US009931581B2

(12) United States Patent
Grossman

(10) Patent No.: US 9,931,581 B2
(45) **Date of Patent: *Apr. 3, 2018**

(54) HELICAL SPRING TOY AND METHOD OF USE THEREOF

(71) Applicant: Victor A. Grossman, Staten Island, NY (US)

(72) Inventor: Victor A. Grossman, Staten Island, NY (US)

( * ) Notice: Subject to any disclaimer, the term of this patent is extended or adjusted under 35 U.S.C. 154(b) by 216 days.

This patent is subject to a terminal disclaimer.

(21) Appl. No.: 13/871,669

(22) Filed: Apr. 26, 2013

(65) Prior Publication Data

US 2013/0309941 A1 Nov. 21, 2013

Related U.S. Application Data

(60) Provisional application No. 61/638,808, filed on Apr. 26, 2012.

(51) Int. Cl.
*A63H 33/00* (2006.01)

(52) U.S. Cl.
CPC ..... *A63H 33/00* (2013.01)

(58) Field of Classification Search
CPC ..... A63H 33/00
USPC ..... 446/397, 486
See application file for complete search history.

(56) References Cited

U.S. PATENT DOCUMENTS 2,213,046 A * 8/1940 Mather ..... 131/240.1
2,455,544 A * 12/1948 Yonkers ..... 285/7
2,658,628 A * 11/1953 Hilgen ..... 211/184
2,778,508 A * 1/1957 Beger ..... 213/211
2,933,201 A * 4/1960 Anderson ..... 213/211
3,222,096 A * 12/1965 Kaman ..... 403/372
3,972,078 A * 8/1976 Maki ..... 4/287
4,219,123 A * 8/1980 Saeki ..... 213/75 TC
5,120,261 A * 6/1992 Dietzman
5,302,148 A * 4/1994 Heinz ..... 446/119
5,310,359 A * 5/1994 Chadbourne et al. ..... 439/462
6,217,451 B1 * 4/2001 Kooy et al. ..... 464/68.92
6,454,624 B1 * 9/2002 Duff et al. ..... 446/91
7,192,328 B2 * 3/2007 Zawitz ..... 446/102
(Continued)

FOREIGN PATENT DOCUMENTS

DE 42 39 633 A1 6/1994

OTHER PUBLICATIONS

Torofluxus, Wikipedia, www.wikipedia.org/wiki/Torofluxus.
Maggie York-Worth, Cool Hunting, Mar. 18, 2010 available at www.coolhunting.com/design/toroflux.

*Primary Examiner* — John E Simms, Jr.
*Assistant Examiner* — Dolores Collins

(57) ABSTRACT

A toy apparatus. The toy including a guide having one or more tracks formed by one or more links; a helical spring coil having first and second ends and a plurality of turns (T) situated about and defining a center axis between first and second ends of the helical coil spring; and/or a coupler which couples the and second ends of the helical spring coil to each other so as to form center opening configured to receive the one or more tracks, wherein an outer surface of one or more of the plurality of turns is in contact with the one or more tracks so that the helical coil spring rotates in a substantially poloidal direction about the central axis when traveling axially along the guide.

20 Claims, 33 Drawing Sheets

(56) References Cited

U.S. PATENT DOCUMENTS 7,601,045 B2 * 10/2009 Zawitz ..... 446/102
8,303,366 B2 * 11/2012 Tremblay et al. ..... 446/92

* cited by examiner

HELICAL SPRING TOY AND METHOD OF USE THEREOF

REFERENCE TO PRIORITY APPLICATION

This application claims priority to U.S. Provisional Application Ser. No. 61/638,808, filed Apr. 26, 2012, and entitled "HELICAL SPRING TOY AND METHOD OF USE THEREOF," the contents of which are incorporated herein by reference in its entirety.

FIELD OF THE PRESENT SYSTEM

The present system relates to a toy, and more particularly, to a coiled toy apparatus and a method of use and manufacture thereof.

BACKGROUND OF THE PRESENT SYSTEM

Toy helixes, springs, and/or coils (hereinafter each of will be commonly referred to as a helical spring for the sake of clarity unless the context indicates otherwise) such as the SLINKY™ are well known and described in, for example, U.S. Pat. Nos. 2,415,012, 4,114,306, 5,626,505, 7,731,562, 7,156,716, D352,971, and D480,769, and U.S. Pat. Publication No. 2002/0102912, the contents of each of which is incorporated herein by reference. The helical springs may be formed from a resilient material such as metal, plastic, carbon fiber, fiberglass, robber, wood, paper, etc. and/or combinations thereof.

SUMMARY OF THE PRESENT SYSTEM

In accordance with an aspect of the present system, there is disclosed a system method, device, computer program, user interface, and/or apparatus (hereinafter each of which will be commonly referred to as a system unless the context indicates other wise for the sake of clarity), which discloses a toy apparatus including a guide having one or more tracks: a helical spring coil having first and second ends and a plurality of turns (T) situated about and defining a center axis between first and second ends of the helical coil spring; and/or a coupler which couples the and second ends of the helical spring coil to each other so as to form center opening configured to receive the one or more tracks, wherein an outer surface of one or more of the plurality of turns is in contact with the one or more tracks so that the helical coil spring rotates in a substantially poloidal direction about the central axis when traveling axially along the guide.

In accordance with some embodiments of the present system, there is disclosed a toy including first through fourth links each having first and second ends; at least one link coupler configured to couple the first through fourth links together; and a spring having first and second ends and a plurality of turns (T), the spring forming a toroid having a center opening configured to receive at least one or the first through fourth links such that at least one of the first through fourth links passes through the opening of the spring, and the spring is configured to travel along the at least one of the first through fourth links which passes through the opening of the spring. It is also envisioned that the toy may include a spring coupler to couple the ends of the spring to each other. Moreover, the spring coupler may include one or more of an adhesive, a hook and loop fastener, a friction-type fastener, and a magnetic fastener. Moreover, the spring may form a torus-like shape in a relaxed closed state. Further, in some embodiments, the first ends of one or more of the first, second, third, and fourth links may be coupled to the at least one link coupler. Further, the toy may include center link coupled to the at least one link coupler. Moreover, the link coupler may hingedly couples one or more of the first through fourth links to one or more of a center link and another one of the first through fourth links. It is further envisioned that the toy may include one or more sensors which may: sense one or more of a proximity of the spring, a velocity or speed of the spring, an angular position of one or more of the first through fourth links, an orientation of the toy, and an acceleration of the toy; and may form corresponding sensor information. The toy may further include a controller which may receive the sensor information and determines a corresponding score for a user. Further, the toy may include a transmission/reception (Tx/Rx) portion coupled to the controller and which may communicate with a network using wired and/or wireless communication methods. In yet other embodiments, the toy may further include a rotational coupler (RC) configured to rotationally couple cross-opposed links of the first through fourth links with each other such that the cross-opposed links are rotationally coupled together and may operate in unison.

In accordance with yet other embodiments of the present system, there is disclosed a toy including: one or more walls configured to form at least part of a cavity situated within the one or more walls; at least one link extending between first and second ends and situated within at least part of the cavity; and/or a spring having first and second ends and a plurality of turns (T), the spring forming a toroid having a center opening configured to receive the at least one link such that the at least one link passes through the opening, and the spring is configured to travel between the first and second ends of the at least one link. It is also envisioned that the one or more walls may form one or more of a sphere and a cylinder. Further, it is envisioned that the one or more walls may further include a center wall situated between end walls. Moreover, it is envisioned that the at least one link may have at least one bend. Further, a chassis may be coupled to the one or more walls and may include two more wheels configured to support the chassis.

In accordance with yet other embodiments of the present system, there is disclosed a computer program stored on a computer readable memory medium, the computer program configured to render information using a user interface (UI) of a toy comprising a helical spring coil having first and second ends and a plurality of turns turned about and defining sa center axis between first and second ends of the helical coil spring, the helical spring coil bent substantially in a closed axial circle by a coupler so as to define a center opening for receiving and exerting a biasing force about a guide member, the computer program including a program portion configured to: determine one or more of location, position, velocity, and acceleration of the helical coil spring; calculate points for a user in accordance with the determined one or more of location, position, velocity, and acceleration of the helical coil spring; update a score for the user in accordance with the calculated points, and/or render the score for the user on a user interface (UI). The program portion may be further configured to calculate the points for at least one player in accordance with came rule information.

In accordance with yet other embodiments of the present system, there is disclosed a computer program stored on a computer readable memory medium, the computer program configured to render information on a user interface (UI), the computer program may include: a program portion configured to: render one or more links and a helical coil spring (HCS) situated about the one or more links; receive an input associated with a link angle; control the angle of the one or more links in accordance with the received input; and determine one or more of position, location, velocity, and acceleration of the HCS in accordance with the controlled angle. The program portion may be further configured to calculate points for a user in accordance with the determined one or more of location, position, velocity, and acceleration of the helical coil spring.

The toy may further include one or more of a shall and one or more wheels coupled to the chassis. Moreover, the toy may further include an actuator coupled to the wheels and at the least one link, wherein the actuator receives an input force from the one or more wheels and outputs a force to cause the at least one link to wobble. In some embodiments, the toy may further include an actuator coupled to the wheels and the one or more walls, wherein the actuator receives an input force from the one or more wheels and outputs a force to cause the at least one or more walls and the link coupled thereto to wobble. It is also envisioned that the at least one link may be coupled to the one or more walls. Further, a controller such as a microprocessor may receive sensor information, process the sensor information to, for example, computer a score for one or more users, determine a number of plays available, a number of lost turns (plays), determine speed of the play spring (e.g. the HCS), etc., and render information in accordance with received sensor information. It is also envisioned that the rendered information may be output on one or more of a display, one or more illumination sources, a speaker, and a haptic generator. The haptic generator may generate a haptic signal which may be detected by a user. For example, when it is determined that the spring has entered an end zone, the controller may cause a red illumination source to light (e.g., a red light emitting diode (LED, etc.) and may cause a speaker such as a buzzer to emit an audible sound. In some embodiments, it is envisioned that the toy may further include one more inserts placed within at least a portion of the cavity. It is also envisioned that the one or more inserts may further include one or more of graphics and text. Further, the toy may include a gimbal coupled to one or more of the one or more walls and the link.

In yet other embodiments of the present system, there is disclosed a toy including an endless helical coil spring (HCS) having ends and a plurality of turns (T) situated between the ends, wherein the HCS further comprises a coupler for coupling the ends so that the HCS forms a torus-like (or toroid) shape (e.g., when relaxed) having a center opening. The HCS may be stretched by one or more links such that the HCS (or wave spring) may form other shapes when stretched. One or more light sources may provide illumination and be coupled to one or more turns of the HCS. It is also envisioned that the controller may control the one or more light sources to illuminate.

In accordance with yet other embodiments of the present system, there is disclosed a toy including: an endless helical coil spring (HCS) having ends and a plurality of turns (T) situated between the ends, wherein the HCS further include: a coupler for coupling the ends so that the HCS forms a torus-like shape having a center opening, and one or more restrictors coupled to a plurality of turns of the HCS so as to limit a separation of the coupled turns from each other.

In accordance with yet other embodiments of the present system, there is disclosed a computer program stored on a computer readable memory medium, the computer program, configured to render information using a user interface (UI) of a toy comprising a helical spring coil having first and second ends and a plurality of turns turned about and defining a center-axis between first and second ends of the helical coil spring, the helical spring coil bent substantially in a closed axial circle by a coupler so as to define a center opening for receiving and exerting a biasing three about a guide member, the computer program may include: a program portion configured to: determine one or more of location, position, velocity, and acceleration of the helical coil spring; calculate points for a user in accordance with the determined one or more of location, position, velocity, and acceleration of the helical coil spring: update a score for the user in accordance with the calculated points, and/or render the score for the user on a user interface (UI). The program portion may be further configured to calculate the points in accordance with game rule information.

In accordance with yet other embodiments of the present system, there is disclosed a computer program stored on a computer readable memory medium, the computer program configured to render information on a user interface (UI), the computer program including: a program portion configured to: render one or more links and a helical coil spring (HCS) situated about the one or more links; receive an input associated with a link angle; control the angle of the one or more links in accordance with the received input; and/or determine one or more of position, location, velocity, and acceleration of the HCS in accordance with the controlled angle. The program portion may be further configured to calculate points for a user in accordance with the determined one or more of location, position velocity, and acceleration of the helical coil spring. It is also envisioned that the program portion may be further configured to update a score for the user in accordance with the calculated points. It is also envisioned that the program portion is further configured to render the score for the user on a user interface (UI). Moreover, in yet other embodiments, the program portion may be further configured to calculate the points in accordance with game rule information and/or sensor information.

BRIEF DESCRIPTION OF THE DRAWINGS

The invention is explained in further detail, and by way of example, with reference to the accompanying drawings wherein.

DETAILED DESCRIPTION OF THE PRESENT SYSTEM

The following are descriptions of illustrative embodiments that when taken in conjunction with the following drawings will demonstrate the above noted features and advantages, as well as further ones. In the following description, for purposes of explanation rather than limitation, illustrative details are set forth such as architecture, interfaces, techniques, element attributes, etc. However, it will be apparent to those of ordinary skill in the art that other embodiments that depart from these details would still be understood to be within the scope of the appended claims. Moreover, for the purpose of clarity, detailed descriptions of well-known devices, circuits, tools, techniques and methods are omitted so as not to obscure the description of the present system. It should be expressly understood that the drawings are included for illustrative purposes and do not represent the scope of the present system. In the accompanying drawings, like reference numbers in different drawings may designate similar elements.

For purposes of simplifying a description of the present system, the terms "operatively coupled", "coupled" and formatives thereof as utilized herein refer to a connection such as an electrical connection and/or a mechanical connection between devices and/or portions thereof that enables operation in accordance with the present system.

Figure 1:
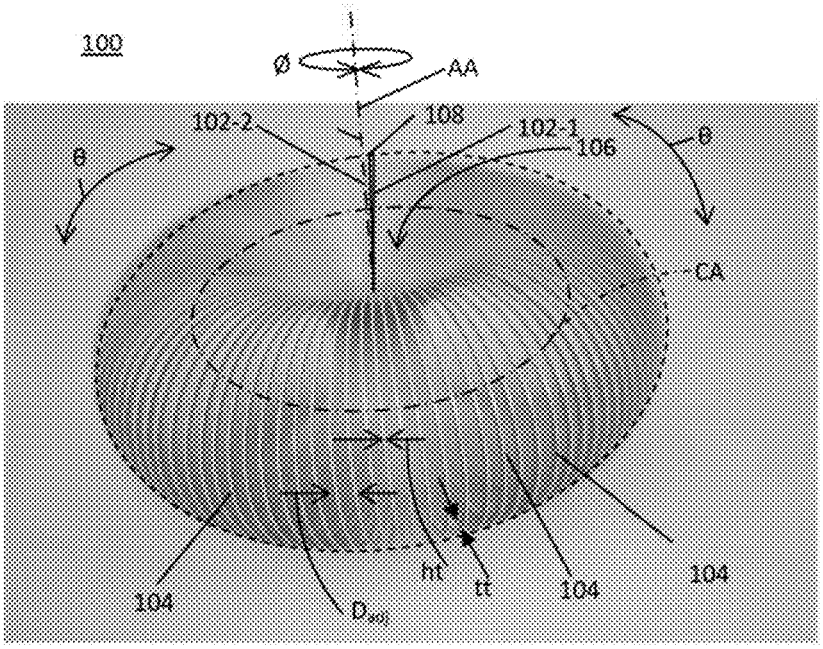
FIG. 1 is a perspective view of a helical coil spring (HCS) in a natural state in accordance with embodiments of the present system.

FIG. 1 is a perspective view of a helical coil spring (HCS) 101 in a natural state in accordance with embodiments of the present system. The helical spring 101 may include first and second ends 102-1 and 102-2 (generally 102-*x*) and may include a plurality of turns 104 situated about and defining a center axis (CA) substantially between the ends 102-*x*. A coupler 108 may couple ends 102-1 and 102-2 of the helical spring 101 together using any suitable method (e.g. using pressure-sensitive adhesive, hook-and-loop fasteners, staples, rivets, screws, tabs, notches, attachment rings, etc.) so that the HCS 101 forms a closed loop which has a central opening 106 and defines an axial axis (AA) which extends through the central opening 106. Accordingly, the CA may form a closed or substantially closed loop. For the sake of clarity, it will be assumed that the HCSs illustrated without limitation in FIGS. 2 through 16C, 18, and 23-50C and described in the corresponding text may be similar to the HCS 101. In some embodiments, it is envisioned that the HCS 101 may include other types of spring such as a wave-spring.

The HCS 101 may be formed from one or more helical springs such as a SLINKY™-brand helical coil springs by Poof-Slinky, Inc.; Magic Springs™ (e.g., Mini Metal Magic™ springs) by Toy Investments, Inc. dba Toysmith; or the like. Moreover, suitable helical springs are described in the U.S. Pat. Nos. 2,415,019, 7,731,562; and/or and U.S. Patent Application No. 61/598,538, entitled "HELICAL SPRING TOY AND METHOD OF USE THEREOF," to Grossman, the contents of each of which are incorporated herein by reference. However, it is also envisioned that other springs may be used. For example, in some embodiments, the spring may include a wave spring or the like.

In a (e.g. closed loop) natural state, when substantially no external forces are acting upon the HCS 101, the HCS 101 may form a torus-like shape having a toroidal axis (TA) (e.g., toroid) which may correspond with the central axis (CA). Further, the turns 104 of the HCS 101 may rotate about the CA in a direction (e.g., a substantially poloidal direction) as indicated by theta (θ) as shown in FIG. 1. However, when subject to external forces (e.g., from acceleration, vibration, deflection, tension, compression, gravity, etc.), the HCS 101 may be deformed and may assume other shapes. As the CA may change shapes in accordance with the deformation (e.g., due to stretching, vibration, etc.) of the HCS 101, it may differ from the TA. However, regardless of changes in the shape of the HCS 101 (e.g., oval, torus, circular, splined, etc.) as may occur during use of embodiments of the present system, the rotation of the turns 104 of the HCS 101 may be referred to as a rotation in the poloidal direction and may be illustrated as theta (θ). Further, if the HCS 101 is formed using a plurality of helical coil springs, each helical coil spring may be attached to each other using couplers which, for example, may be similar to, or different from, the coupler 108. The free ends of the plurality of coupled helical coil springs may be attached to each other so as to form the HCS 101. Moreover, when subject to a release force from or manipulation from a user, the coupler 108 may release the ends 104-*x* of the HCS 101 from each other so as to open the HCS 101, if desired. It may be desirable to open the HCS 101 for various reasons such as for untangling and/or to perform conventional activities such as may be performed using a conventional SLINKY™ (e.g., a HOCS) such as stair walking, etc. Accordingly the HCS 101 may include a releasable coupling so that it may be opened (e.g., ends may be uncoupled from each other) to form a helical open coil spring and may be closed (e.g., ends coupled to each other so as to form a closed or substantially closed loop) so as to form an HCS 101. For the sake of clarity, an opened HCS 101 will be referred to as a helical open coil spring (HOCS) so that it is not confused with an HCS 101 (or derivatives thereof) which may take the form of a torus in their natural state. Further, it is envisioned that one or more turns 104 of the HCS 101 may overlap each other and/or the coupler may couple two or more of the overlapped turns 104 to each other.

Figure 2:
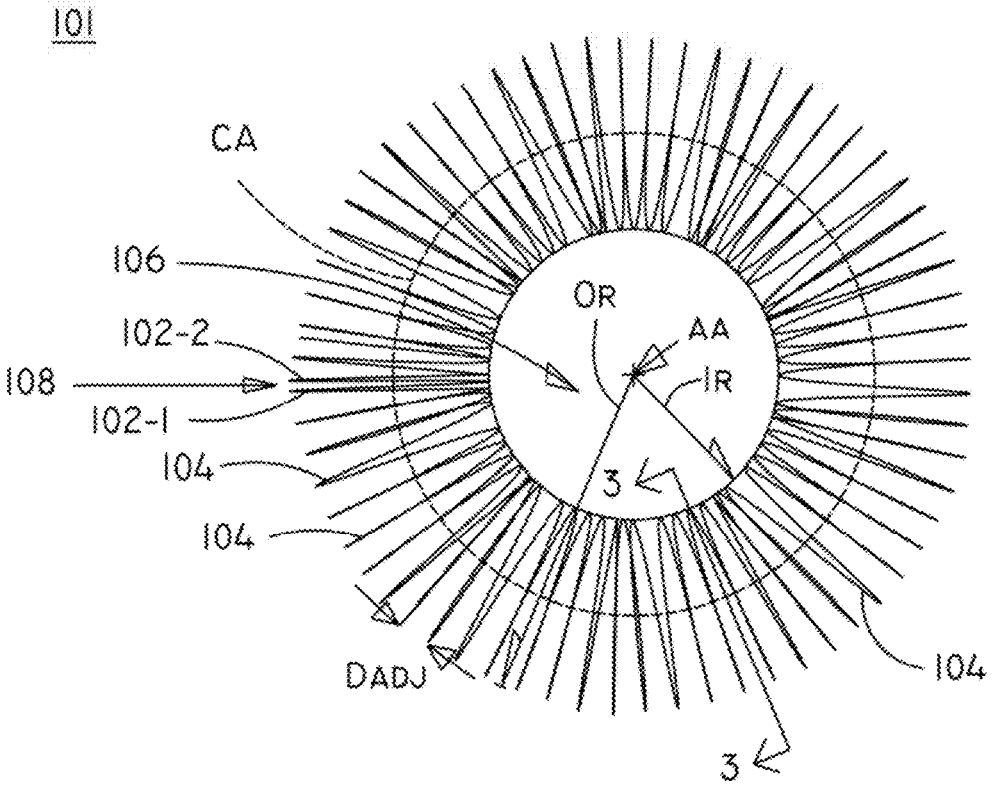
FIG. 2 is a top planar view of the HCS of FIG. 1 shown in a natural state in accordance with embodiments of the present system.

FIG. 2 is a top planar view of the HCS 101 of FIG. 1 shown in a natural state in accordance with embodiments of the present system. The central opening 106 may have a shape and/or size suitable for receiving one or more objects such as links as will be described elsewhere. Further, the central opening 106 may stretch to conform to one or more other objects inserted therethrough (e.g., through the central opening 106). Accordingly, the HCS 101 may be placed about one or more objects such as one or more links as will be described below and one or more external surfaces of the HCS 101 may exert a biasing force about one or more portions of the link. Accordingly, when the link (e.g., inserted through the central opening 106) and the HCS 101 are moved relative to each other (e.g., the link is moved along an axial axis of the HCS 101), the turns 104 of the HCS 101 may rotate about the CA of the HCS 101 as illustrated by theta (θ) of FIG. 1 which may be known as a poloidal direction (PD). This rotation may be due, at least in part, to a frictional force between an external surface of one or more turns 104 of the HCS 101 and a surface of the link. As discussed above, although the HCS 101 may assume a torus-like shape under certain conditions (e.g. without significant external forces), it may be deformed and assume other shapes. Accordingly, when the HCS 101 is deformed (e.g., and does not assume a torus-like shape), the PD may correspond with an angular rotation of each turn about the CA. It is further envisioned that the shape and/or size of the central opening 106 may vary based upon objects inserted therethrough and/or external forces acting upon the HCS 101. Distances between adjacent surfaces of adjacent turns 104 may be denoted by ($d_{adj}$) and may vary based upon, for example, angular position (e.g., location) about the CA. Accordingly, when in a natural state, adjacent surfaces of adjacent turns may be in contact with each other at the inner radius (ir) and may be separate from each other at an outer radius (Or) (also known as a torus radius) of the HCS 101. However, when the HCS 101 is stretched due to external forces (e.g., static and/or dynamic), adjacent turns 104 may move apart from each other and may no longer contact each other at the ir.

With regard to friction, one or more outer surfaces of the HCS 101 may include a friction-enhancing material surface such as rubber, latex, or other types of friction-enhancing materials, if desired. Accordingly, for example the HCS 101 may be formed substantially from steel or plastic and may include a friction-enhancing layer or surface, if desired to enhance friction between the HCS 101 and one or more links or other surfaces which the HCS 101 is in contact with. Further, for the sake of clarity, slippage has not been taken into account. However, in actual embodiments, there may be some slippage when the link (e.g., inserted through the central opening 106) and the HCS 101 are moved relative to each other. Accordingly, theta (θ) may be less than calculated values due to slippage. Further, the HCS 101 may be configured to apply a sufficient force against the one or more links which may pass through the central opening 106 of the HCS 101. A bottom planar view is similar to the top planar view.

Figure 3:
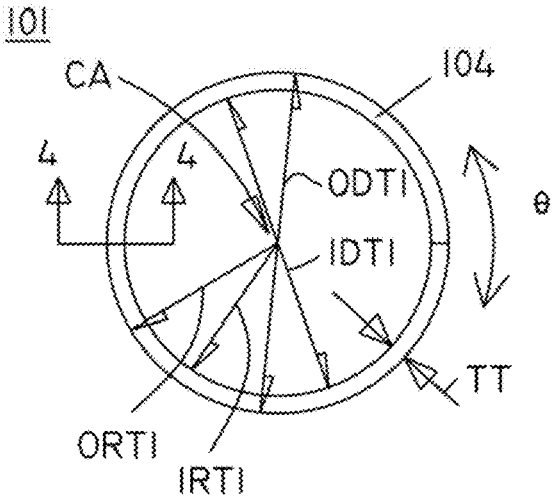
FIG. 3 is a cross-sectional view of the HCS taken along lines 3-3 of FIG. 2 in accordance with embodiments of the present system.

FIG. 3 is a cross-sectional view of the HCS 101 taken along lines 3-3 of FIG. 2 in accordance with embodiments of the present system. Each turn 104 of the HCS 101 may have an outer diameter (odt) (also known as a barrel outer diameter) and an inner diameter (idt) (also known as a barrel inner diameter) when measured across a diameter of the HCS 101 (e.g., through the CA of the corresponding turn). Likewise each HCS 101 may have an outer radius (ort) and an inside radius (irt), where each of the ort and the irt extends substantially from the CA of a corresponding turn 104 and is substantially equal to one half of the odt and the idt, respectively. Accordingly, each turn 104 may have a thickness (tt) which may be constant or may vary with position and may be defined as a difference between the ort and the irt. Further, the thickness (tt) of adjacent turns 104 of the HCS 101 may be constant or may vary relative to each other.

Although a substantially round cross section is shown in FIG. 3, in yet other embodiments, it is envisioned that the HCS may include a cross section laving other shapes such as slightly oval, a star, a flower, a heart, a polygon, etc. However, if it is desired that the HCS turn about its CA easily during use, the cross section should be configured to easily permit the HCS to rotate about its CA.

Further, in yet other embodiments of the present system, it is envisioned that the HCS 101 may be placed about objects such as a rod, a cylinder, a stick, a cone, a baton, a sinusoidal shaped rod, a curved rod, a splined rod, etc.

With regard to the spring (e.g., the play spring), in some embodiments it may include a helical coil spring, a wavespring, etc. having a number of coils and ends which may be coupled together to form a donut- or torus-like shape when relaxed. However, in yet other embodiments, it is envisioned that the spring may include an elastic member such as a latex tube, a foam tube, etc. having ends coupled to each other which may form a donut or torus-like shape when in a relaxed position and/or may have a center opening through which one or more links may pass. However, in yet other embodiments, it is envisioned that the spring (e.g., the play spring) may be substituted with a rigid ring such as a rigid plastic ring. The ring and or the links which may pass through the ring may be coated with a non-stick surface to reduce friction, if desired. However, when using a spring which may rotate, a friction enhancer may be used to increase friction between the spring and links passing therethrough, if desired.

Figure 4:
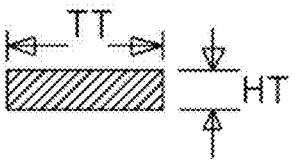
FIG. 4 is a cross-sectional view of the HCS taken along lines 4-4 of FIG. 3 in accordance with embodiments of the present system.

FIG. 4 is a cross-sectional view of the HCS 101 taken along lines 4-4 of FIG. 3 in accordance with embodiments of the present system. Each turn 104 may have a height (ht) which may be constant or may vary based upon position relative to the CA. Further, the height (ht) of adjacent turns 104 may vary from each other. Further, the thickness tt and/or height ht of each turn 104 may be varied to change a spring constant of the corresponding turn 104 of the HCS 101. Although a rectangular cross section for turns 104 is shown for the sake of clarity, in alternative embodiments, it is envisioned that the turns 104 may have cross-sections with other shapes and/or sizes. Accordingly, in yet other embodiments of the present system, it is envisioned that upper and/or lower surfaces (us) and (ls), respectively, of the turn 104 may include a rounded area, a bend, a crescent, a spline, etc. For the sake of clarity, in some drawings, the play spring, (e.g., the HCS etc.) may be shown using an outline form.

Figure 5:
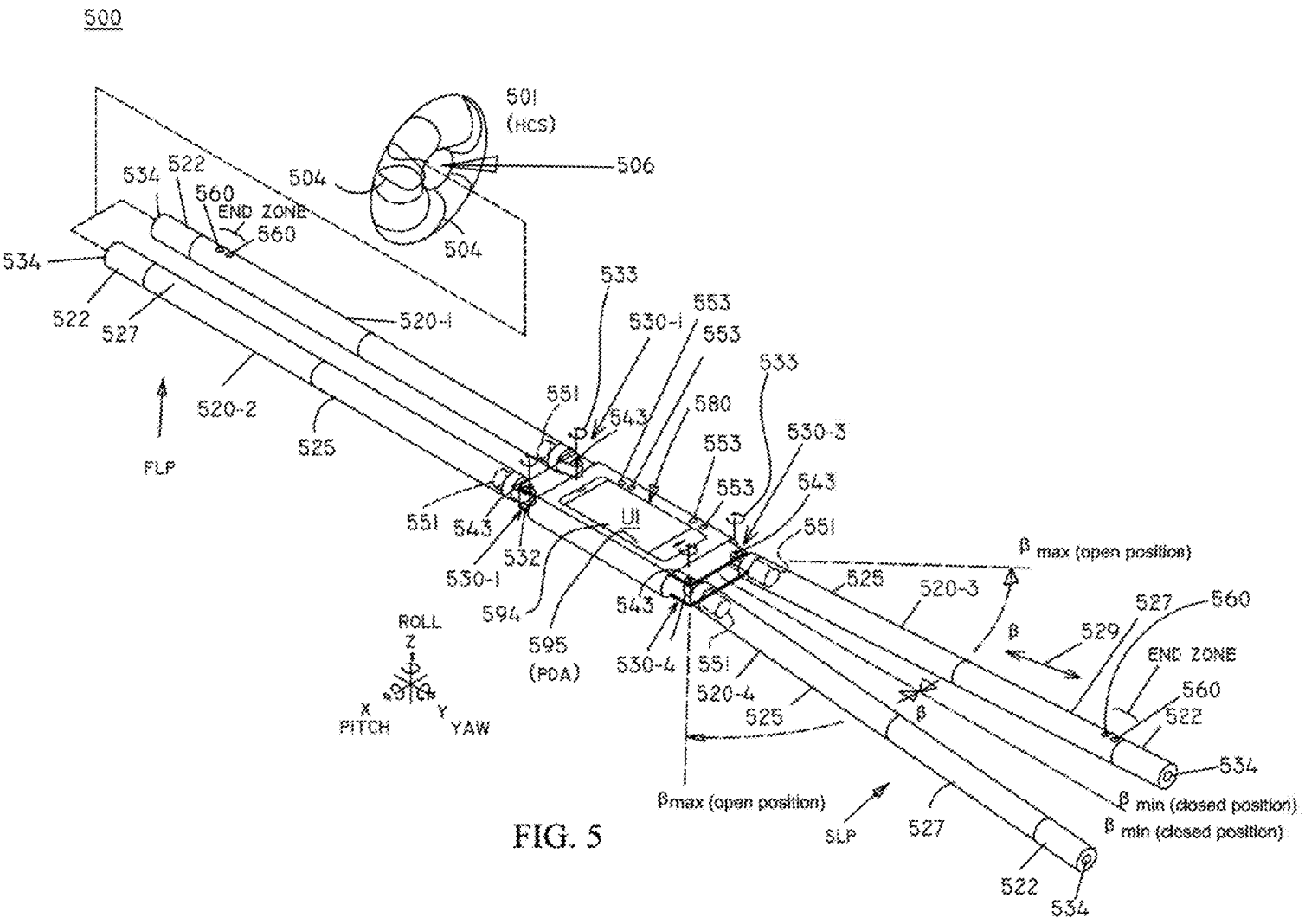
FIG. 5 is an exploded front perspective view of a portion of an apparatus in accordance with embodiments of the present system.

FIG. 5 shows an exploded front perspective view of a portion of an apparatus 500 in accordance with embodiments of the present system. The apparatus 500 may include one or more of an HCS 501, a center link 521, and links 520-1 through 520-4 (generally 520-*x*). The links 520-*x* may be coupled to the center link 521 by a coupler 530-*x* and are shown in a substantially closed position. However, other positions such as a substantially closed or opened or positions therebetween are also envisioned. The HCS 501 may be similar to the HCS 101 and is preferably formed from metal and may include turns 504 and a center opening 506. The apparatus 500 may be suitable for simultaneous use by multiple users (e.g., multiple players). For example, a first user may manipulate links 520-1 and 520-2 (e.g., a first link pair (FLP)) while a second user may manipulate links 520-3 and 520-4 (e.g., a second link pair (SLP)) so as to control movement of the HCS 501 along a path defined by the first and/or second link pairs across the apparatus 500. Each of the links 520-1 through 520-4 may have proximal ends 532 and distal ends 534 and, for the sake of clarity each of the links 520-*x* may be considered to be similar to each other. However, it is also envisioned that one or more of the links 520-*x* may be different from another of the links 520-*x* and may, for example, include curves, bends, etc., along a longitudinal length thereof, if desired. However, for the sake of clarity, it will be substantially straight links 520-*x* will be assumed. The proximal ends 532 of one or more of the links 520-1 through 520-4 may be coupled to the center link 521 via corresponding couplers 530-1 through 530-4 (generally 530-*x*), respectively. The couplers 530-*x* may include any suitable coupler such as a simple hinge including, for example, a hinge pin 543 defining a hinge axis 541 about which corresponding links 520-*x* may rotate as illustrated by arrow 533 with a desired rotational range of motion which may correspond with a difference between maximum and minimum values of β where the maximum value of beta is $\beta_{max}$ and the minimum value of beta is $\beta_{min}$ which correspond with open and closed positions, respectively, of a corresponding link 520-*x*. Thus, the rotational range of motion for a corresponding link 520-*x* may be equal to $\beta_{max}-\beta_{min}$ where each link 520-*x* is assumed to have substantially equal $\beta_{max}-\beta_{min}$ values. However, in yet other embodiments, $\beta_{max}$ and/or $\beta_{min}$ may vary by link 520-*x* and/or by link pair. For example, links of a first link pair (FLP) (e.g., 520-1 and 520-2) may have the $\beta_{max}$ and/or $\beta_{min}$ values which are different from $\beta_{max}$ and/or $\beta_{min}$ values, respectively, for links a second link pair SLP (e.g., 520-3 and 520-4 in the present example).

For example, it is envisioned that each of the links 520-*x* may have a rotational range of motion of between 0 and approximately 70 degrees (e.g. $\beta_{max}-\beta_{min}$=70-0), although other ranges and/or values (e.g., 0-90 degrees, etc.) are also envisioned and may be set by the user and/or system (e.g., using hinge stops such as adjustable screws, if desired).

In other embodiments, it is envisioned that the couplers 530-*x* may include ball-and-socket-type couplers, hidden hinges, compound hinges, live hinges, etc. It is further envisioned that each of couplers 530-*x* may include a limiter (e.g., fixed or adjustable) to define the rotational range of motion of a corresponding link 520-*x*. Accordingly, for example, in some embodiments a user may adjust open and closed positions such that a value of $\beta_{max}$ and/or $\beta_{min}$ may be adjusted (e.g., $\beta_{max}$ may be set from 45 degrees to 70 degrees, etc.). It may be desired to adjust a values of $\beta_{max}$ and/or $\beta_{min}$ so as to prevent the HCS 101 from overstretching or to adjust to a players skill level, etc.

The couplers 530-*x* may include an optional damper to dampen motion (e.g., to provide a resistive force) and/or an optional biasing member (e.g., a spring, etc.) to provide a return force to, for example, return a corresponding link 520-*x* to a desired position (e.g., a default position) relative to the center link 521 and/or to an adjacent link 520-*x*, if desired. Further, in yet other embodiments it is envisioned that each of the links 520-*x* may have several degrees of freedom and may move one or more planes. Accordingly, the couplers 530-*x* may include for example, ball-and-socket type couplers, live hinges, compound hinges, etc., which may provide desired a desired range of motion in each of the one or more planes. Further, with regard to live hinges, these hinges may include an elastic material (e.g., rubber, latex, etc.) which may be coupled to (e.g., by molding, bonding, adhesives, friction fits, screws, pins, etc.) the center link 521 and to distal ends 532 of corresponding links 520-*x*. In yet further embodiments, it is envisioned that covers (e.g., bellows type covers, elastic covers, resilient covers (e.g. latex, etc.)) may cover one or more portions of the couplers. Further, with regard to elastic couplers (e.g., of live hinges), it is envisioned that portions of adjacent elastic couplers may be formed integrally with each other, if desired.

The apparatus 500 may include one or more of a controller, a sensor, a memory, and a user interface (UI), The controller may include one or more processors (located locally and/or remotely from each other) and may receive sensor information from the one or more sensors. The UI may included a display, a speaker, and/or user input keys (e.g., hard or soft) and may render information received from the controller. Further, the controller may receive user selections from the UI and may output information to the UI. For example, the UI may included a touch-screen display which may display content received from the controller and/or may receive user selections (e.g., menu-item selections, keyboard selections, etc. entered by the user) and transmit corresponding information to the controller. However, in yet other embodiments, it is envisioned that the UI may include a plurality of illumination sources (e.g., light emitting diodes (LEDs), etc.) to output information to a user and/or hard or soft keys for selection by a user. Accordingly, a user may enter a selection via the hard and/or soft keys and this information may be transmitted to the controller for further processing. Further, the UI may include a transducer, a speaker, and/or a haptic generator (e.g., a transducer) which may output audio and/or haptic information for the convenience of a user. The UI may further include a microphone (MIC) which may receive audio information and transmit the received audio information to the controller for further processing. Further, the controller may process the audio information and determine one or more corresponding commands and/or determine corresponding text information (e.g., using a speech-to-text application). Similarly, the controller may include a text-o-speech application to convert text information (e.g., such as may be included in game information, etc. as will be discussed below) and render corresponding audio information for the convenience of the user(s). The controller or sensors may communicate with one or more other computational device such as a smart phone (e.g., an IPhone™, a Blackberry™, a Nexus™, etc.), a tablet (e.g., an Ipad™), a personal digital assistant (PDA (e.g., a IPad Touch™, a), a mobile station, a personal computer, a laptop, a netbook, a gaming device (e.g., a Wii™, an Xbox™, etc.), etc. (hereinafter each of which will be commonly referred to as a user device (UD) for the sake of clarity) using any suitable method such as by a wired and/or wireless links. Further, it is envisioned that one or more of the controller, sensors, a memory, and a user interface (UI) may be included within the UD. Accordingly, it is envisioned that the apparatus 500 may include a cavity such as cavity 580 which may receive the UD. It is further envisioned that the apparatus 500) may include cavities and/or circuitry for receiving one or more power sources (e.g., batteries, a solar cell, an inductive charger, etc., to provide power to the apparatus 500), a transmitter/receiver (e.g., coupled to the controller), etc.

One or more of the links 520-*x* and/or the center link 521 may include a telescopic portion so that the corresponding link 520-*x* or center link 521 may be telescopically extended and/or contracted, as desired. Accordingly, for example, the length of the center link 521 and/or one or more of the links 520-*x* may be adjusted for storage (e.g., in a contracted state) and/or play (e.g., in an extended state), as desired. For example, each of the links 520-*x* may include portions 525 and 527 one of which may telescope within or relative to the other as illustrated by arrow 529. Moreover, each of links 520-*x* may fold so as to compact the apparatus 500 (e.g., for storage, transport, etc.). Accordingly, for example, each of the links 520-*x* may include hinge such as a hidden hinge (e.g., a barrel hinge, etc.) 551 which may enable the corresponding link 520-*x* to fold relative to itself and/or to the center link 521. Further, a hinge 551 and/or a corresponding link 520-*x* may include a lock to prevent the folding of the link 520-*x* during operation of the apparatus 500. Further, it is envisioned that two or more of the links 520-*x* may include a common hinge. Moreover, in yet other embodiments, it is envisioned that the center link 521 may include one or more cavities (or portions thereof) configured to receive at least part of one or more of the links 520-*x* so as to compact the apparatus 500 (e.g., for storage, shipping, etc.).

The apparatus 500 may include sensors to determine position of the HCS 501 and/or a physical orientation (e.g., yaw, pitch, and/or roll) of the apparatus 500 or parts thereof. For example, the sensors may provide information related to rotational positions of one or more of the links 520-*x* relative to each other and/or to the center link 521. Further, the sensors may provide information related to a position of the HCS 501 relative to for example, one or more of the links 520-*x* and/or the center link 521. Accordingly, the apparatus 500 may include sensors such as an inclinometer, magnetic orientation sensors (e.g., operating in one or more axes), gravity sensors (e.g., operating in one or more axes), accelerometers (e.g., in one or more axes, etc.), optical sensors (e.g., an image capture device, infrared (IR) sensors, etc.), capacitive sensors, proximity sensors, microphones, mechanical switches, etc., which may provide corresponding sensor information to the controller. For example, optical-type sensors (e.g. infra-red (IR) sensors, etc.), may sense when the HCS 501 passes over the optical sensor, form corresponding sensor information and/or may provide the corresponding sensor information to the controller for further processing. Thus, the sensors may provide information indicative of location of the HCS 501 to the controller. This sensor information may then be processed by the controller to determine, various game information such as, for example, one or more of speed, direction, number of repetitions, and/or maximum travel amplitude of the HCS 501 relative to one or more links 520-*x* and/or center link 521.

However, it is also envisioned that proximity sensors such as those provided by the Microsoft™ Kinect™ system may interface with the apparatus 500 to provide information related to, for example, a location/orientation of one or more of the apparatus 500, the HCS 501 (relative to one or more portions the apparatus 500), and/or one or more users (players) relative to a fixed object and/or each other, for further processing and/or rendering on a UI (e.g., a display, etc.) of the system. For example, the Kinect™ system may provide information related user gestures and to tilt (e.g., corresponding with a inclination of the apparatus an/or parts thereof in pitch or roll) the apparatus 500 which information may rendered for the convenience of one or more users and may be used to calculate a score, outs, plays, etc., for a corresponding user. For example, the controller may compare a current pitch of the apparatus 500 (e.g., 5 degrees, etc.) to a predetermined threshold tilt value (e.g., 20 degrees). Accordingly, if it is determine that the current pitch is equal to or greater than the threshold tilt value, the controller may compute a score for a user and/or may assign an out or subtract a play from a current user. However, if it is determine that the current pitch is less than the threshold tilt value, the controller may compute a score for the current user. These actions may be determined in accordance with game rules (GR) which may be set and/or selected by the system and/or user. The GR may contain information related to sensor information such as speed, location, link angles (e.g., link rotational angles) (e.g., alpha ($\alpha$), beta ($\beta$) etc.), roll, pitch, and/or yaw, and corresponding actions (e.g., associated points or point calculation methods, lost plays (or outs), bonuses, point multipliers, etc. Further, the OR may include information for a particular game type (type 1, type 2, type 3, default, user defined 1, user defined 2, etc.) and/or experience level (e.g., novice, intermediate, expert, etc.). The game type may be selected by a user for example who may wish to play a game in accordance with certain selected game rules corresponding with the game type. Accordingly, points, scores, lost plays or outs, may be determined in accordance with the game rules of a corresponding game type. This may provide for an easy selection of game rules which may be applicable to the selected game type. However, it is also envisioned that the user and/or system may select game rules rather than using preselected rules. Further, the controller may determine information related to a current tilt (e.g. roll and/or pitch) of the apparatus and render this information on a UI of the apparatus 500 for the convenience of the user.

In some embodiments, it is envisioned that a controller may determine a current value of alpha ($\alpha$) and/or beta ($\beta$), and may render a corresponding tone, pitch, musical note(s), score(s), an auditory attribute of musical tones and/or an audio (and/or video) file (e.g., an MPEG-3 file, etc.), based upon the determined value of alpha ($\alpha$) and/or beta ($\beta$). Thus, for example, a value or range of alpha ($\alpha$) and/or beta ($\beta$) (e.g., 0-20 degrees) may be mapped to, for example, a certain audio file while another value or range of alpha ($\alpha$) and/or beta ($\beta$) (e.g., 21-45 degrees) may be mapped to, for example, a different audio file. Accordingly, for example, as a user opens and/or closes a link pair, the controller may determine a value of a current value of alpha ($\alpha$) and/or beta ($\beta$) and may determine and thereafter render a corresponding tone, pitch, musical note(s), score(s), an auditory attribute of musical tones, etc., and/or an audio (and/or video) file (e.g., an MPEG-3 file, etc.), based upon the determined value of alpha ($\alpha$) and/or beta ($\beta$) for a user's entertainment.

Further, when in embodiments which may include a conductive HCS 501 (e.g., a steel or metallic plated helical coil spring), capacitive or magnetic proximity sensors may be used to provide sensor information indicative of a location of the HCS 501 in relation to one or more of the links 520-*x*, the center link 521, the couplers 530-*x*, etc.

Accordingly, in embodiments of the present system, the apparatus 500 may include, for example, optical, capacitive, mechanical, or other types of sensors to determine location of the HCS 501 at, for example, any given time. For example, the apparatus 500 may include one or more optical sensors placed at various locations to sense whether the HCS 501 has passed over the corresponding sensor and form corresponding sensor information. Accordingly, for example, optical sensors 560 may be provided on or more of the links 520-*x* and/or the center link 521 to sense a location of the HCS 501 and provide this information to the controller which may then determine location, speed, and/or direction of the HCS 501 and may output this information via the UI for the convenience of the user. Moreover, the controller may use this information to determine a score for a corresponding user. Thus, the sensors may provide sensor information to the controller which may then process the sensor information and determine, for example, various game information (GI) such as one or more of number of repetitions (e.g., of the HCS 501 between, for example, the first and second link pairs), instantaneous speed (Inst. Spd) of the HCS 501 (e.g., as the HCS 501 passes a speed trap at the center link 521), average speed (Av Spd) of the HCS 501 (e.g. as calculated at the speed trap of the center link 521), maximum displacement at a side of the apparatus 500 (e.g., relative to a corresponding link 520-*x*, zone 1, zone 2, zone 3, end zone, etc.), a total distance the HCS traveled during the current game (e.g., Dist.), total duration of play (Time), acceleration of the HCS, orientation of a portion of the apparatus such as the center link (e.g., relative to horizontal) in or more axes (e.g., tilt), user score(s), points, plays, outs, etc. This information may be displayed as shown FIG. 17 as will be discussed below. The controller may then render the GI and/or information related thereto, on a UI of the system for the convenience of one or more users.

The controller may include one or more processors which may be local and/or remote from each other. Further, the apparatus 500 may include a transmitter/receiver which may be coupled to the controller and may transmit and/or receive information such as the GI to and/or from a remote device such as a UD (e.g., a smart phone (e.g., an IPhone™, etc.), a tablet (e.g., an Ipad™), a personal digital assistant (PDA), personal computer, a laptop, a netbook, a gaming device (e.g., a Wii™, an Xbox™, etc.), etc.) which may then process the CG (and/or related sensor information) and store the GI as well as associated information (e.g., names/identification of users, day/date/time, GI, final scores, etc.). However, it is also envisioned that the sensors may transmit sensor information directly to the remote device for further processing and/or rendering.

Accordingly, the apparatus and/or the remote device may include an application which may provide a user interface (UI) with which a user may interact with and/or select, for example, a number of game players (e.g., by number (e.g., two players, etc.), identify the game players (e.g., John and Jane, etc.), select game skill or play level (e.g., advanced, intermediate, novice, etc., game type (speed trap, endurance, user defined, etc., in accordance with a predefined game rule set), etc. The players may then play a selected game (selected from predefined or user defined game rule set (e.g., speed trap, in the current example)) on the apparatus 500, and information related to game may be transmitted to the UD for further processing, rendering and/or storage (e.g., in a memory of the system) for the convenience of one or more users.

With regard to the games, the memory may store information related to game rules and/or historical information such as information related to stored games (e.g., previous high score, game history, player name, etc.).

Further, it is envisioned that the apparatus 500) may include a dock for the UD (e.g., a smart phone (e.g., an IPhone™, etc.)). The dock may include a cavity 580 which may be configured to receive at least part of the UD and may further be configured to hold the UD such that the UD is extends outward from, is flush with, or is recessed relative to an outer periphery of the apparatus 500. Further, the apparatus 500 may include a panel such as a flip panel which may cover at least a portion of the cavity 580 and may protect the UD. The flip panel may be made from any suitable material such as a clear plastic panel (e.g., made from polycarbonate, etc.). However, regardless of configuration, the cavity 580 should such be configured such that the UD does not interfere with operation of the apparatus 500 when, for example, the HCS 501 travels past the UD.

Figure 6:
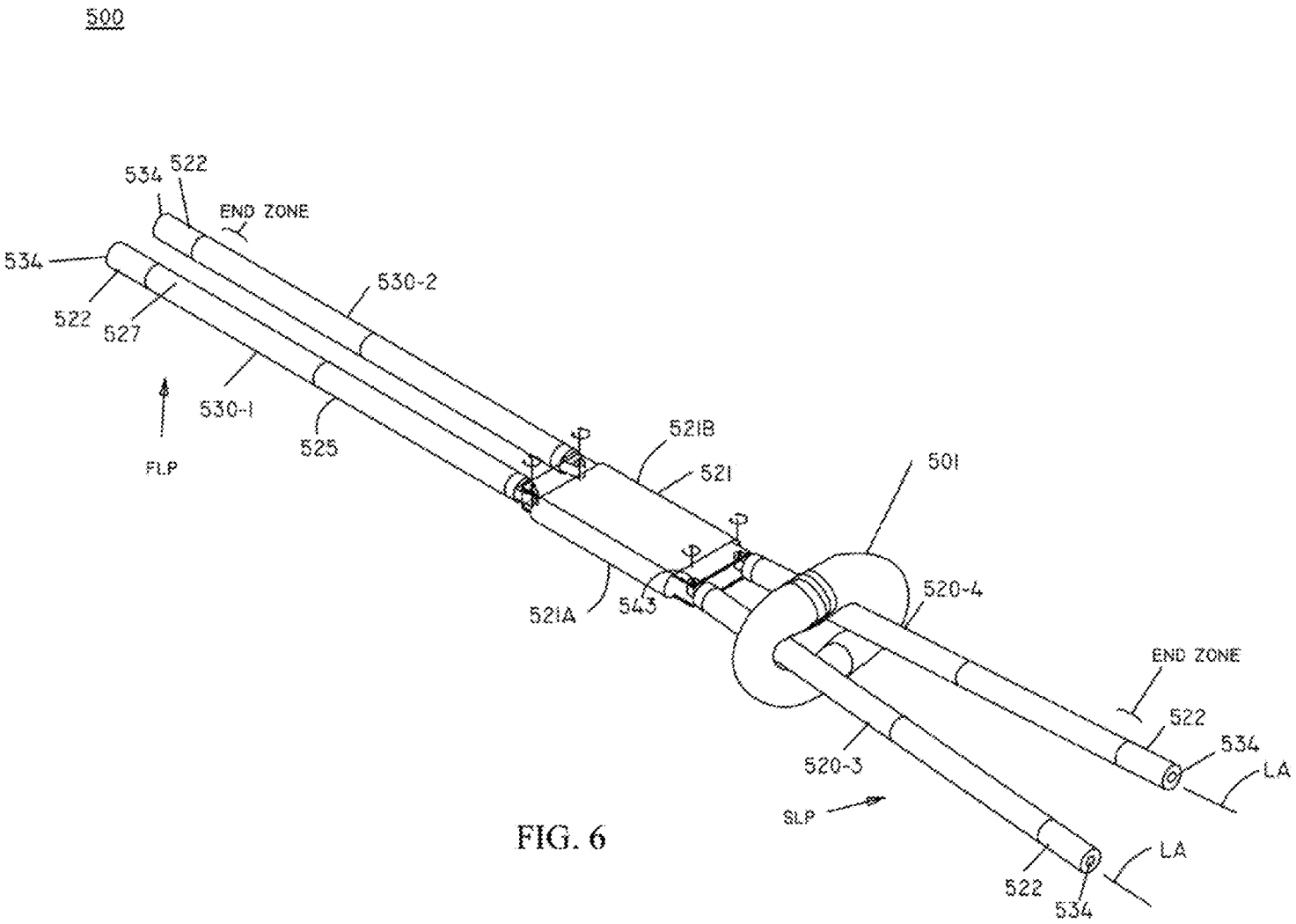
FIG. 6 is a rear perspective view of a portion of the apparatus of FIG. 5 in accordance with embodiments of the present system.

FIG. 6 is a rear perspective view of a portion of the apparatus 500 of FIG. 5 in accordance with embodiments of the present system. The center link 521 may be formed from a single unitary member. However, in other embodiments of the present system, it is envisioned that the center link 521 may be formed from a plurality of components. For example, the center link 521 may be formed as a clamshell having front and rear halves 521A and 521B, respectively, each of which may include one or more components and may be assembled together to form a completed center link 521, if desired.

Figure 7:
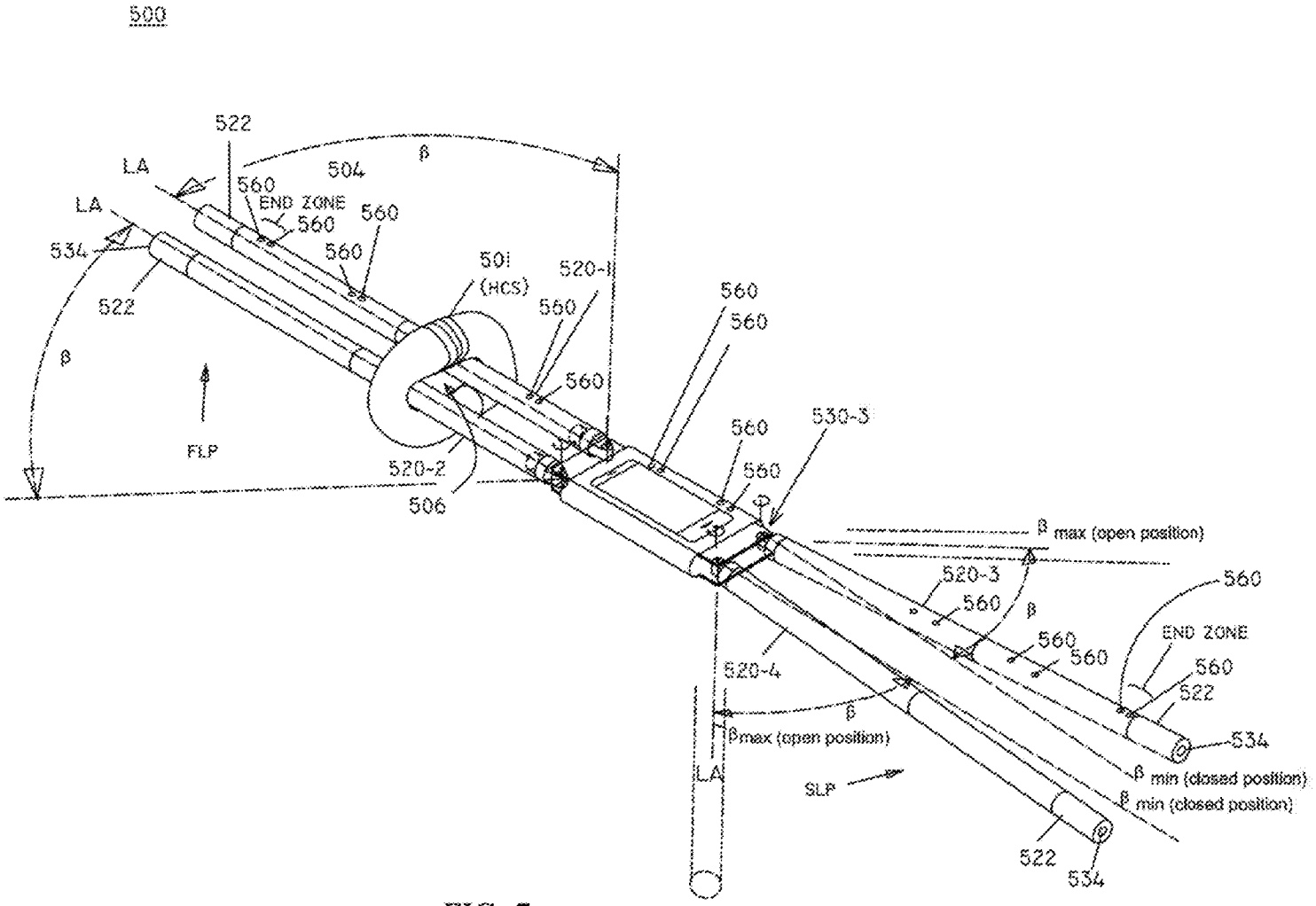
FIG. 7 is a front perspective view of a portion of the apparatus of FIG. 5 in accordance with embodiments of the present system.

FIG. 7 is a front perspective view of a portion of the apparatus 500 of FIG. 5 in accordance with embodiments of the present system. One or more of the links 520-*x* and the center link 520 may pass through the center opening 506 of the HCS 501. Accordingly, the HCS 501 and travel along one or more of the links 520-*x* and the center link 520 during operation of the apparatus 500 and may substantially rotate about its CA. Each of the links 520-*x* may have a corresponding as angular range of motion as illustrated by corresponding angles $\beta_{max}$ $\beta_{min}$ (e.g., 0-70 degrees) as measured between a longitudinal axis (LA) of a corresponding link 520-*x* in a substantially closed and a substantially opened positions, respectively. However, other values and/or ranges are also envisioned and may be set and/or preset by a manufacturer and/or user. Although the angular range of motion is illustrated with reference to rotation in a single plane about a single axis (e.g., the HA 541), in yet other embodiments it is envisioned that the range of motion may include multiple planes and/or axes. Accordingly, for example, in these embodiments values of $\beta$ ($\beta_{max}$, $\beta_{min}$, and/or $\rho_{inst}$), may include subcomponents such as $\beta_x$, $\beta_y$, $\beta_z$, which may correspond with, for example, for x, y, and z, or other planes, respectively.

The HCS 501 may be stretched by links of a link pair (e.g., the FLP or the SIP about which extend through the opening 506 of the HCS 501) which are spread apart from each other at, for example, their distal ends 534. The links of the link pair may be spread apart by a user and/or by the controller (e.g., operating via one or more actuation devices as solenoids, etc.). By spreading a link pair (FLP, SLP) apart at the distal c ds, the corresponding link pair (FLP or SLP) forms an incline (e.g., in free space) relative to a longitudinal axis (LA) of each of the links 520-*x* of the corresponding link pair. The as the HCS is assumed to be located at the distal ends 534 of a corresponding link pair) it is assumed to stretch and have a corresponding potential energy (e.g. due to stretching of the turns 504 of the HCS 501) which is greater than its potential energy in its natural state (which will be assumed to be that substantially similar to the energy level when the HCS is about an un-spread (e.g. substantially closed, etc.) links 520-*x*, for the sake of clarity) and may attempt to travel along the incline in a direction which may decrease the potential energy of the HCS 501 due to the stretching. As the HCS 501 moves along a length of the corresponding link pair (FLP or SLP), a friction force between an outer surface of one or more turns of the HCS 501 may act to cause the HCS 501 to rotate about its CA, absent any significant slippage.

However, with regard to slippage, it has been found that certain embodiments, combinations of the HCS and link pairs (FLP or SLP) may experience relatively low friction even when a stretched HCS provides a tension (e.g., due to normal values of tension of the stretched HCS) against the corresponding link pair (FLP or SLP). In these combinations, the HCS may slip relative to the corresponding FLP or SLP and may not substantially rotate about its CA as it travels along an incline in a direction which may decrease the potential energy of the HCS (e.g., due to the stretching). Accordingly, to enhance friction between the HCS and/or one or more of the links (e.g., 520-*x* and/or 521) may include a friction enhancing surface (e.g. rubber, etc.) to increase friction, if desired.

Further, with regard to tension of the HCS, the HCS may be configured (e.g., by adjusting a length the HOCSs from which the HCS if formed) so as to provide a desired amount of tension during use of the HCS with a desired apparatus such as the apparatus 500. Thus, for example, reducing a number of turns of the HCS (e.g., by removing end turns of the HCS) may cause the HSC to tighten about one or more of the links 520-*x* and/or 521.

Figure 8:
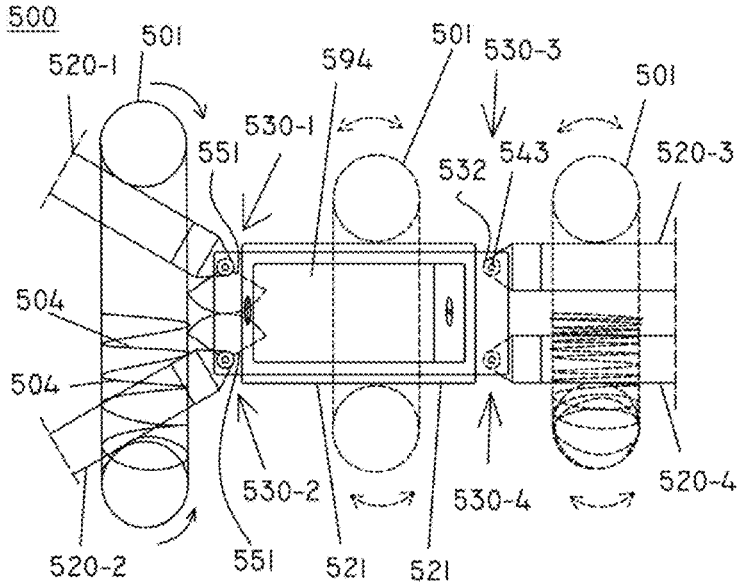
FIG. 8 is a top view of a portion of the apparatus of FIG. 5 in accordance with embodiments of the present system.

FIG. 8 is a lop view of a portion of the apparatus 500 of FIG. 5 in accordance with embodiments of the present system. In some embodiments, each of link may include a gear which is coupled to another gear (e.g., having the same ratio) of an adjacent link of a corresponding link pair (e.g., the SLP and the FLP). Accordingly, when a link is rotated (e.g., relative to the center link), the adjacent link of the same link pair would rotate an corresponding amount in an opposite direction relative to the center link. Thus, for example, if a first link is opened 10 degrees relative to a center link, the second link (e.g., of the same link pair) would open a corresponding amount (e.g., 10 degrees) in an opposite direction relative to the center link. The other link pair may be coupled in a similar manner. This may assure proper alignment For example, each link 520-*x* of a link pair (e.g., the SLP and the FLP) may include a gear (or pulley) 551 which may be coupled to the adjacent link 520-*x* of the corresponding link pair. The gears 551 may have the same ratio as each other such that the links 520-*x* of the corresponding link pair may be rotationally coupled to each other. This may further align the center link 521 with the link pairs during use. The center link may include a cavity in which the gears 551 or pulleys may be located. It is also envisioned that the links 520-*x* may be rotationally coupled to each other using a linkage, if desired.

Figure 9A:
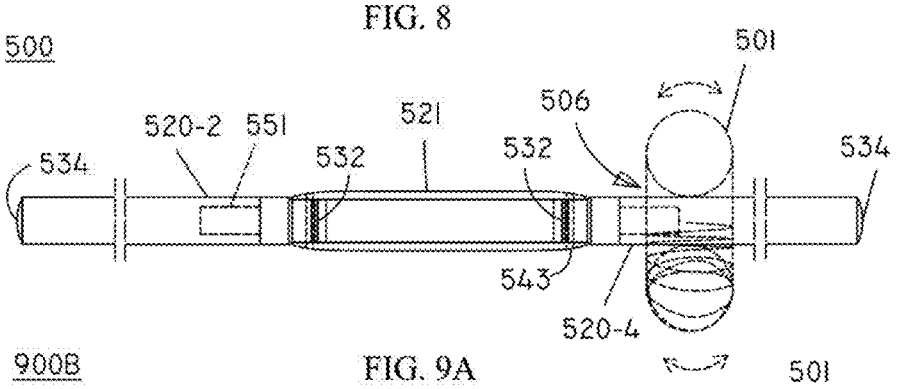
FIG. 9A is a side view of a portion of the apparatus of FIG. 5 in accordance with embodiments of the present system.

FIG. 9A is a side view of a portion of the apparatus 500 of FIG. 5 in accordance with embodiments of the present system.

Figure 9B:
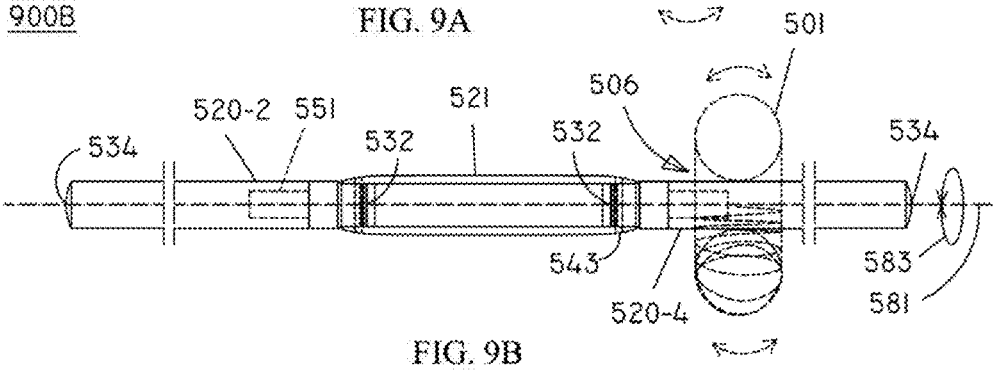
FIG. 9B is an exploded side view of a portion of the apparatus 900B in accordance with embodiments of the present system.

FIG. 9B is an exploded side view of a portion of the apparatus 900B in accordance with embodiments of the present system. The apparatus 900B may be similar to the apparatus 500. However, the apparatus 900B may include a center link 521B including one or more rotators 585 (e.g., slip rings, bearings, etc.) which rotationally couples first and second portions 521A and 521B of the center link 521B, respectively, together. Accordingly, the first portion 521A of the center link 521B may rotate about a longitudinal axis 581 of the center link 521B as illustrated by arrow 583. Similarly, the second portion 521B of the center link 521B may rotate about the longitudinal axis 581 of the center link 521B as illustrated by arrow 587 independently of first portion 521A. Further, rather than cavity 580, the apparatus 900B may have a cavity 585.

Figure 10:
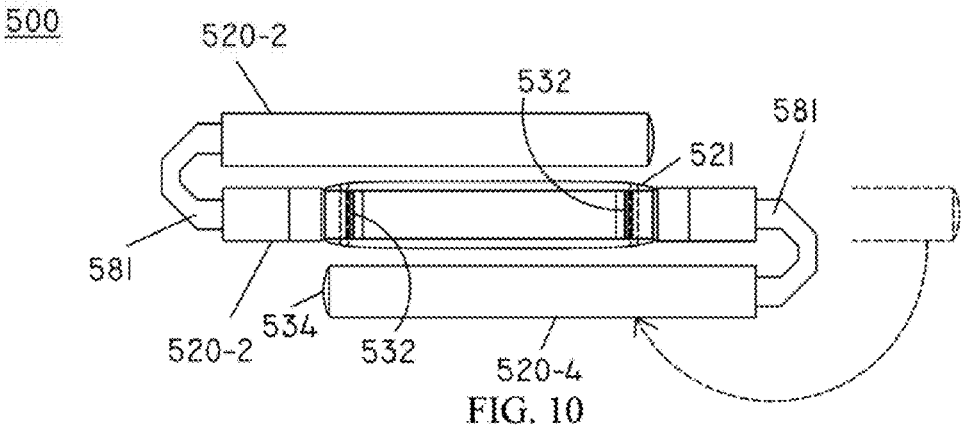
FIG. 10 is a side view of a portion of the apparatus of FIG. 5 in a substantially folded configuration in accordance with embodiments of the present system.

FIG. 10 is a side view of a portion of the apparatus 500) of FIG. 5 in a substantially folded configuration in accordance with embodiments of the present system. The links 520-*x* may be folded one or more times so as to reduce an overall length of the apparatus 500 which may minimize volume of the apparatus 500. This may be desirable for storage, transport, packaging, shipping, etc. Portions of the hinges 551 such as hinge links 581 are shown. The center link 521 may include a cavity for receiving the HCS 501 which may be opened (e.g. to form a HOCS) and/or partially flattened so as to conserve space such that it may easily fit within a cavity. Further, the links 520-*x* may be shorted by, for example, telescoping them to a substantially closed telescopic position. However, in yet other embodiments, the links may include portions which may be removed from each other to reduce length of the corresponding links if desired.

Figure 11A:
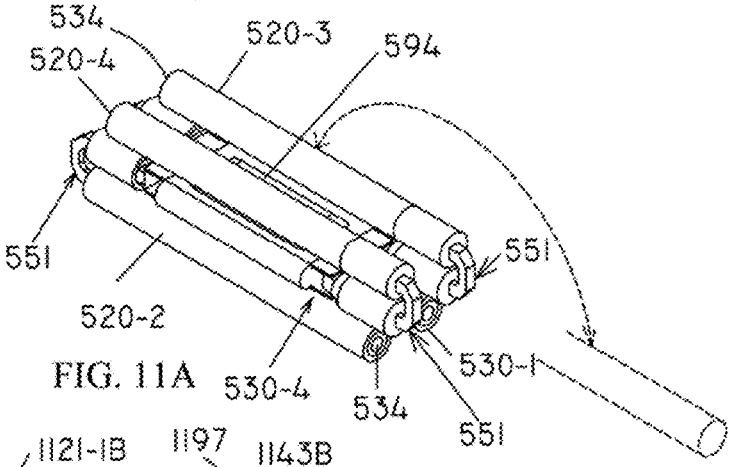
FIG. 11A is a front perspective view of a portion of the apparatus of FIG. 5 in a substantially folded configuration in accordance with embodiments of the present system.

FIG. 11A is a front perspective view of a portion of the apparatus 500 of FIG. 5 in a substantially folded configuration in accordance with embodiments of the present system. Each of the hinges 551 may include a locking member to lock a corresponding link 520-*x* in a desired position. Further, the apparatus 500 may include a strap which may be wrapped around the apparatus 500 so as to hold the apparatus 500 in the substantially folded position, if desired.

Figure 11B:
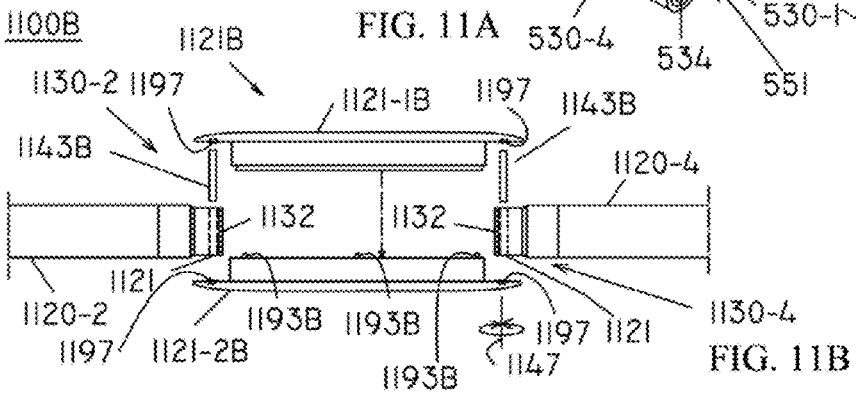
FIG. 11B is an exploded side view of a portion of a apparatus in accordance with embodiments of the present system.

FIG. 11B is an exploded side view of a portion of the apparatus 1100B in accordance with embodiments of the present system. The apparatus 1100B may be similar to the apparatus 500 and may include first through fourth links 1120-1 through 1120-4 ((generally 1120-*x*) which may be similar to the links 520-*x*) and which may be coupled to a center link 1121-1B by a corresponding coupler 1130-1 through 1130-4 (generally 1130-*x*), respectively. Each coupler 1130-*x* may include a hinge pin 1143B configured to fit within an opening 1121 of a corresponding link 1120-*x*. The links 1120-*x* may be similar to the links 520-*x*. The center link 1121-B may be similar to the center link 521. However, the center link 1121-B may include an upper portion 1121-1B and a lower portion 1121-2B (thus forming a clamshell type center link) which may be attached to each other using any suitable method such as a friction fit using for example, tabs 1193B which may engage notches configured to receive the tabs 1193B. However, in yet other alternative embodiments, screws, welds, adhesives, rivets, etc., may be used to attach the upper portion 1121-2B together. One or more of the upper portion 1121-1B and the lower portion 1121-2B may include a saddle 1197 which may include an opening configured to receive a corresponding hinge pin 1143B.

Figure 11C:
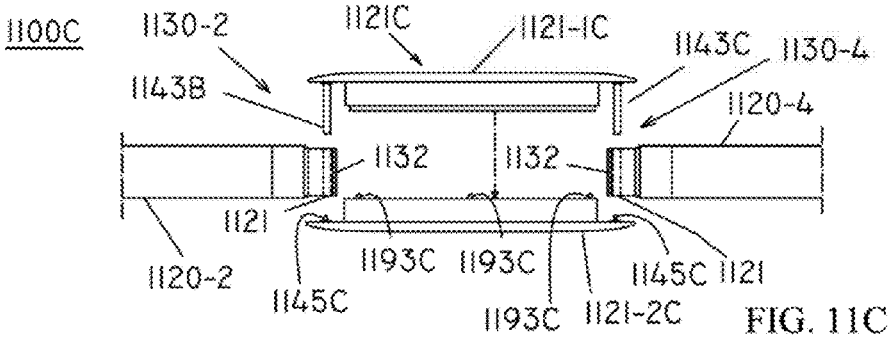
FIG. 11C is an exploded side view of a portion of a apparatus in accordance with embodiments of the present system.

FIG. 11C is an exploded side view of a portion of an apparatus 1100C in accordance with embodiments of the present system. The apparatus 1100C is similar to the apparatus 1100B and may include links 1120-*x* coupled to a center link 1121C. However, the apparatus 1100C includes hinge pins 1143C which may be formed integrally with an upper portion 1121-1C (or a lower portion 1121-2C) of a center link 1121C. The lower portion 1121-2C (or the other upper portion 1121-1C) may include a saddle 1145C configured to receive the hinge pins 1143C. Links 1120-*x* may be configured to receive the hinge pins 1143C and rotate about an axis defined by the hinge pins 1143C.

In certain embodiments of the present system, the one or more of links (e.g., cross-opposed links of the first and second link pairs) may be rotationally coupled to an opposite opposed link, if desired. (e.g., sing links, etc.). Accordingly, for example, one link of each of the first and second link pairs may be rotationally coupled to a link (e.g., a cross-opposed link) of the other link pair for single user (player) operation and these links may be rotationally decoupled from each other for multiple user (e.g., simultaneous player) operation as described below with respect to FIGS. 12-16 below.

Figure 12:
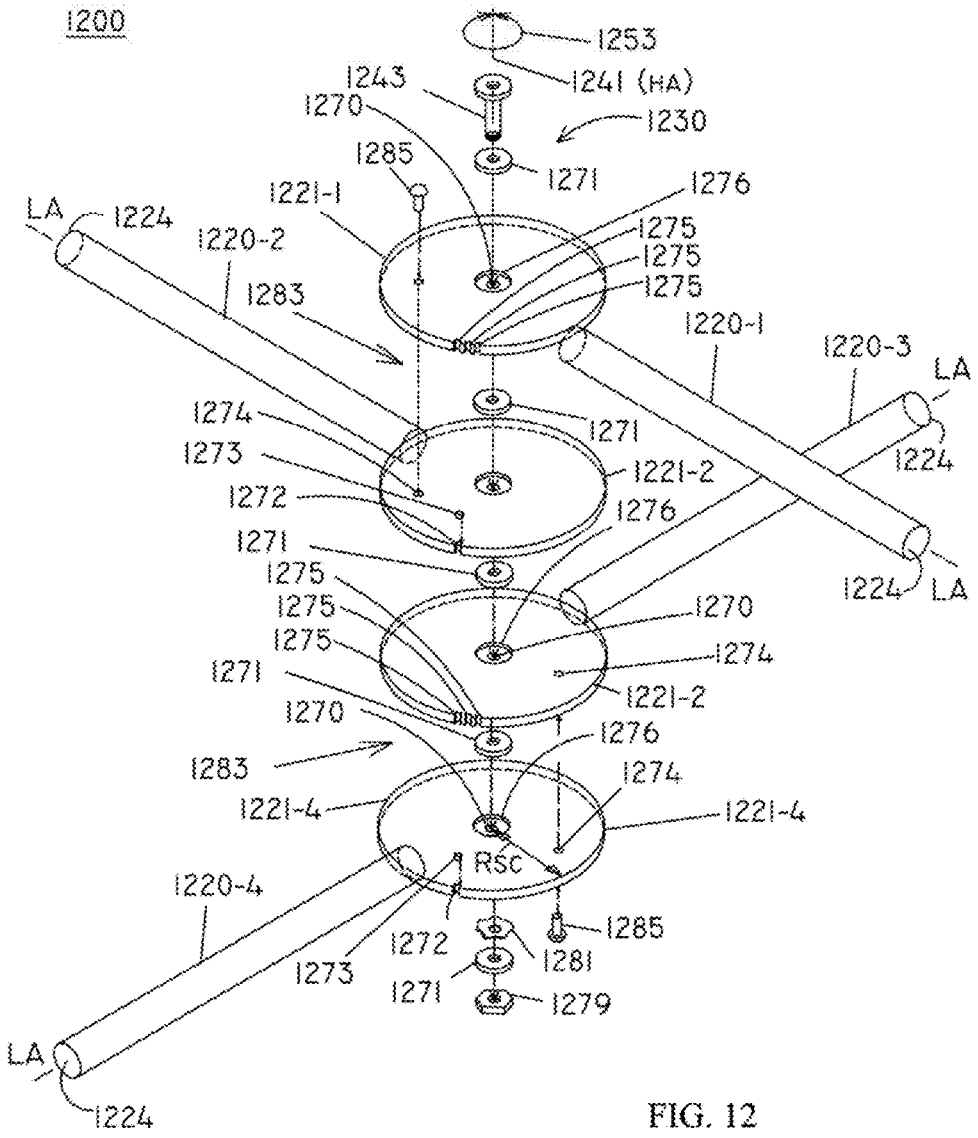
FIG. 12 is an exploded front perspective view of a portion of an apparatus in accordance with embodiments of the present system.

FIG. 12 shows an exploded front perspective view of a portion of an apparatus 1200 in accordance with embodiments of the present system. The apparatus 1200 may include one or more of a center link 1221 and links 1220-1 through 1220-4. The center link 1221 may include a plurality of center links 1221-1 through 1221-4 (generally 1221-*x*) each of which may be coupled to a corresponding link 1220-1 through 1220-4, respectively. The links 1220-1 and 1220-2 may form a first link pair (FLP) and the links 1220-3 and 1220-4 may form a second link pair (SLP). For the sake of clarity, at will be assumed that each of the links 1220-*x* may be similar to each other and may include proximal and distal ends 1232 and 1234, respectively, and may define a longitudinal axis (LA). However, in yet other embodiments, it is envisioned that each of the links 1220-*x* may be different from each other and may for example, include curves, bends, etc. For example, it is envisioned that in certain embodiments the links may include a twenty (20) degree (although other values are also envisioned) bend between their proximal and distal ends, if desired.

When viewed from the top, the center link 1221 may be substantially round and should be sized such that the HCS 1201 may pass easily over it during use. However, in yet other embodiments, the center link 1221 may include other shapes and/or sizes.

One or more of the links 1220-*x* may include a folding or telescoping mechanism to adjust a length or a corresponding link 1220-*x*, if desired. However, it is also envisioned that the links 1220-*x* may be formed from one or more sections which may be coupled to each other to adjust a length of a corresponding link 1220-*x*. An HCS 1201. (e.g., see, FIG. 13) which may be similar to the HCSs 101, 501, etc., may be placed about one or more of the links 1220-*x* and/or the center link 1221 such that they may pass through a center opening 1206 of the HCS 1201.

The center links 1221-*x* may be coupled to each other using any suitable coupling method so as to form the center link 1221. For example, a coupler 1230 may be inserted through optional openings 1270 in one or more of the center links 1221-*x*. The coupler 1230 may include any suitable coupler such as a pin, a rivet, an axle, a threaded coupler, etc., and may be coupled to the center links 1221-*x* so as to define a rotational axis (e.g., a hinge axis (HA) 1241) about which the links 1220-*x* and their corresponding center links 1221-*x* may rotate as illustrated by arrow 1253. Each of the center links 1221-*x* may have a radius ($R_{cl}$) which extends from a center of a corresponding center link 1221-*x*. The rotational axis may pass through the center of each of the center links 1221-*x*. The coupler 1230 may include a threaded coupler such as a bolt 1243 which may be inserted through the openings 1270 in one or more of the center links 1221-*x* and may be locked in position using a locking member such as a threaded nut 1279. However, it is also envisioned that the locking member may include a pin (e.g., inserted through an opening of the bolt member), a lock ring, a locking washer, an expanded area (e.g., a compressed area such as on a rivet), etc. Friction reducing members such as one or more spacers such as washers 1271 may be situated between one or more of the center links 1221-*x* and/or about the coupler 1230. The spacers may be configured to decouple turning forces (e.g., rotational forces) between one or more of the center links 1221-*x* and/or the coupler 1230 as one or more of the discs 1221-*x* is rotated about the rotational axis relative to another (e.g., such as may occur during use of the apparatus 1200). Accordingly, the spacers may be formed from a material which may reduce friction such as Teflon™, nylon, steel, etc. However, in yet other embodiments, spacers may include ball bearings situated in races between one or more of the center links 1221-*x* and/or about the coupler 1230 such as is common to "lazy-susan"-type rotary turntables. Further, a biasing member such as one or more springs may coupled to one or more of the center links 1221-*x* so as to bias these links into a desired position (e.g., substantially opened, substantially closed or positions therebetween) absent forces from a user, if desired.

Further, in yet other embodiments, it is envisioned that the spacers may be formed integrally with one or more of the center links 1221-*x*. Further, it is also envisioned that the coupler 1230 may be formed integrally with one or of the center links 1221-*x*. An optional biasing member such as a wave spring 1281, a coil spring, etc., may provide a biasing force against one or more of the center links 1221-*x*, if desired. Further, the threaded coupler may be configured such that a user may adjust a tension of the threaded coupler, if desired, so as to adjust resistance of the center links 1221-*x* to rotate about the hinge axis 1241 during use. The coupler 1230 may pass through an opening of the biasing member such as the wave spring, 1281, etc. Thus, the rotational resistance of the link pairs 1220-*x* such as occurs when rotating the links 1220-*x* about the hinge axis 1241 (e.g. when opening or closing one or more link pairs (FLP, SLP)) may be adjusted (e.g., by a manufacturer and/or by a user) by adjusting resistance between the center links 1221-*x* via the coupler 1230 so as to obtain a desired resistance when using the apparatus 500. It is further envisioned that an adjustment member may be configured to allow a user to easily lighten or loosen the threaded coupler, if desired so as to adjust tension of the threaded coupler and thus rotational resistance of the center links 1221-*x* relative to each other, if desired. It is further envisioned that the one or more of the center links 1221-*x* may include a recess 1276 to receive the washers 1271 or other friction reducing members (e.g., nylon or Teflon™ washers), if desired. A depth of the recesses 1276 may be adjusted so as to adjust a depth of an exterior surface of the washers 1271 or other friction reducing members, if desired.

It is also envisioned that the apparatus 500 may include end caps situated over the center links 1221-1 and 1221-4.

Further, in yet other embodiments it is envisioned that a dampener may be coupled to two or more of the center links 1221-*x* to dampen rotational movement between corresponding center links 1221-*x* when they are rotated about the hinge axis relative to each other. The damper may include a friction dampener such as a mechanical dampener, a friction modifying gel, etc., situated between one or more of the center links 1221-*x*. Further, it is also envisioned that the dampener may include a friction material whose viscosity may fixed or adjustable.

One or more of the links 1220-*x* may be coupled to a corresponding one of the center links 1221-*x* such that the longitudinal axis of the corresponding link 1220-*x* (at least near the proximal end 1232 of the corresponding link 1220-*x*) may be slightly offset from the hinge axis (HA) 1241 by a distance (Co). However, in yet other embodiments it is envisioned that one or more of the links 1220-*x* may be coupled to a corresponding one of the center links 1221-*x* such that the longitudinal axis of the corresponding link 1220-*x* (at least near the proximal end 1232 of the corresponding link 1220-*x*) may pass through hinge axis (HA) 1241. In yet other embodiments, it is envisioned that a corresponding link 1220-*x* may be coupled to a corresponding one of the center links 1221-*x* using a hinge (e.g. using a pin, a live hinge, etc.) that the longitudinal axis of the corresponding link 1220-*x* may shift relative to the hinge axis (HA) 1241. In yet other embodiments, it is envisioned that one or more of the links may be detachably coupled to the center link.

As mentioned above, cross-opposed links of the first and second link pairs (FLP and SLP, respectively) may be rotationally coupled to together for single user (player) operation and rotationally de-coupled from each other (with regard to rotation about a rotational axis) for multiple user (e.g., simultaneous player) operation. Accordingly, the apparatus 500 may include a rotational coupler (RC) to rotationally couple cross-opposed links 1221-*x* of the first and second link pairs (e.g., 1220-1 and 1220-3; and 1220-2 and 1220-4) with each other such that the cross-opposed link pairs rotate about the HA 1241 together as a pair when selectively rotationally coupled together and may rotate about the HA 1241 independently of each other when selectively rotationally decoupled from each other. The RC may include any suitable mechanism to rotationally couple the selectively cross-opposed link pairs together. For example, the RC may include a friction mechanism (e.g. a cam-type friction mechanism, etc.), a latch-type mechanism, a pin or peg type mechanism, etc. Further, the center links 1221-*x* of diagonally opposed links 1220-*x* of the first and second link pairs may be configured such that they (e.g., the center links 1221-*x*) are adjacent to each other and may be coupled together by the RC. However, in yet other embodiments, it is also envisioned that the adjacent center links 1221-*x* of (e.g., coupled to) diagonally opposed links 1220-*x* of the first and second link pairs may be configured such that they (e.g., the center links 1221-*x*) are not adjacent to each other.

The RC may include any suitable mechanism, for example, RC may include a latch-type coupler 1283 which may include a latch member 1273 which may be configured to slidably fit within notches 1272 of adjacent center links 1221-*x*. The latch member 1273 may include an engaged position and a disengaged position. In the engaged position, the latch member 1273 may engage notches 1272 of both of the adjacent center links 1221-*x* so as to rotationally couple links 1220-*x* of the corresponding cross-opposed link pairs 1220-*x* together (e.g. 1220-1 and 1220-3 or 1220-2 and 1220-4) as illustrated with reference to FIG. 15A which shows a cross-sectional view of a portion of the center links 1221-*x* of the apparatus 1200 taken along lines 15-15 of FIG. 14 in accordance with embodiments of the present system. However, in the disengaged position, the latch member 1273 engages notches 1272 of a single one or of the adjacent center links 1221-*x* so as to rotationally dc-couple links 1220-*x* of the corresponding cross-opposed link pair 1220-*x* (e.g., 1220-1 and 1220-3; or 1220-2 and 1220-4) as illustrated with reference to FIG. 15B which is a cross-sectional view of a portion of the center links 1221-*x* of the apparatus 1200 taken along lines 15-15 of FIG. 14 in accordance with embodiments of the present system. Further, one or more of the center links 1221-1 or 1221-3 may include multiple notches 1275 each of which may be similar to notch 1272 and configured to receive at least part of the latch member 1273, if desired. By configuring a plurality of notches 1272 and/or 1275 adjacent to one another a user may rotationally couple links 1220-*x* of the corresponding cross-opposed link pair 1220-*x* (e.g., 1220-1 and 1220-3; or 1220-2 and 1220-4) at various angles relative to the HA 1241, if desired.

However, in yet other embodiments, it is envisioned that the RC may include other suitable mechanisms such as optional pins or pegs such as pegs 1285 which are configured to be inserted into optional openings 1274 of adjacent center links 1221-*x* so as to rotationally couple these center links 1221-*x* together so that these center links (e.g., 1221-1 and 1221-3; and/or 1221-2 and 1220-2 and 1221-4) rotate about the hinge axis 1241 as a link pair. Different embodiments of RCs (e.g., pin or pegs and latches) are shown for illustration only. However, it is also envisioned that the RC may include a cam-type friction mechanism, other types of latching mechanisms, electronic clutches, electro-mechanical clutches, mechanical clutches, etc. As the links 1220-*x* are coupled to respective center links 1221-*x*, coupling the center links 1220-*x* may effectively couple corresponding ones of the links together. However, in yet other embodiments, it is envisioned that links may be coupled together using linkages, etc.

Figure 13A:
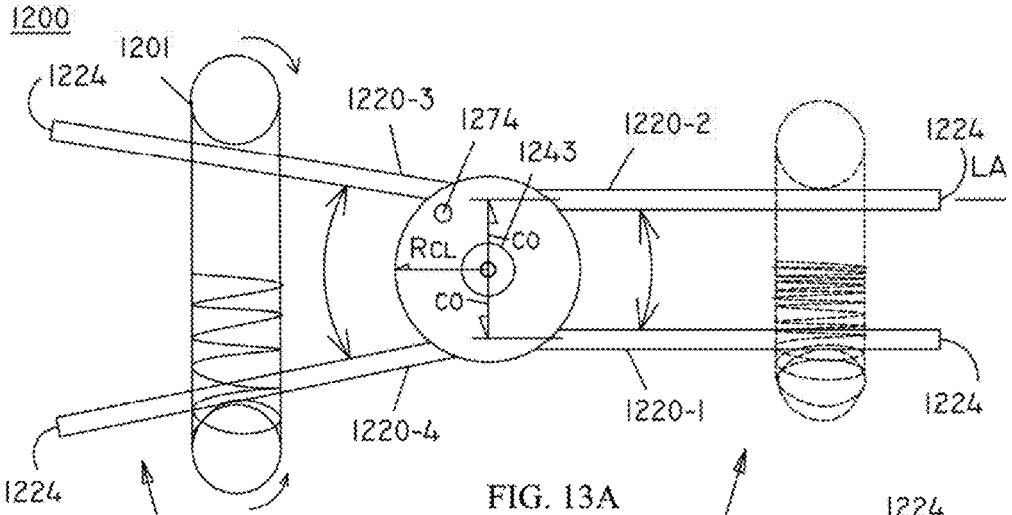
FIG. 13A is a top view of a portion of the apparatus of FIG. 12 with the cross-opposed link pairs rotationally coupled together and in a partially closed position in accordance with embodiments of the present system.

FIG. 13A shows a top view of a portion of the apparatus 1200 of FIG. 12 with the cross-opposed link pairs rotationally coupled together and situated in a partially closed position in accordance with embodiments of the present system.

Figure 13B:
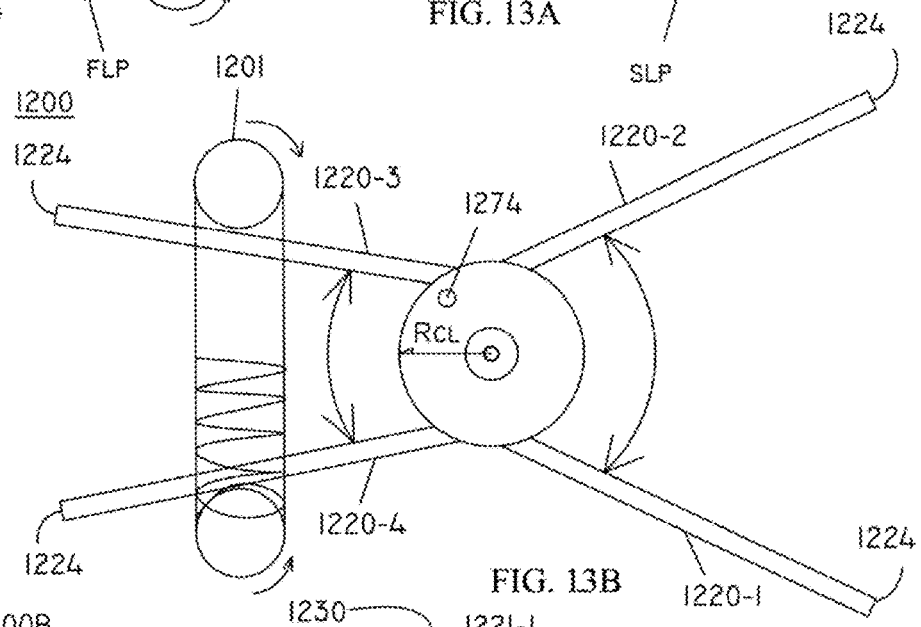
FIG. 13B is a top view of a portion of the apparatus of FIG. 12 with the cross-opposed link pairs rotationally coupled together and in a substantially open position in accordance with embodiments of the present system.

FIG. 13B shows a top view of a portion of the apparatus 1200 of FIG. 12 with the cross-opposed link pairs rotationally coupled together and in a substantially open position in accordance with embodiments of the present system. A rotational stop may define fully opened and/or closed positions of one or more corresponding links 1220-*x* relative to a fixed location and/or each other. The rotational stop may include latches, pins, pegs, etc., as desired.

Figure 14:
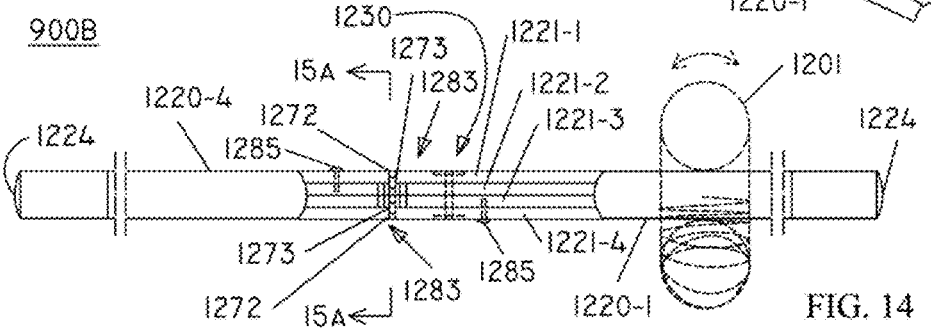
FIG. 14 is a side view of a portion of the apparatus of FIG. 12 with the cross-opposed link pairs rotationally coupled together in accordance with embodiments of the present system.
Figure 15A:
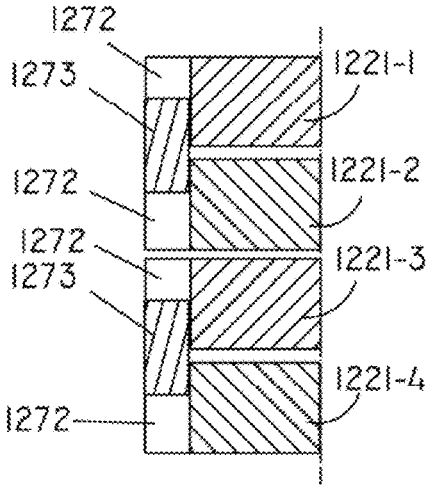
FIG. 15A is a cross-sectional view of a portion of the center links of the apparatus taken along lines 15-15 of FIG. 14 in a rotationally coupled position.
Figure 15B:
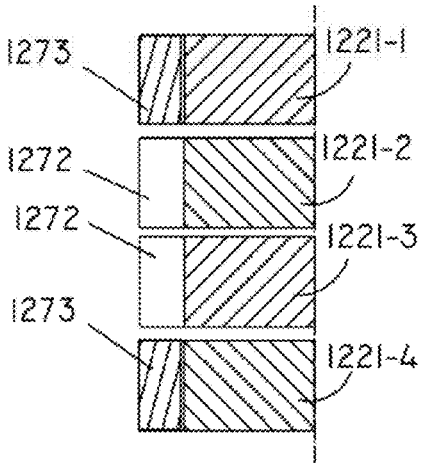
FIG. 15B is a cross-sectional view of a portion of the center links of the apparatus taken along lines 15-15 of FIG. 14 in a rotationally de-coupled position.

FIG. 14 shows a side view of a portion of the apparatus 1200 of FIG. 12 with the cross-opposed link pairs rotationally coupled together in accordance with embodiments of the present system.

Figure 16A:
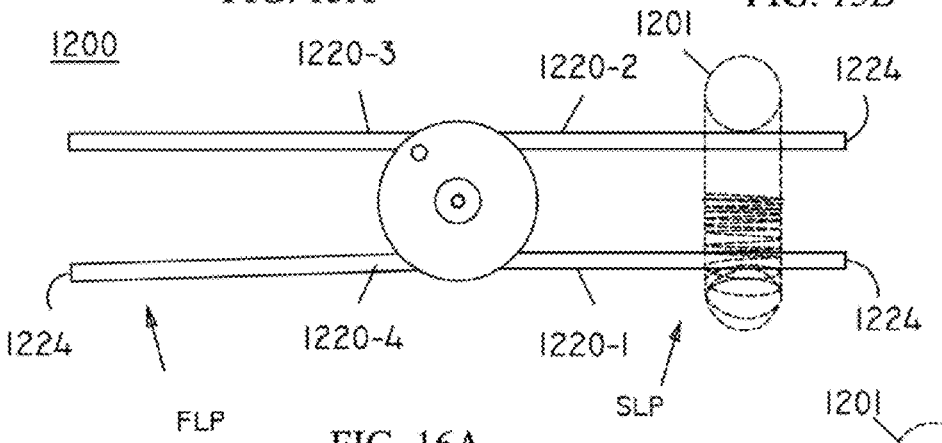
FIG. 16A is a top view of a portion of the apparatus of FIG. 12 with the cross-opposed link pairs rotationally coupled together and in a substantially closed position in accordance with embodiments of the present system.

FIG. 16A shows a top view of a portion of the apparatus 1200 of FIG. 12 with the cross-opposed link pairs rotationally coupled together and in a substantially closed position in accordance with embodiments of the present system.

Figure 16B:
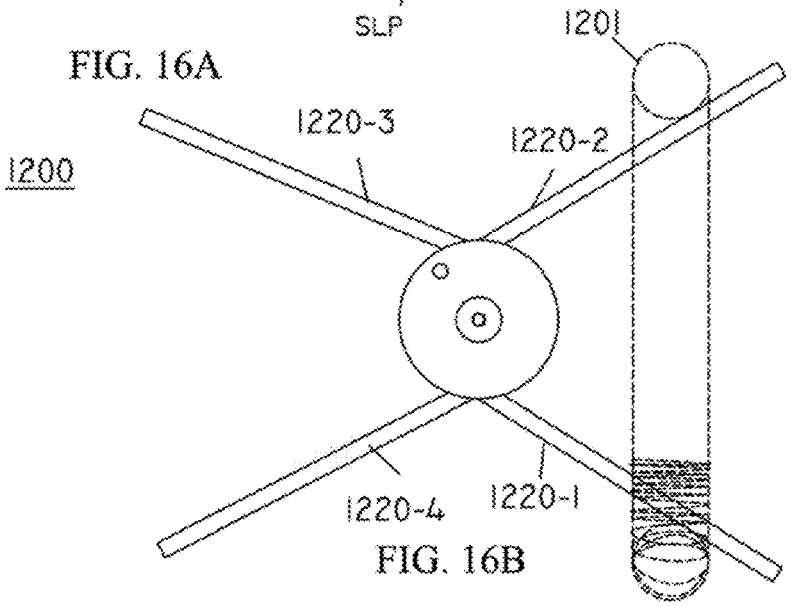
FIG. 16B is a top view of a portion of the apparatus of FIG. 12 with the cross-opposed link pairs rotationally coupled together and in a substantially open position in accordance with embodiments of the present system.

FIG. 16B shows a top view of a portion of the apparatus 1200 of FIG. 12 with the cross-opposed link pairs rotationally coupled together and in a substantially open position in accordance with embodiments of the present system. When the cross-opposed link pairs are rotationally coupled together, separation of distal ends 1224 of a first link pair (FLP 1220-1 and 1220-2) causes the distal ends 1224 of the second link pair (SLP 1220-3 and 1220-4) to separate from each other. Thus a single user (e.g., player) may simultaneously control rotation (or opening/closing) of both link pairs.

Figure 16C:
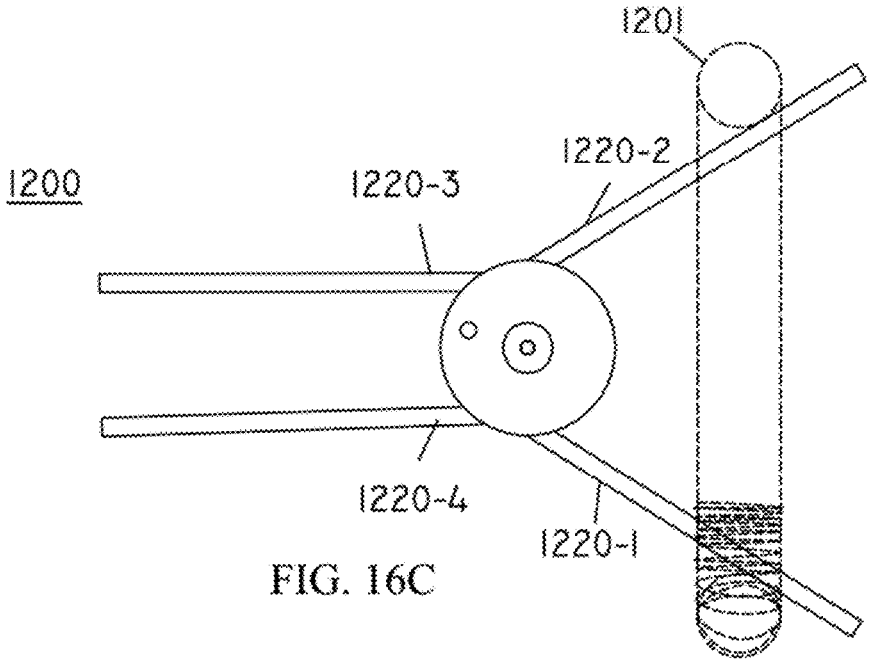
FIG. 16C is a top view of a portion of the apparatus of FIG. 12 with the cross-opposed link pairs rotationally decoupled in accordance with embodiments of the present system.

In contrast, FIG. 16C shows a top view of a portion of the apparatus 1200 of FIG. 12 with the cross-opposed link pairs rotationally de-coupled from each other in accordance with embodiments of the present system. This setup may be ideal for two-player operation where each player may control a corresponding link pair (e.g., FLP or SLP). Accordingly, a first player may control a link pair while an other player may control an other link pair (e.g., FLP or SLP).

Figure 16D:
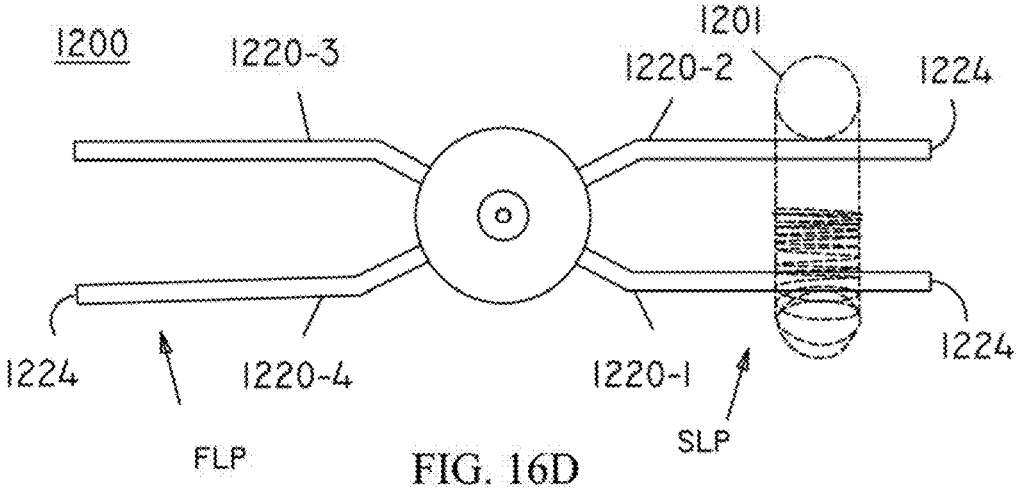
FIG. 16D is a top view of a portion of an apparatus with links including bends in accordance with embodiments of the present system.

FIG. 16D is a top view of a portion of a an apparatus 1600D with links including bends in accordance with embodiments of the present system. The apparatus 1600D is similar to the apparatus 1200 of FIG. 12. However, the apparatus includes first through fourth links 1620D-1 through 1620D-4 one or more of which may include a longitudinal axis (LLA) which may extend through a hinge axis (HA) 1641D of the apparatus 1600D. Further, one or more of the first through fourth links 1620D-1 through 1620D-4 may include one or more bends such as bends 1695. This bend may provide for separation of handles 1622D during use. Further, it is envisioned that the handles may include bends of other shapes, sizes, angles, etc.

Figure 17:
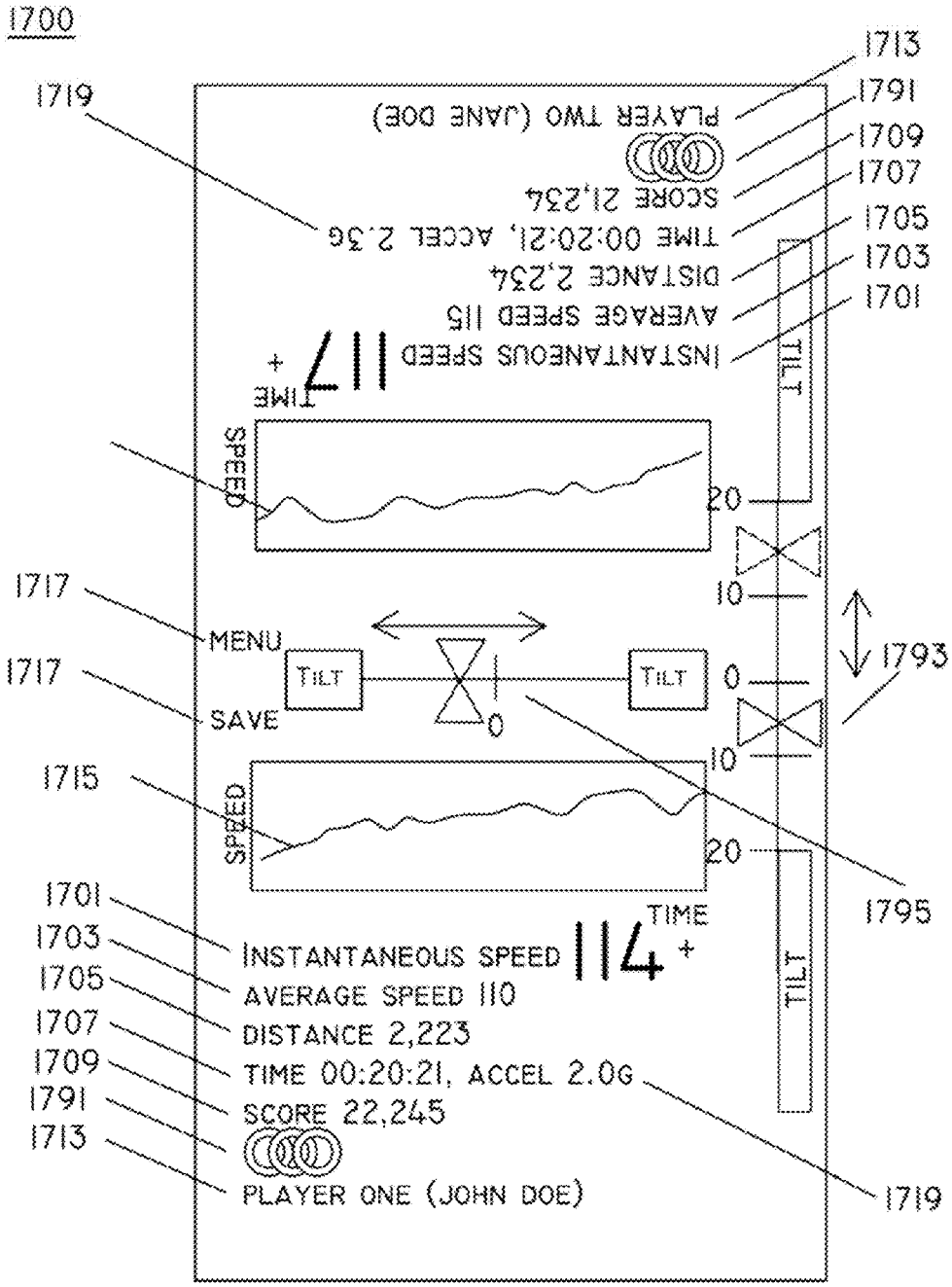
FIG. 17 is a portion of a screen shot in accordance with embodiments of the present system.

FIG. 17 shows a portion of a screen shot 1700 in accordance with embodiments of the present system. The screen shot may be rendered on a UT of the system such as a display of a UD (e.g., such as a smartphone) and may include information such as instantaneous speed (e.g. speed of the HCS 101, etc.) 1701 as determined by the controller. The speed may be measured in one or more locations such as at a trap (e.g., a speed trap) including two or more optical sensors on, for example, the center link, a link, etc. However, for the sake of clarity, it will be assumed that the two more optical sensors of the speed trap may be located at the center link for the sake of clarity. Accordingly, for example, optical sensors (e.g., infrared (IR) sensors) located at the center link may sense the proximity of the HCS as it passes over a corresponding sensor pair of a speed trap and report this information (e.g., corresponding sensor information) to the controller. Then, knowing a reporting time of each sensor of the sensor pair over a time interval dT and knowing the distance between the sensors of the sensor pair, the controller may determine speed for a corresponding player as an absolute value of a change in distance (dS) over the corresponding time interval (dT). Thus, speed may be computed as dS/dT. Similarly, the controller may determine acceleration of the HCS as it accelerates from substantially zero velocity (at the point where it reverses direction at, for example, an end of a link) to the speed trap. Further, with regard to units of distance, these units may correspond with actual units (e.g., miles-per-hour, kilometers-per-hour, feet-per-second, meters-per-second, etc., or some other unit(s)), as may be set by the system and/or user, as desired. The controller may also determine a direction of the travel of the HCS in accordance with the sensor information and determine corresponding GI for a corresponding user. The sensor information may further be used to identify a current player (e.g. user) associated with the current GI. For example, the controller may determine a direction of travel of the HCS in accordance with the sensor information from the reporting sensors. Then, for example, if it is determined that the HCS is traveling away from the first player, the controller may associate the current sensor information as well as the GI with the first player. Similarly for example, if it is determined that the HCS is traveling away from the second player, the controller may associate the current sensor information and the GI with the second player.

Each player may have a certain number of player turns (plays) as illustrated by donuts 1791 for each game. For example, a game may start which each player having four turns (or some other value as may be set by the system and/or user). When the corresponding player runs out of turns, the controller may determine to end the player's game. Thus, the game for one or more players may end when a player runs out of turns (or accumulates a default number of outs such as three outs as will be described below). Depending upon settings for the game, a player may lose turns when, for example, it is determined that the HCS has entered a predetermined zone which the HCS should not enter such as an "end zone" adjacent to a player (e.g., adjacent to a players hands). Depending upon settings, a player may also lose a turn when it is determined that the apparatus has been pitched beyond a threshold pitch value (e.g., 20 degrees, however other values are also envisioned). Similarly, depending upon settings, a player may also lose a turn when it is determined that the apparatus has been rolled or yawed beyond threshold roll or yaw values, respectively (e.g., 20 degrees, however other values or ranges are also envisioned). However, it is also envisioned that a player may lose a turn for other factors such as when it is determined that the HCS has an instantaneous speed (velocity) which is less than a threshold speed value. In yet other embodiments the game may use outs rather than player turns, and a player may accumulate outs in a similar manner to that which a player loses player turns. At the start of a game, a player may have zero outs, and thereafter, when it is determined (e.g., by the controller) that a player has accumulated a default number of outs (e.g., three), the player's game may end.

If desired, the controller may further receive orientation information from one or more orientation sensors (e.g., gravitational and/or magnetic field sensors) indicative of an orientation of the apparatus (e.g. 500, 1200 etc.) in one or more axes (e.g., x, y, or z axes corresponding with, for example, roll, pitch, and yaw, respectively) of the apparatus and render information indicative of the determined orientation in real-time for the convenience of the user(s) (e.g., players). For example, pitch and roll of the apparatus may be determined by the controller and illustrated using arrows 1793 and 1795, respectively, for the convenience of the user. Further, the controller may determine whether an absolute value of pitch (e.g., in degrees) of the apparatus is equal to or greater than a corresponding threshold value for pitch, and if it is determined that the absolute value of pitch of the apparatus is equal to or greater than the corresponding threshold value for pitch, the controller may set the GI accordingly by, for example, subtracting a play and/or points from a player associated with the current GI or a player who is determine to have caused the apparatus to pitch (e.g., as may be determined using acceleration information obtained from one or more acceleration sensors (e.g., angular acceleration sensors) associated with one or more axes such as the x, y, and/or z axes). However, if it is determined that the absolute value of pitch of the apparatus is less than the corresponding threshold value for pitch, the controller may continue the game without subtracting plays or points from one or more of the players.

Similarly, the controller may determine whether an absolute value of roll (e.g., in degrees) of the apparatus is equal to or greater than a corresponding threshold value for roll, and if it is determined that the absolute value of roll is equal to or greater than the corresponding threshold value for roll, the controller may set the GI accordingly by, for example, subtracting a play and/or points from a player associated with the current GI. However, if it is determined that the absolute value of roll is less than the corresponding threshold value for roll, the controller may continue the game without subtracting plays and/or points from one or more of the players.

It is further envisioned that when using UIs with limited graphics capabilities (e.g., as may be found on a small display, an apparatus with an LED display, etc.) certain information of the GI may be rendered by toggling through a plurality of information.

Further, for single player games, GI for only a single player may be rendered. Moreover, the controller may determine bonuses (e.g., an extra player turn, an out subtraction, a prize, a bonus (e.g., 10000 points, etc.), as may be set by the system and/or user) for a player based upon, for example, a duration of play, a number of rounds, a number of levels of play, a score, etc. of a player and may information a player of the bonus, when it is generated for a player.

Although screenshot 1700 illustrates a graphic user interface, the controller may render information such as the GI using simple illumination outputs (e.g., LEDs), haptic, and/or audio UIs (e.g., a speaker, etc.), etc. Moreover, in yet other embodiments, it is envisioned that analog user interfaces may be displayed. For example, rather than illustrating orientation (e.g. roll, pitch, and/or yaw) in one or more axis using an electronically generated graphic display, the system may use one or more bubble levels or ball bearings for illustrating roll, pitch, and/or yaw of the apparatus or portions thereof (e.g., see, 500, 1200 etc.). Further, the system may render information related to roll, pitch, and/or yaw using a microphone. Thus, for example with regard to pitch, the system may increase a frequency and/or tone of an audible sound rendered by a speaker linearly with the determined value of roll, pitch, and/or yaw. Thus, a user may easily determine roll, pitch, and/or yaw of the apparatus.

Referring back to FIG. 17, the controller may obtain the sensor information related to the HCS and may determine and/or render information for each player of a game such as instant speed 1701, 1701', average calculated speed (e.g., average of multiple instant speed readings) of the HCS during a current game based upon the instant speed 1707, 1707', total distance traveled by the HCS during the game 1705, 1705', time of the game 1709, 1709' (which may be triggered by the first or second speed reading of the HCS), acceleration of the HCS 1719, 1719' and (e.g., by the current user/player), current player score 1709, 1709', number of turns remaining (or outs) 1791, 1791', player identification 1713, 1713' roll 1795, and pitch 1793. The roll 1795 and/or pitch 1793 may be rendered as arrow which may move linearly along a corresponding axis to inform a user of roll 1795 and/or pitch 1793 in real time. Additionally, the controller may render menu items 1717 for selection by a user such as a "menu" menu item and a "save" menu item.

Further, in yet other embodiments, it is envisioned that the controller may determine recommended values of roll, pitch, and/or yaw and may render information about these determined value(s) on a UI of the system. Then, for example, a user may manipulate the apparatus to attempt to match recommended values. The closer the apparatus is manipulated to the recommended values, the more point may be awarded to a user when calculating a score for the user. For example, the controller may inform a user to roll the apparatus 10 degrees (as shown by arrows which may slide along a liner scale, etc.). The user may then roll the apparatus and the controller may measure roll. The closer the measured (actual) value of roll is to the recommended value, the more points (or other benefits) the controller may award the user. For example, in embodiments of the present system used for physical rehabilitation, upon determining that a user has maintained pitch or roll within recommended values for a threshold duration time period, the controller may inform the user of such by rendering a predetermined audio and/or video file from a memory of the present system.

Further, in yet other embodiments the center link may for example, be split into two halves. The first half coupled to the first link pair and the second half coupled to the second link pair. The halves may be rotationally decoupled from each other by a slip ring. Accordingly, each user may roll the apparatus (e.g., his or her link pair and/or rotationally coupled half of the center link) independently of the other user.

Figure 18:
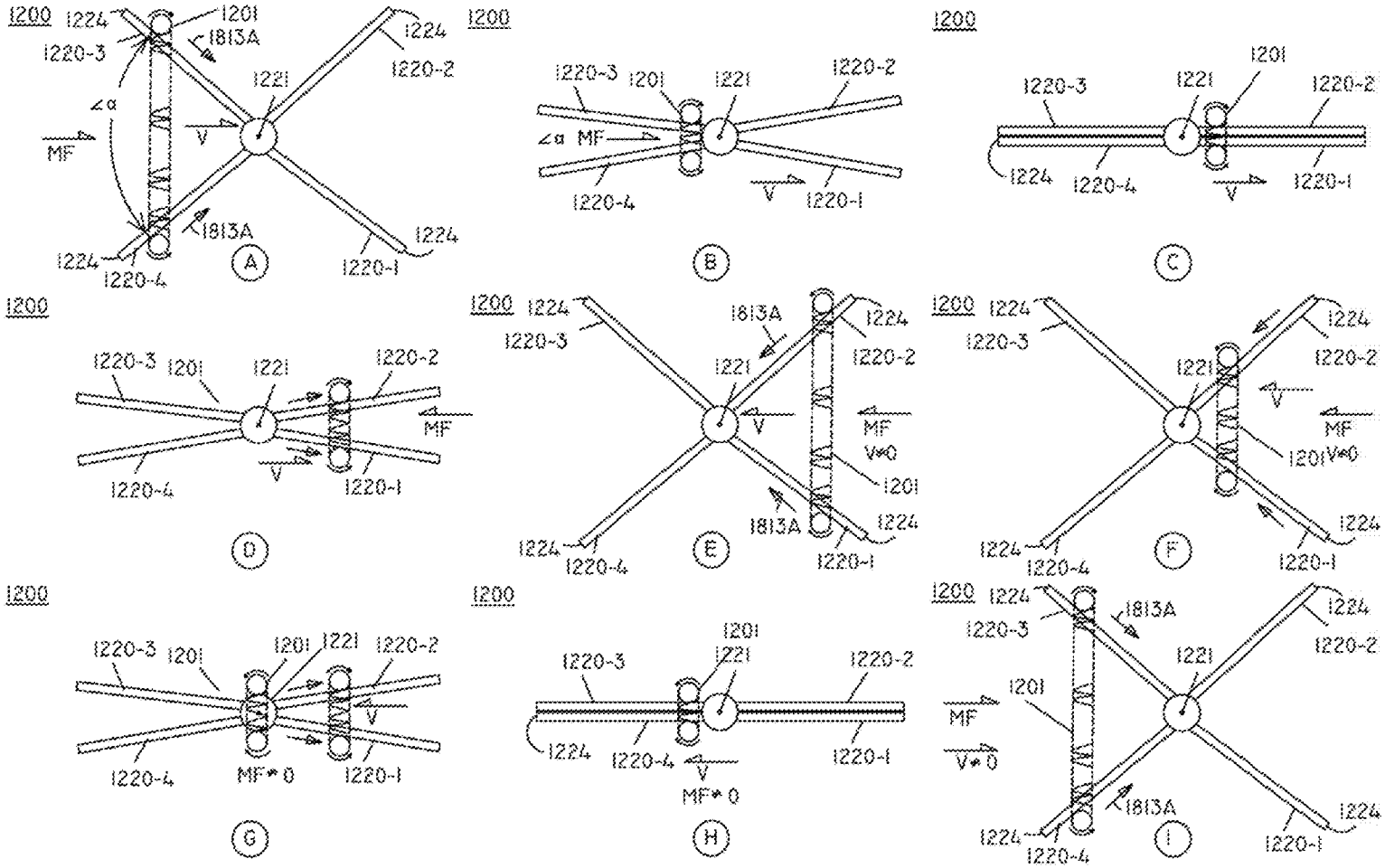
FIG. 18 is a sequence of acts of a user or controller may perform to cause the HCS to move between ends of the links in accordance with embodiments of the present system.

FIG. 18 shows a series of top views (views A through I) of a portion of an apparatus 1800 in various operational states in accordance with embodiments of the present system. The apparatus 1800 may be similar to the apparatus 1200 and is shown in various operational states such as a substantially open, substantially closed and in various positions therebetween. Similar numerals may be used to denote similar parts. Each of the views A through I may correspond with acts A through I, respectively. Further, the apparatus 1800 may be configured for a single user (player) game and, therefore, cross-opposed links of the first and second link pairs (FLP and SLP, respectively) are rotationally coupled to together for single user (player) operation. However, it is envisioned that the links **1820-*x* may be rotationally decoupled from each other (with regard to rotation about a rotational axis) for multiple user (e.g., simultaneous player) operation. Accordingly, the apparatus 1800 may include links 1220-1 through 1220-4. The links 1220-1 and 1220-2 may form the first link pair (FLP) and the links 1220-3 and 12204 may form the second link pair (SLP). The links may rotate about a hinge axis (HA) 1241**.

Referring to act A, during this act the links **1220-*x* are in a substantially opened position (e.g., current (instantaneous) values of alpha ($\alpha_{inst}$) or just $\alpha$ may be equal to $\alpha_{max}$) and the HCS 1201 is be stretched. Accordingly, a motive force (MF) (e.g., due to the stretching and orientation of the link pair about which the HCSs 1201 is being stretched) may act generally in a direction as shown by arrow MF upon the HCS 1201. Accordingly, the HCS 1201 may accelerate and travel towards the center link 1221. As the HCS 1201 gains speed (e.g., velocity) the HCS 1201 may gain momentum (e.g., linear momentum and/or angular momentum as the HCS 1201 rotates about its CA). As the HCS 1201 travels along the link pair, $\alpha$ may be reduced so as to begin to close the corresponding link pair. The links may be opened and/or closed by a user and/or by a controller. Accordingly, the controller may determine location and/or velocity of the HCS 1201 and may determine alpha ($\alpha$) and/or beta ($\beta$) for one or more of the links 1220-*x***. Where, alpha ($\alpha$) may equal the sum of betas ($\beta$s) for each of the links of a link pair.

During act B, the links **1820-*x* may be partially closed as the HCS 1201 acquires momentum and moves towards the center link 1221. During act C, as the HCS 1801 passes the center link 1221 (e.g., carried at least in part by its momentum) it continues toward ends 1224 of the second link pair (e.g., links 1220-3 and 1220-4) which are in substantially closed position (e.g., alpha ($\alpha$) substantially $\alpha_{min}$=0 in the present example) so as to minimize any forces (e.g. MF) which may act against the direction of movement of the HCS 1201 so that the HCS 1201 may continue to travel along the second link pair. During act D, the links are opened to stretch the HCS 1201. Accordingly, the force MF acts in a direction opposite of the direction of travel (e.g., as shown by velocity V) of the HCS 1201 so as to slow the HCS 1201 to a stop before it passes over the ends 1224 of the links 1220-3 and 1220-4 of the second link pair. During act E, the HCS 1201 is brought to a stop close to the ends 1224 of the second link pair (e.g., links 1220-3 and 1220-4) and is stretched and may thus, have a high potential energy. Accordingly, the MF acts to return the HCS 1201 towards the ends 1224 of the first link pair and the HCS 1201 may begin to travel towards the first link pair. During act F, similarly to act B, the links 1220**-*x* may be partially closed as the HCS 1201 acquires momentum and moves towards the center link 1221. Accordingly, the MF is decreasing During act G, the HCS 1201 passes over the center link 1221 and is substantially un-stretched. The links 1220-*x* may be closed or in the process of being closed. During act H, similarly to act C (but in an opposite direction), the HCS 1201 passes the center link 1201 and continues towards ends 11224 of the first link pair, the links 1220-*x* are now substantially closed so as to minimize any MF against the direction of movement of the HCS 1201. During act 1, the links 1220-*x* are opened to stretch the HCS 1201 and so as to provide a MF against the direction of travel of the HCS 1201 so as to bring the HCS 1201 to a stop (e.g., V substantially=0). Then, the MF acting upon the HCS 1201, may cause the HCS to begin to travel towards the second link pair, thus, completing a cycle. A user or controller may repeat acts A through I so as to cause the HCS 1801 to travel between ends of the links 1820-*x*.

Figure 19A:
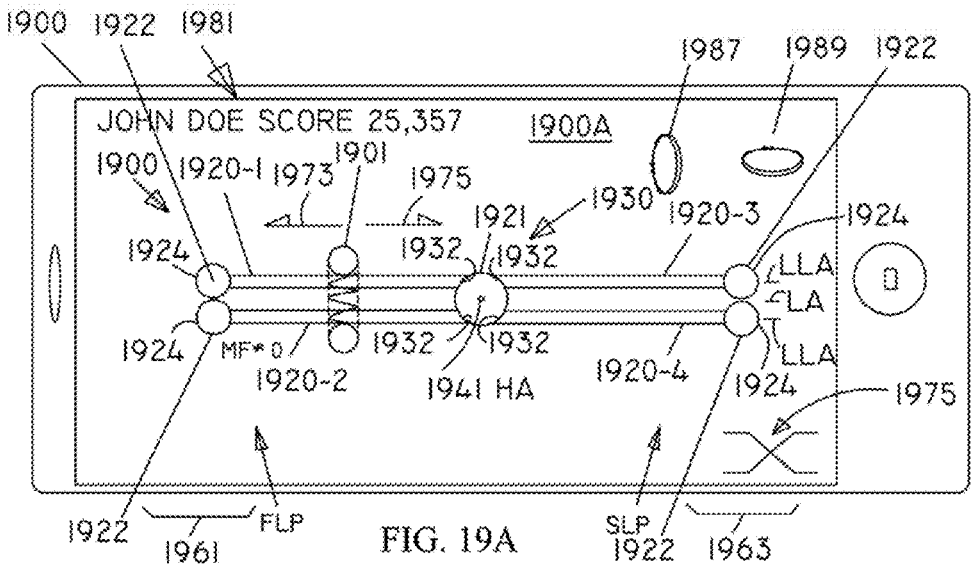
FIG. 19A shows a screen shot of a model apparatus including a HCS in accordance with embodiments of the present system as rendered on a UD of the present system.

The embodiments of the present system may further be modeled and rendered on a display of the system. A user may then interact with the model using any suitable method such as direct inputs, virtual reality (VR), etc. For example, FIG. 19A shows a screen shot 1900A of a model apparatus 1900 including a HCS 1901 in accordance with embodiments of the present system as rendered on a UD of the present system. The screen shot 1900A may be rendered on a UI of the system such as a display 1981 of the UD (e.g., such as a smartphone, an IPhone™, etc.) 1980 under the control of a controller including one or more processors which may be local and/or remote from each other. The controller may generate one or more of a center link 1921, first though fourth links 1920-1 through 1920-4 (generally 1920-*x*), respectively, a coupler 1930, and the HCS 1901. The model apparatus 1900 may be modeled to operate similarly to the apparatus 1200. However, in yet other embodiments, it is envisioned that the model apparatus may be modeled upon other physical embodiments in accordance with yet other embodiments.

Accordingly, links 1920-*x* may modeled to be coupled to each other by a coupler 1930 (e.g., a virtual pivot having a hinge axis (HA) 1941) so that the links 1920-*x* may rotate about the HA 1941. However, in yet other embodiments, it is envisioned that the coupler 1920 may be modeled in accordance with other types of live hinges, compound hinges, etc. The model apparatus 1900 may further include a center link such as a center link 1921. The center link 1921 may include the coupler 1930. Accordingly, each of the links 1920-*x* may rotate about the HA 1941 so as to emulate operation of or otherwise represent the embodiment shown in FIG. 12. Each of the links 1920-*x* may have a rotational range of motion which may correspond with a difference between maximum and minimum and maximum values of β where the maximum value of beta is $\beta_{max}$ and the minimum value of beta is $\beta_{min}$. Thus, the range of motion for a corresponding link 1920-*x* may be equal to $\beta_{max}-\beta_{min}$. Further, each link 1920-*x* may be assumed to have values of similar values of $\beta_{max}$ and $\beta_{min}$. However, in yet other embodiments, $\beta_{max}$ and/or $\beta_{min}$ may vary by link 1920-*x* an or by link pair. For example, links of a first link pair (FLP) (e.g., 1920-1 and 1920-2) may have the $\beta_{max}$ and/or $\beta_{min}$ values which are differ from values of $\beta_{max}$ and/or $\beta_{min}$, respectively, of links a second link pair SLP (e.g., 1920-3 and 1920-4 in the present example).

In the present embodiment, as the links 1920-*x* may be slightly offset from the HA 1941, such that β is slightly offset (e.g. see delta Δ) to compensate from this discrepancy. For the sake of clarity, $\beta_{min}$ will be assumed to be equal to 0 (as measured from a longitudinal axis of the apparatus) and $\beta_{max}$ may be 70 degrees, however, although other values and/or ranges are also envisioned. Further, the range of motion may be set in accordance with screen size and/or aspect ratio of the display 1981 so that a user may easily interact with the links 1920-*x*.

Figure 19B:
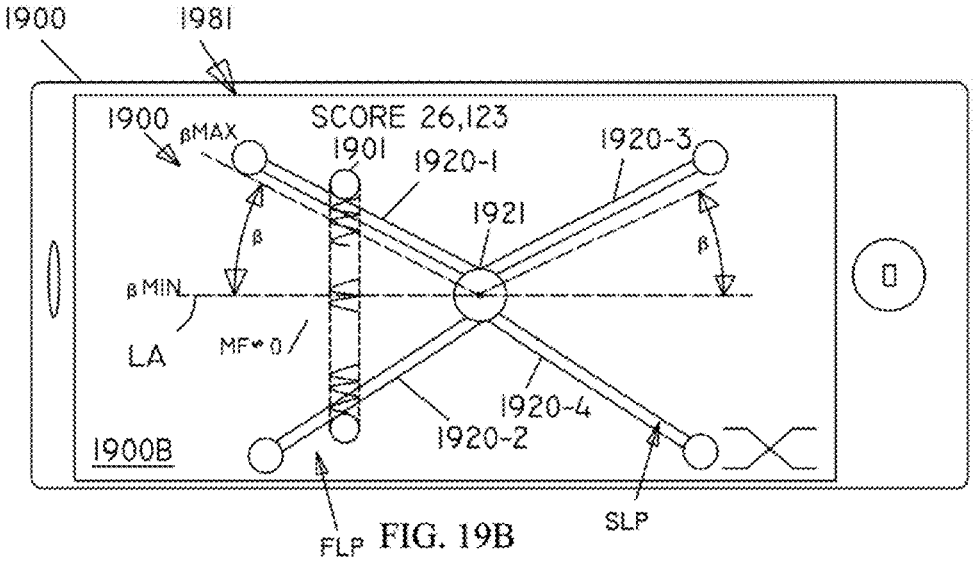
FIG. 19B shows a screen shot of the model apparatus with the FLP and SLP in the opened positions in accordance with embodiments of the present system.

A controller may include a gesture recognition application to recognize gestures entered by a user (e.g., body part and/or finger gestures) via any suitable user inter face such as a virtual reality (VR) user interface, a touchscreen, a touchpad, a keyboard, a motion sensing input device (e.g., Wii™ or Kinect™-type motion sensing systems), a keyboard, a mouse, etc. In the present example, it will be assumed that gestures are entered via a touchscreen of the display 1981 which may receive single- or multi-touch gestures as user-entered inputs. Gestures may be mapped to certain actions and/or vice versa. Thus, for example, a manufacturer and/or a user may map a single-tap gesture adjacent to (e.g. in a predefined area such as area 1961 for the FLP and 1963 for the SLP) a link pair with a command to toggle the link pair from a closed position to an open position (e.g., $\beta=\beta_{max}$ for each link of the link pair). Accordingly, if a user enters a single tap in the area 1961 of the display 1961, the FLP will open (e.g., fully in the present example) as shown in FIG. 19B which shows a screen shot 1900B of the model apparatus 1900 with the FLP and SLP in the opened positions in accordance with embodiments of the present system. The cross-opposed links of the FLP and the SLP are rotationally coupled such that opening the FLP causes the SLP to open and vice versa. Thus, taps in areas 1961 and 1963 may have a similar effect of opening both of the FLP and the SLP and a user may tap either area (when the cross-opposed links of the FLP and SLP are rotationally coupled) with similar results.

The link pair may then, for example, be set to automatically close after a certain period of time (e.g., ½ second, etc.). However, in yet other embodiments, it is envisioned that the link pair may close when a similar action (e.g., a single-tap gesture adjacent to the link pair) is entered by the user.

Figure 20A:
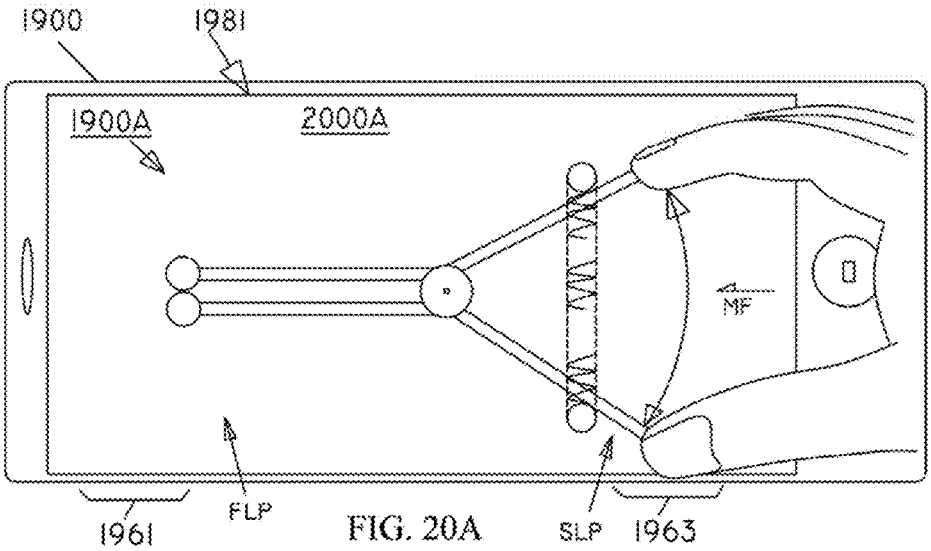
FIG. 20A shows a screen shot of the model apparatus in accordance with embodiments of the present system.
Figure 20B:
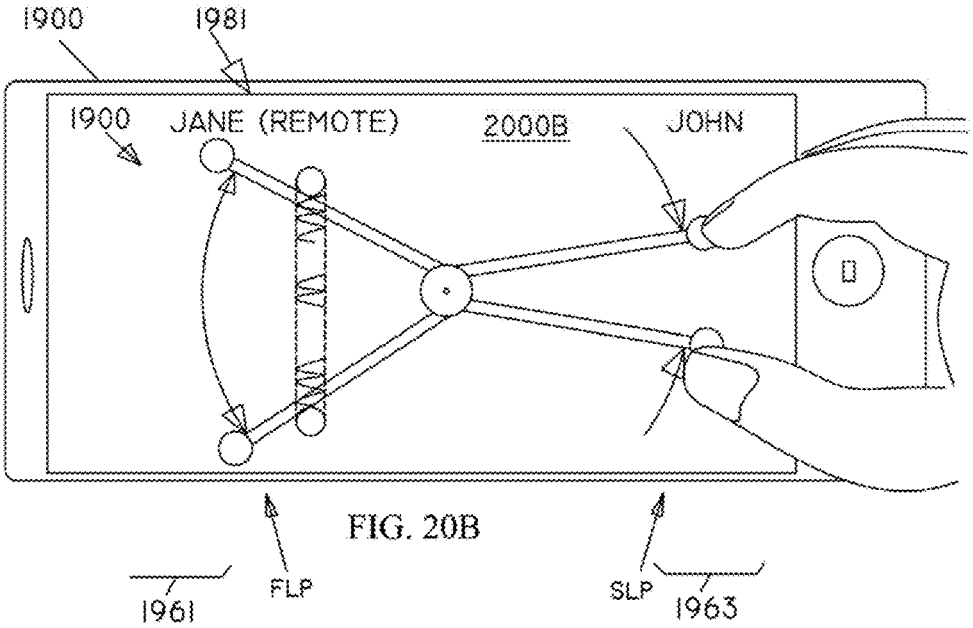
FIG. 20B shows a screen shot of the model apparatus in accordance with embodiments of the present system.

In yet other embodiments, a user may modulate position of the links of a link pair (e.g., the FLP and/or the SLP) by using a two-finger gesture. For example, to open the links of a desired link pair (e.g., the SLP in the current example), a user may enter a two-finger spread via the touchscreen of the display 1981 in an area that is adjacent to (or otherwise mapped to) the desired link pair (e.g., 1963 for the SLP) as is shown in FIG. 20A which shows a screen shot 2000A of the model apparatus 1900 in accordance with embodiments of the present system. Similarly, to close the desired link pair, a user may enter a two-finger pinch via the touchscreen of the display 1981 in an area that is adjacent to (or otherwise mapped to) the desired link pair (e.g., 1963) as shown in FIG. 20B which shows a screen shot 2000B of the model apparatus 1900 in accordance with embodiments of the present system. In FIGS. 20A and 20B, the link pairs are not rotationally coupled to each other. Accordingly, the FLP may be opened or closed independently of the SLP. Further, the FLP may be controlled by a user who is local and/or remote from the UD 1980 or may be controlled by the controller (e.g., for a single user game against the controller).

However, in yet other embodiments, it is envisioned that other actions or combinations of actions may be used open or close the links 1920-*x* of a desired link pair (e.g., FLP and/or SLP). For example, in some embodiments, it is envisioned that a user may perform a tap or double tap to toggle the desired the links 1920-*x* of the desired link pair from an open position to a closed position and vice versa. It is also envisioned that when a user removes one or more fingers from the touch display 1981 such as from the vicinity of a link pair (FLP and/or SLP), the controller may open or close (e.g., toggle) the link pair.

For single user (player) games, the controller may rotationally couple the cross-opposed links (e.g., 1920-1 and 1920-4 and 1920-2 and 1920-3). Accordingly, a user may control the FLP and the SLP together. When these links are rotationally cross coupled, the controller may render indication of such as illustrated by graphic 1975. Further, if requested by a user or otherwise set, the controller may control a link pair such as the FLP or SLP to play against a user who may control the other of the link pairs (FLP or SLP).

Figure 19C:
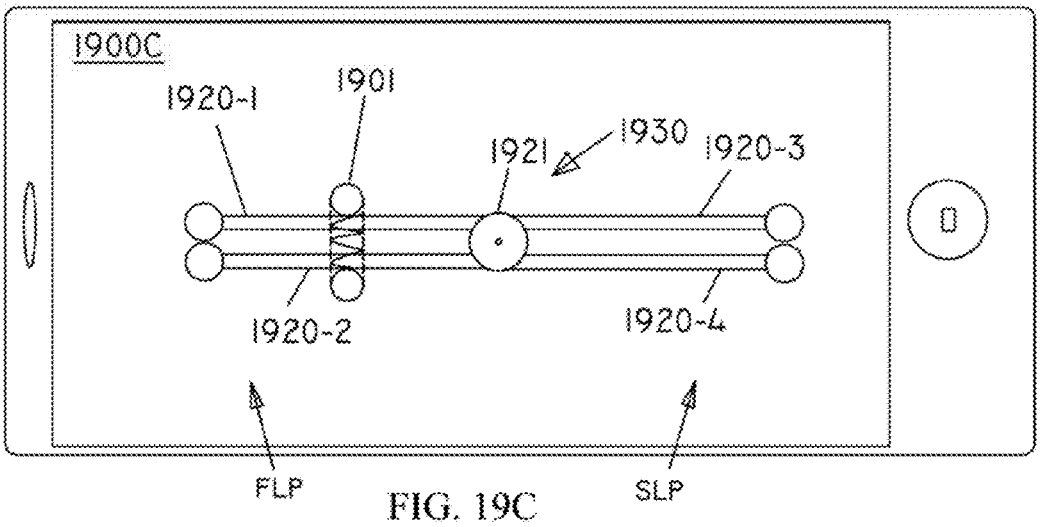
FIG. 19C illustrates a screen shot which shows a portion of the modeled apparatus with the first and second link pairs rotationally decoupled from each other and in the closed position.
Figure 19D:
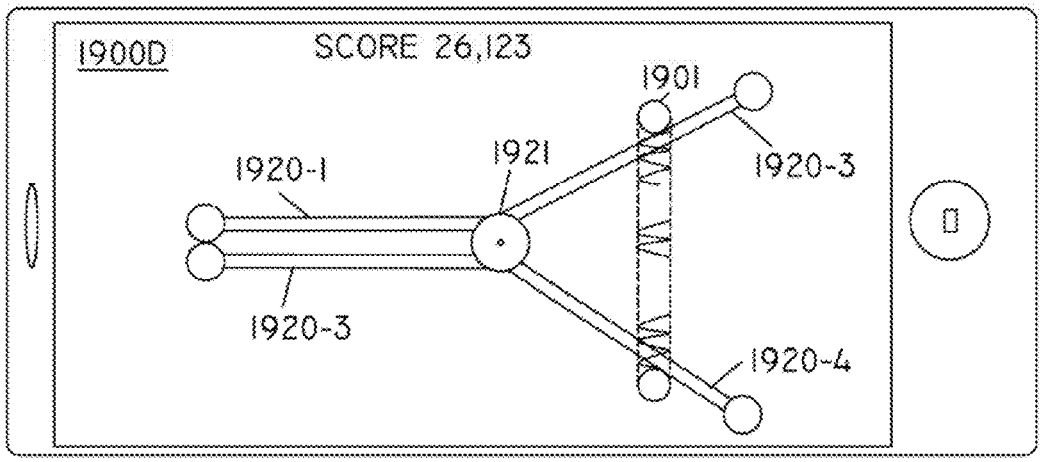
FIG. 19D illustrates a screen shot which shows a portion of the modeled apparatus with the first and second link pairs rotationally decoupled from each other and one link pair in an open position and the other in a closed position.

For two-user (player games) two players may play locally (e.g., together) using a single UD or may player remotely from each other via a wired and/or wireless interface. Thus, for example, if playing a game remotely, the controller may synchronize and render the model apparatus 1900 on two displays. A first user may control the FLP and a second user may control the SLP. Further, the first and second link pairs (e.g., FLP and SLP, respectively) may open and/or close independently of each other. For example, FIGS. 19C and 19D each illustrate a screen shot which shows a portion of the modeled apparatus 1900 with the first and second link pairs (e.g., FLP and SLP, respectively) rotationally decoupled from each other. Icon 1975 is not rendered to inform a user that the first and second link pairs are rotationally decoupled from each other. However, in yet other embodiments an icon may be rendered to inform a user of the decoupled link pairs. Referring to FIG. 19C, when a user inputs a command such as a tap to open the second link pair (e.g., the SLP), the controller may be operative to open the SLP independent of opening and/or closing of the FLP as illustrated in the screen shot of FIG. 19D. The FLP may be controlled by another player (locally and/or remotely: located), by independent inputs (e.g. by the player), and/or by the controller (e.g., when playing against the controller).

Further, when using a VR interface, for example, the user may enter inputs virtually. Accordingly, for example, the user may map VR actions to certain commands. For example, bringing right and left hands of a user together in front the user's body may correspond with a command to close the links of link pair corresponding with the user and opening hands spreading right and left hands of a user apart in front the user's body may correspond with a command to open the links of link pair corresponding with the user. Accordingly, the controller may receive information related to actions of a user from a VR sensing system such as a Kinect™ proximity sensing system by Microsoft™ corporation which may interface with the controller. However, in yet other embodiments it is envisioned that a user may manipulate links in VR and the controller may control the apparatus 1900 accordingly.

The controller may determine position, speed, and/or direction (PSD) (e.g., position and velocity) of the HCS 1901 relative to one or more of the links 1920-*x* and/or the center link 1921 using any suitable method. For example in a first embodiment, the PSD may be determined using mathematical modeling of the apparatus 1900 in accordance with classical physics methods (e.g., conservation of momentum, energy, etc.) using, for example, numerical analysis. Accordingly, specifications of a model of the HCS 1901 such as mass, moment of inertial (rotational and/or linear), number of turns, spring constant, size of turns, inside and/or outside diameters of the turns, etc. may be obtained (e.g., from a memory of the system, from a user, etc.) and may be used to determine PSD of the HCS 1901 relative to an orientation of one or more of the links 1920-*x* and/or the center link 1921. Further, dimensions (diameter size, shape) and/or orientation (opened 30 degrees from longitudinal centerline, etc.) of one or more of the links 1920-*x* and/or the center link 1921 may also be obtained and/or modeled.

Figure 21:
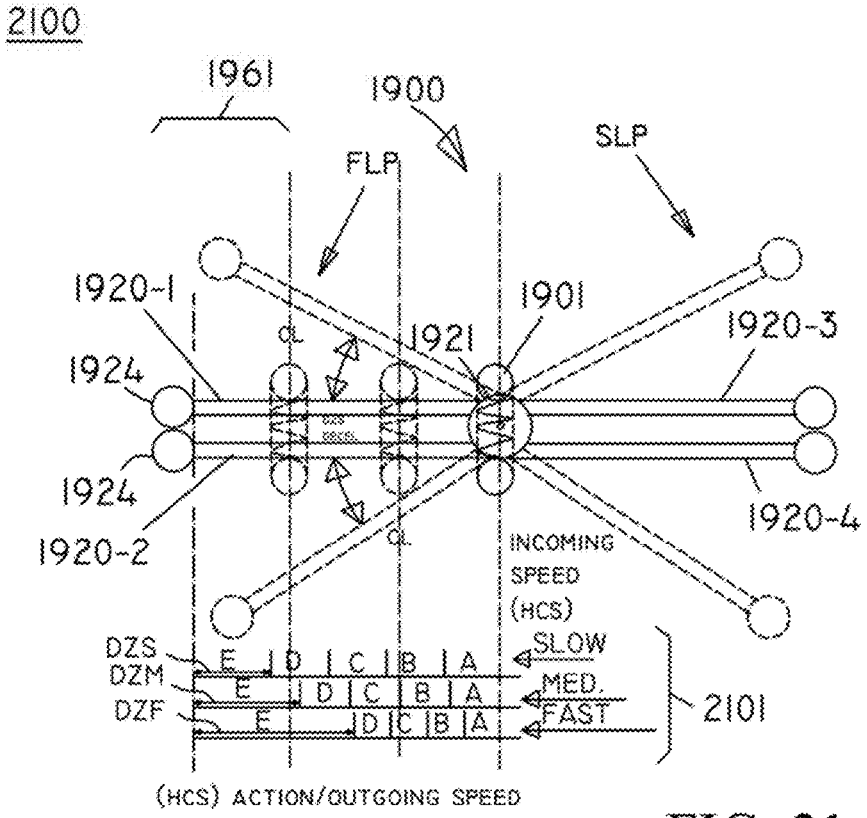
FIG. 21 is a screen shot which shows a portion of the modeled apparatus with the HCS incoming (e.g., approaching) the FLP and a corresponding motion map (MM).

However, to conserve resources, discrete modeling may be performed using motion rules (MRs) to determine the PSD of the HCS 1901 relative to the one or more links 1920-*x* and/or the center link 1921. This concept is more clearly illustrated with reference to FIG. 21 which is a screen shot which shows a portion of the modeled apparatus 1900 with the HCS 1901 incoming (e.g., approaching) the FLP and a corresponding motion map (MM) 2100. With regard to the motion map 2101 each of the three discrete speeds (e.g., slow, medium, and fast or other speed(s) as may be set by the system and/or user) of the incoming HCS 1901 may include one or more corresponding actions A through E. The actions A through E have identify outgoing speeds and/or actions (e.g., lose a play, out) as may be set forth below in Table 1. The controller may render the motion map 2100 so that a user may set/reset the motion map 2100, if desired.

TABLE 1

| Incoming | Action(s) | | | | |
|---|---|---|---|---|---|
| speed | A | B | C | D | E |
| Slow | Lose Turn Stop HCS | Slow (outgoing speed) | Med | Fast | Lose Turn HCS traveled off of End |
| Med | Lose Turn Stop HCS | Slow | Med | Fast | Lose Turn HCS traveled off of End |
| Fast | Lose Turn Stop HCS | Slow | Med | Fast | Lose Turn HCS traveled off of End |

The controller may select a action in accordance with a location of the HCS 1901 (or parts thereof such as the center line (CL)) relative to mapped action for the incoming speed when the user (or the controller) enters a command (swipes) to toggle (or otherwise open) the corresponding link pair (e.g., the FLP in the current example) from the closed position to the open position. Thus, for example assuming that the incoming speed, is slow, if the controller determines that the HCS 1901 (as determined by a center line CL of the HCS 1901) is located at location 1 (Loc1) when the user enters the single tap gesture to toggle the FLP from the closed to the open positions, the controller may select action B. However, if the incoming speed under these circumstances is fast, then the controller will select action C. Similarly, for example, if the incoming speed is slow, if the controller determines that the HCS 1901 is located at location 2 (Loc2) when the user enters the single tap gesture to toggle the FLP from the closed to the open positions, the controller may select the action D. However, if the incoming speed under these circumstances is fast, then the controller will select action E.

Then, the controller may control the HCS 1901 in accordance with the action. For example, if action A is selected, the user may lose a turn (play or gain an out) and the HCS 1901 may be slowed and stopped using an oscillating action at the center link 1921, or example. If action B is selected, the controller may slow the HSC 1901 over an interval corresponding with the corresponding incoming speed of the HCS 1901 (e.g. dzs for slow speed; dzm for medium speed, and dzf for fast speed) and then return the HCS 1901 using a speed corresponding with action B (e.g., slow in the present embodiment). Similarly, if action C is selected, the HCS 1901 may slow the HSC 1901 over an interval corresponding with the corresponding incoming speed of the HCS 1901 (e.g., dzs for slow speed; dzm for medium speed, and dzf for fast speed) and then return the HCS 1901 using a speed corresponding with action C (e.g., medium in the present embodiment). Similarly is action D is selected, the HCS 1901 may slow the HSC 1901 over an interval corresponding with the corresponding incoming speed of the HCS 1901 (e.g., dzs for slow speed; dzm for medium speed, and dzf for fast speed) and then return the HCS using a speed corresponding with action D (e.g., fast in the present embodiment). Lastly, if action E is selected, the HCS 1901 may continue off of distal ends 1924 of the link pair and the corresponding user loses a turn (play or gains an out).

Points may be awarded based upon a relationship between incoming and outgoing speeds of the HCS 1901. Thus, for example, if the incoming speed is fast and the outgoing speed is fast; the user may be awarded 900 points. However, if the incoming speed is slow and the outgoing speed is medium, the user may be awarded 200 points.

TABLE 2

| | Outgoing (return) Speed | | |
|---|---|---|---|
| Incoming Speed | Slow | Med | Fast |
| Slow | 100 | 200 | 300 |
| Med | 200 | 400 | 600 |
| Fast | 300 | 600 | 900 |

Table 2 may be set by the system and/or user. Further, the user may receive points for number of returns and/or may receive bonus plays when the user's score is greater than a threshold score (e.g., 25,000, 50,000, 100,000 points, etc.).

However, in yet other embodiments, when it is determined that an HCS has entered a restricted zone (e.g., a restricted zone such as an end zone adjacent to the handles of the links), the user may lose a turn and/or the controller may render information indicating such. For example, the controller may output an audible alarm sound via a speaker of the apparatus and/or illuminate one or more illumination sources (e.g., red LEDs). The controller may keep track of the number of times that the HCS has entered the restricted zone during a current game. Accordingly, when it is determined that the HCS has entered the restricted zone a number of times which is equal to or greater than a threshold number of times, the controller may render information indicative of such (e.g., by sounding an alarm and/or illuminating one or more LEDs) and thereafter end the current game. However, when it is determined that the HCS has not entered the restricted zone a number of times which is equal to or greater than a threshold number of times (e.g., by comparing a value indicative of the number of times), the controller may render information indicative of such (e.g., by sounding an alarm and/or illuminating one or more LEDs) and continue the current game. Each time it is determined that the HCS has entered the restricted zone, the controller may increment a value indicative of the number of time s time that the HCS has entered the restricted zone during the current game. This value may start at zero when the game is started.

The controller may control operation of virtual and/or physical games similarly, or differently from each other, if desired.

Further, when closing and/or opening the links 1920-*x* of a link pair with an HCS 1901 superimposed thereupon, the controller may contract and/or expend the HCS 1901, respectively, accordingly. However, in yet other embodiments, it is also envisioned that the controller may hold the corresponding link pair open until the HCS passes off of it.

Figure 22A:
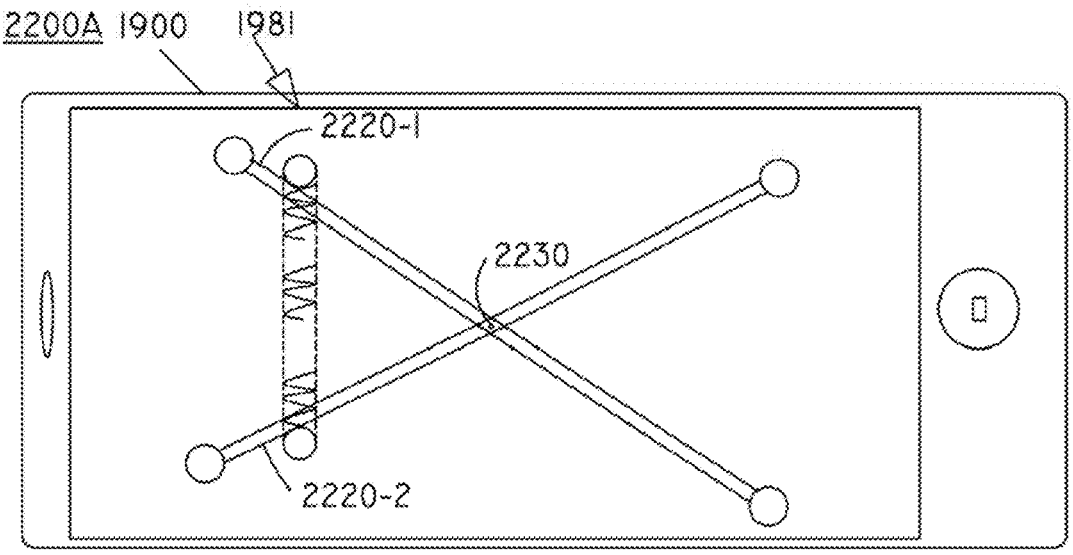
FIG. 22A shows a screen shot of a model apparatus including a HCS in accordance with embodiments of the present system as rendered on a UD of the present system.

FIG. 22A shows a screen shot 2200A of a model apparatus 2200A including a HCS 1901 in accordance with embodiments of the present system as rendered on a UD of the present system. The apparatus 2200A is similar to the apparatus 1900 of FIG. 19A. However, rather than using four links (e.g., 1920-1 through 1920-4) the apparatus 2200A only includes first and second links 2220-1 and 2220-2 (generally 2220-*x*) coupled together via a coupler 2030. This embodiment may be modeled after embodiments of U.S. Patent Application No. 61/598,538, entitled "HELICAL SPRING TOY AND METHOD OF USE THEREOF" to Grossman, the contents of which is incorporated herein by reference. Accordingly, a location of the coupler 2230 may be varied relative to the links 2220-*x*. The links 2220-*x* are shown in an open position.

Figure 22B:
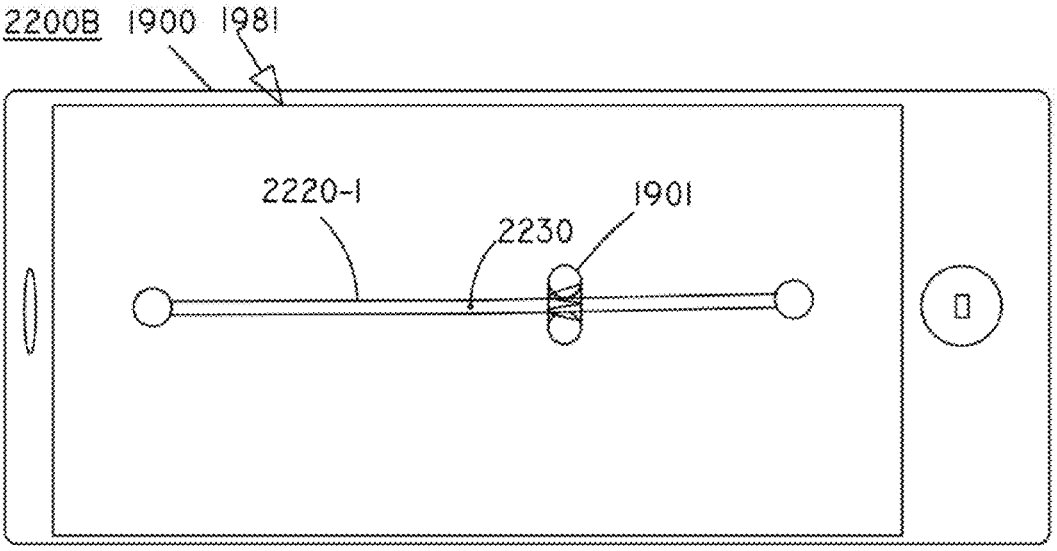
FIG. 22B shows a screen shot of the model apparatus including a HCS in accordance with embodiments of the present system as rendered on a UD of the present system.

FIG. 22B shows a screen shot 2200B of the model apparatus 2200A including a HCS 1901 in accordance with embodiments of the present system as rendered on a UD of the present system. The links 2220-*x* are shown in a closed position.

The HCS and link(s) inserted therein may be located in a vessel having one or more cavities defined by one or more walls. Various vessels are shown in FIGS. 23 through 40. Although vessels having one or more walls are shown, in some embodiments, the one or more walls may have one or more openings.

Figure 23:
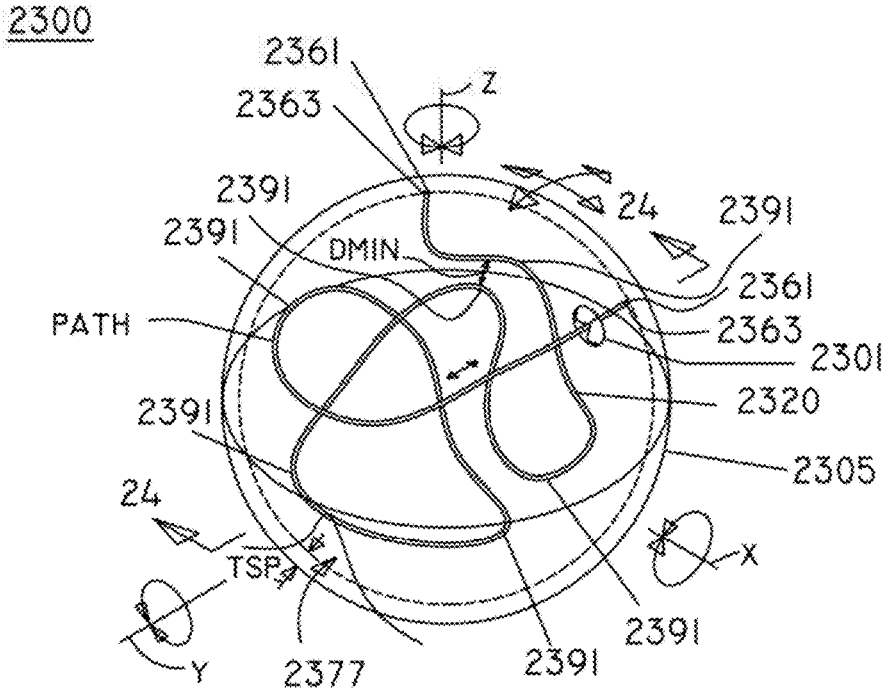
FIG. 23 is a perspective view of a portion of an apparatus which includes a helical coil spring (HCS) in accordance with embodiments of the present system.

FIG. 23 is a perspective view of a portion of an apparatus 2300 which includes a helical coil spring (HCS) 2301 in accordance with embodiments of the present system. The HCS 2301 may be similar to the HCS 101 and may include one or more turns and a center opening 2306 which may be similar to the center opening 106 of the HCS 101. The one or more turns may form tilt or partial loops. The apparatus 2300 may include one or more walls 2305 which may define at least part of one or more cavities 2377 and which may contain one or more links such as a link 2330. The link 2320 may include one or more ends 2361 and may be attached to the one or more walls 2305 using any suitable method (e.g., adhesives, friction fits, screws, bonds, welds, etc.). For example, one or more of the one or more ends 2361 may fit openings 2363 in the one or more walls 2305 which are configured to receive and functionally engage the link 2320. The one or more walls 2305 may have be formed from a suitable material which may be transparent such as a plastic (e.g., acrylic) or glass, etc., and may include one or more optional openings sufficient to insert the link 2320 and/or HCS 2301 into the cavity 2377. The apparatus 2300 may include one or more covers which may cover the one or more optional openings, if desired. The one or more covers may be attached to the one or more walls 2305 using any suitable method e.g., screws, adhesives, welds, bonds, friction fits, latches, etc.). Further, the one or more walls 2305 may have any desired shape such as a sphere, a spheroid, a cylinder, a cuboid, three-dimensional polygons, etc. However, in yet other embodiments, it is envisioned that the one or more walls 2305 may form other shapes such as, for example, animals (e.g., a whale an arched inchworm, etc.), characters (e.g., a cartoon character (e.g., Mickey Mouse™), a movie character), plants (e.g., coconut, a flower (e.g., a daisy), etc.), etc. Further, it is envisioned that in yet other embodiments, the one or more walls may form a circular or semi-circular shape, etc., which may form a corresponding envelop within which, for example, one or more links having a similar shape and/or form (e.g., a circular or semicircle, etc.), may be included.

Referring back to the FIG. 23, the one or more walls 2305 may be formed from a single wall or from a plurality of shells (e.g., clamshell type walls) which may be attached to each other. The one more walls 2305 may have inner and outer surfaces which may be separated from each other by a distance Tsp. Moreover, it is envisioned that ancillary objects such as mirrors, illumination sources, etc., may be coupled to the one or more walls 2305, if desired.

The link 2320 may define a curved path having one or more bends such as bends 2391. The bends 2391 of the path should be gradual such that the HCS 2301 may round the bends 2391 gradually (e.g., without getting stuck at or requiring undue force at any of the bends 2391 to pass. Further, the path of the link 2320 should be configured such that the HCS 2301 does not collide with other portions of the link 2320 other than those portions of the link 2320 which pass through the center opening 2306 of the HCS 2301 as the HCS 2301 travels along the path of the link 2320 as shown by arrows 2395. Accordingly, the adjacent portions of the link 2320 should be separated from each other by a distance (dmi) (e.g., see, FIG. 23) which should be much greater than the outer diameter (odt) (e.g., see, FIG. 3) of the HCS 2301 so that the HCS 2301 does not bind with portions of the link 2320 as it travels along the path of the link 2320. The link 2320 may have any suitable cross section such as round or oval cross section and may include a taper, a spiral, etc., in one or more portions thereof. Further, the link may be configured to form other various paths as may be desired. For example, in yet other embodiments, the link may be straight or may form a helix (e.g. double or single), oval, a polygon, etc.

To use the apparatus 2300, a user may grasp one or more walls 2305 of the apparatus 2300 and orient the apparatus such that a force (e.g., gravity, magnetic, etc.) acting upon HCS 2301 may cause the HCS 2301 to travel along the path of the link 2300. Accordingly, for example, a user may rotate the apparatus about its x, y, and/or z, axes as illustrated by arrows Ax, Ay, and/or Az, respectively, so as cause the HCS 2301 to travel along the path of the link 2300. In yet another embodiment, a user may place the apparatus 2300 on a surface (e.g., a floor, a table, etc.) and may rotate the apparatus 2300 in a desired direction so as to correspondingly rotate the link 2300 such that portions of the link which pass through the HCS 2301 are inclined (e.g., with respect to gravity) so that, for example, the force of gravity (fg) may act upon the HCS 2301 so as to cause the HCS 2301 to travel (e.g., in a desired direction) along the link 2300 substantially between the ends 2363 of the link 2300. This may develop hand and/or eye coordination of the user and may provide a soothing and/or therapeutic effect upon the user. In yet other embodiments, a controller may control orientation of the apparatus 2300 so as to cause the HCS 2301 to travel along the path of the link 2320 substantially between the ends 2363 of the link 2300.

Figure 24:
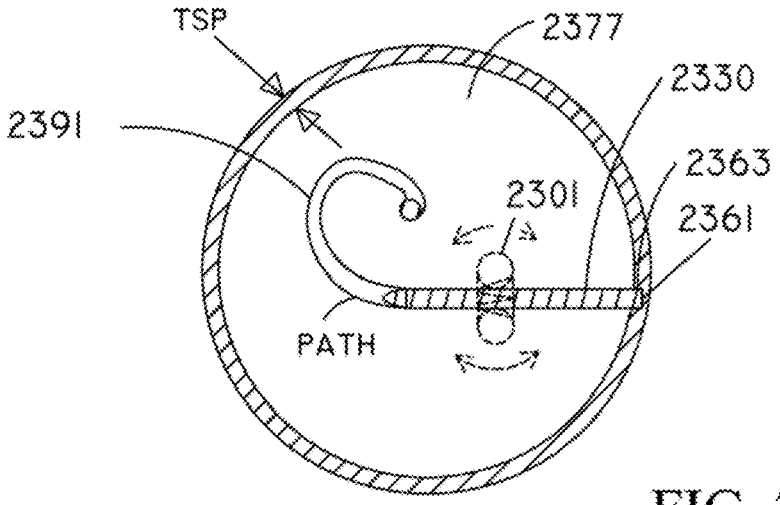
FIG. 24 is a cross-sectional view of the apparatus taken along lines 24-24 of FIG. 23 in accordance with embodiments of the present system.

FIG. 24 is a cross-sectional view of the apparatus 2300 taken along lines 24-24 of FIG. 23 in accordance with embodiments of the present system.

Figure 25:
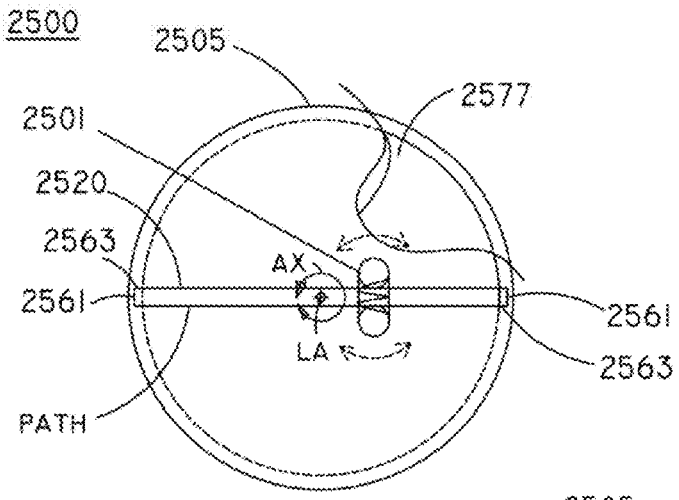
FIG. 25 is a top planer view of an apparatus which includes a helical coil spring (HCS) in accordance with embodiments of the present system.

FIG. 25 is a top planer view of an apparatus 2500 which includes a helical coil spring (HCS) 2501 in accordance with embodiments of the present system. The apparatus may include one or more of an HCS 2501, a link 2520, situated within a cavity 2577 defined by one or more walls 2505. The link 2520 may be coupled to the one or more walls 2505 using any suitable method. For example, one or more of one or more ends 2561 of the link 2530 may fit corresponding openings 2563 in the one or more walls 2505 which are configured to receive and frictionally engage the link 2520. The apparatus 2500 is substantially similar to the apparatus 2300, accordingly, the HCS 2501, the cavity 2577, and/or the one or more walls 2505 may be similar to the HCS 2301, the cavity 2377 and/or the one or more walls 2305, respectively. However, the apparatus 2500 includes more links such as a link 2520 which has a substantially straight path as opposed to curved path of the link 2320 of FIG. 23. Accordingly, rotating the apparatus 2500 its longitudinal axis (LA2500) as shown by the arrow Ax may cause a force (e.g., gravity) which may act upon the HCS 2301 to cause the HCS 2301 travel along the path of the link 2520 between the ends 2561 of the link 2520.

Figure 26:
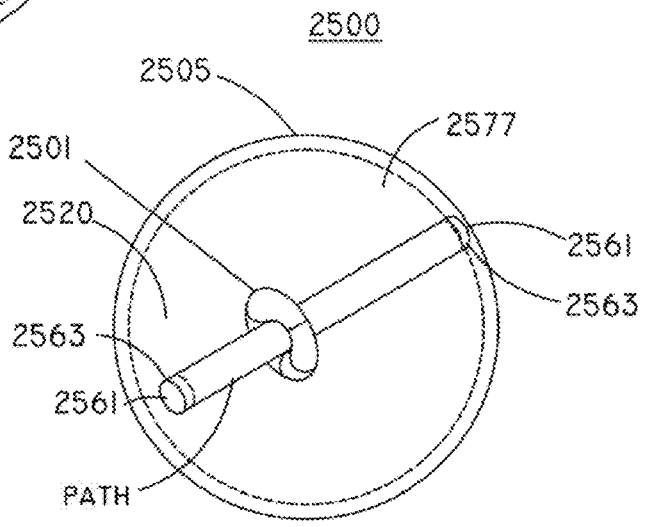
FIG. 26 is a front perspective view of a portion of an apparatus of FIG. 25 in accordance with one or more embodiments of the present system.

FIG. 26 is a front perspective view of a portion of an apparatus 250 of FIG. 25 in accordance with one or more embodiments of the present system.

Figure 27:
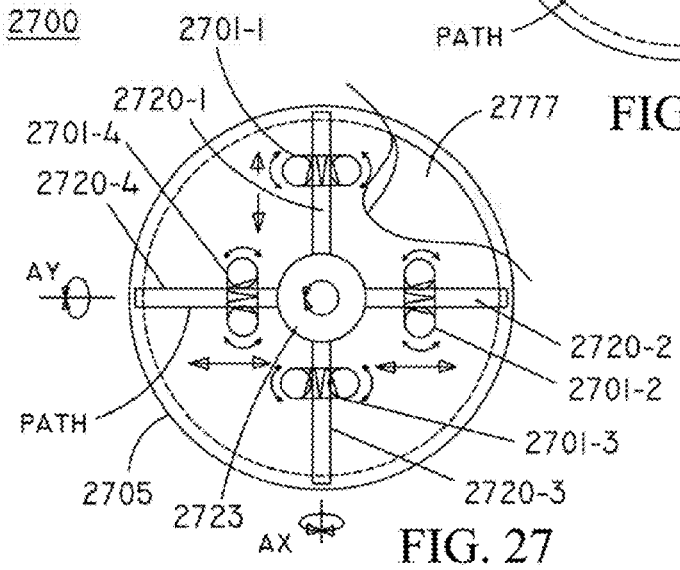
FIG. 27 is a partial top planer view of an apparatus which includes helical coil springs (HCSs) through in accordance with embodiments of the present system.

FIG. 27 is a partial top planer view of an apparatus 2700 which includes helical coil springs (HCSs) 2701-1 through 2701-4 in accordance with embodiments of the present system. The apparatus may include one or more of an HCS **2701-*x*, links 2720-1 through 2720-2 (generally 2720-*x*) which may be situated within a cavity 2777 defined by one or more walls 2705. The links 2720-*x* may be coupled to the one or more walls 2705 using any suitable method. For example, one or more of one more ends 2761 of the links 2730-*x* may fit corresponding openings 2763 in the one or more walls 2705 which are configured to receive and frictionally engage the link 2720. The apparatus 2700 is substantially similar to the apparatus 2700, accordingly, the HCS 2701, the cavity 2777, and/or the one or more walls 2705 may be similar to the HCS 2701, the cavity 2777, and/or the one or more walls 2705, respectively. However, the apparatus 2700) includes a plural of links 2720-*x* as opposed to the single link 2520 of FIG. 25. A divider 2723 may be coupled to the links 2520-*x* and may act to separate the HCSs 2701-*x* from each other as they move about the respective links 2720-*x* which pass through them (i.e., the HCSs 2701-*x*). The divider 2723 may have any suitable shape and/or size and should be configured to separate the HCSs 2701-*x* from each other such that the HCSs 2701-*x* do not substantially touch each other during operation, shipping etc. The links 2720-1 and 2720-3 may be orthogonal to the links 2720-2 and 2720-4**, if desired.

Figure 28:
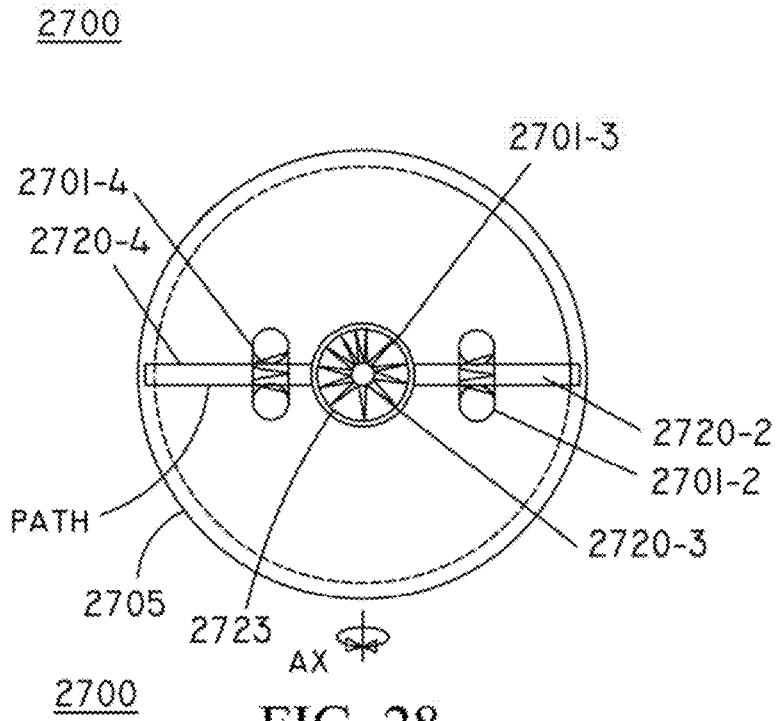
FIG. 28 is a front planer view of an apparatus of FIG. 27 in accordance with one or more embodiments of the present system.

FIG. 28 is a front planer view of an apparatus 2700 of FIG. 27 in accordance with one or more embodiments of the present system.

Figure 29:
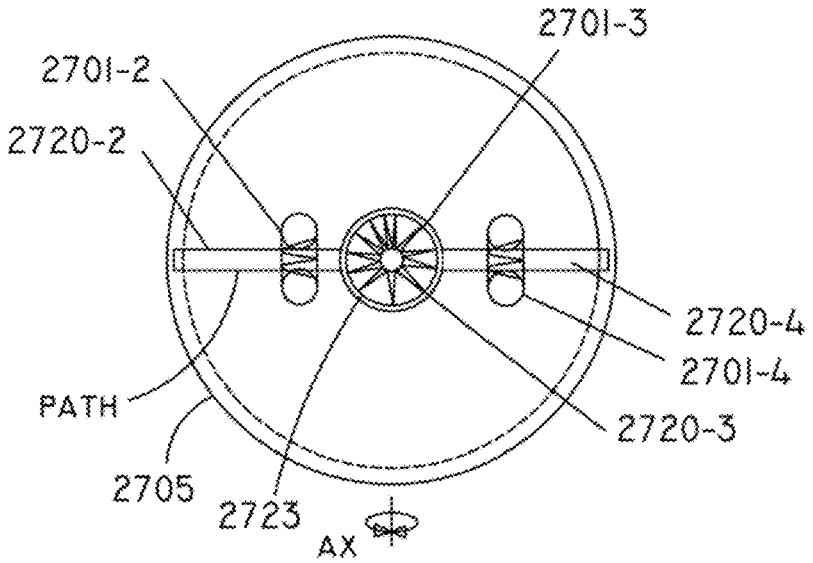
FIG. 29 is a rear planer view of an apparatus of FIG. 27 in accordance with one or more embodiments of the present system.

FIG. 29 is a rear planer view of an apparatus 2700 of FIG. 27 in accordance with one or more embodiments of the present system.

Figure 30:
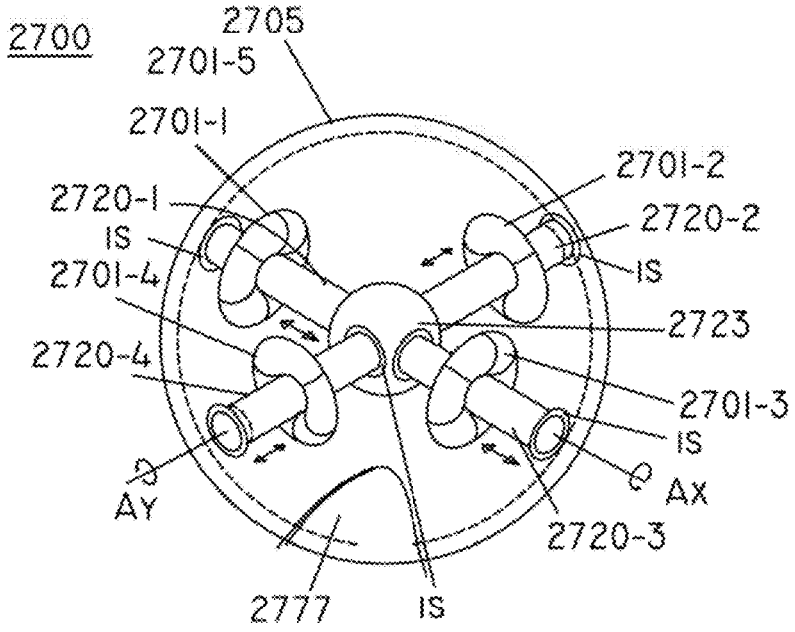
FIG. 30 is a perspective front view of a portion or an apparatus of FIG. 27 in accordance with one or more embodiments of the present system.

FIG. 30 is a perspective front view of a portion of an apparatus 2700 of FIG. 27 in accordance with one or more embodiments of the present system.

In some embodiments, the links may be coupled to the one of the one or more walls and/or the divider using coupler (e.g. hinges such as live hinges, etc.) which may allow movement of the links relative to either or both of the one or more walls and/or divider. Further, it is envisioned in yet other embodiments, an actuator may be coupled to one or more of the links and divider and may transfer a force to one or more of the links and divider as to tilt the links as desired.

Figure 31:
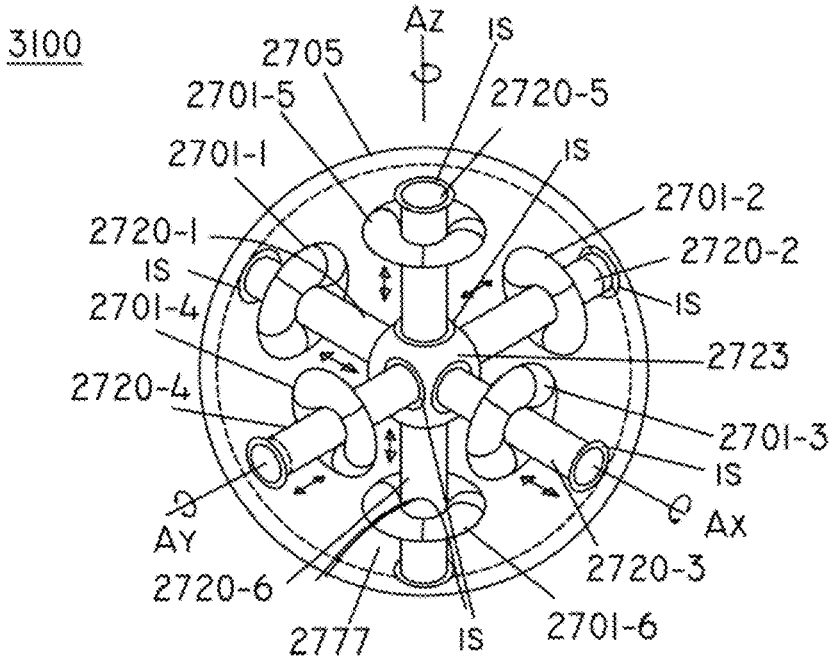
FIG. 31 is a perspective front view of a portion of an apparatus which includes helical coil springs (HCSs) in accordance with embodiments of the present system.

FIG. 31 is a perspective front view of a portion of an apparatus 3100 which includes helical coil springs (HCSs) 2701-1 through 2701-6 in accordance with embodiments of the present system. The apparatus 3100 is similar to the apparatus 2700 (and similar numerals have been used for the sake of clarity). However, the apparatus 3100 includes links 2720-5 and 2720-6 each passing through a center opening of a corresponding HCS 2701-5 and 2701-6, respectively, in addition to links 2720-1 through 2720-4. The links 2720-5 and 2720-6 may be orthogonal to the links 2720-1 through 2720-4, if desired, and may be coupled to the divider 2723 and/or the one or more walls 2705 in a similar manner as the other links 2720-1 through 2721-4. In some embodiments, each link **2720-*x* may have one or more illumination sources (ISs) such as LEDs, etc., at ends of the corresponding link. The ISs may be controlled by a controller and may be illuminated by the controller in a certain sequence (e.g., a pattern) such as link 2720-1 far IS (e.g., IS proximate to the one or more walls 2705) may illuminate for two seconds, then link 2720-1 inner IS (e.g., IS proximate to the divider 2723) may illuminate for two seconds, thereafter link 2720-4 far IS (e.g., proximate to the one or more walls 2705) may illuminate for 2 seconds. The this pattern may correspond with a current level or turn cycle. This illumination pattern may indicate desired pattern of positions of HCSs 2701-*x* of corresponding illuminated links 2720-*x* for the current play cycle. In response to the pattern, the user may manipulate the apparatus 3100 so that the HCSs 2720-*x* of the corresponding links 2720-*x* move adjacent to the illuminated ISs in the same pattern so that the placement of the HCSs 2701-*x* matches the desired position(s). Sensors may detect location of the HCSs 2701-*x* and may provide results of the determination to the controller. The controller may then determine whether corresponding HCSs 2701 were moved to their corresponding desired positions in accordance with the pattern. Accordingly, if it is determined that the corresponding HCSs 2701 were moved to their desired positions in accordance with the pattern, the controller may render information indicating such to a user, may calculate a user's score (e.g., level completed add 100 points, etc.) and/or may determine or otherwise obtain a new pattern and render this pattern in a similar manner as discussed with respect to the first pattern. However, if it is determined that the corresponding HCSs 2701-*x* were not moved to the desired positions in accordance with the pattern (e.g., user manipulated the apparatus in the wrong direction), the controller may render information indicating such to a user, may calculate a user's score accordingly, and/or may subtract a play (e.g. turn) from the user (e.g., the user starts game with three plays). Further, after the subtraction, if it is determine that the user has less than one play, the controller may end the users game and/or update the game history in accordance with the current scores (e.g., high score 20,000 10 levels, John Doe, etc.). Further, if desired, the controller may determine whether any HCSs 2701-*x* other than those corresponding to the illuminated links 2720-*x* and/or certain HCSs 2701-*x* permitted to move, were moved during the current cycle. Accordingly, if it is determined that HCSs 2701-*x* other than those of the illuminated links 2720-*x*** were moved during the current level, the controller may render information indicating such to a user, may calculate a user's score accordingly, and or may subtract a play (e.g. turn) from the user (e.g., the user starts game with three plays). The system and/or use may set and/or select game rules which may be stored in a memory of the system.

Figure 32:
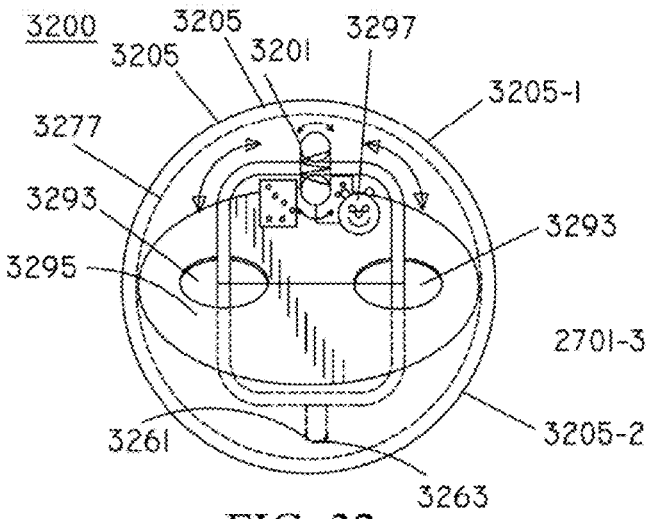
FIG. 32 is a perspective front view of an apparatus which includes a helical coil spring (HCS) in accordance with embodiments of the present system.

FIG. 32 is a perspective front view of an apparatus 3200 which includes a helical coil spring (HCS) 3201 in accordance with embodiments of the present system. The apparatus 3200 may include one or more of the HCS 3201 and a link 3220 situated within a cavity 3277 defined by one or more walls 3205. The link 3220 may have a desired path including one or more portions which is substantially square (shown), oval, round, rectangular, sinusoidal, and helical, paths. The link 3220 may be coupled to the one or more walls 3205 using any suitable method. For example, one or more of one or more ends 3261 of the link 3230 may fit corresponding openings 3263 in the one or more walls 3205 which are configured to receive and frictionally engage the link 3220. Further, the one or more walls 3205 may be formed from first and second shells 3205-1 and 3205-2. The first and/or second shells **3205-*x* may be formed from a transparent material. A second wall 3295 may located within the cavity 3277 and may include one or more optional openings 3293 through which the link 3220 may pass. The second wall 3295 may be opaque so that the HCS 3201 may be partially or fully hidden from view when it is located between the second wall 3295 and the second shell 3205-2, if desired. The openings 3293 should be configured so that they may provide for passage of the HCS 3201 without contact. Further, other walls such as other wall 3297 may situated within the cavity 3277 and attached to the second wall 3295. The other wall 3297 and may include, for example, graphics (e.g., a city skyline, advertising), text, etc. During use, a user may tilt the apparatus 3200 so that the HCS 3201 travels between ends of the link 3201. The link 3201** may have various shapes so as to define a path having a desired shape (e.g., helical, sinusoidal, square, rectangular, polygonal, etc.).

Figure 33:
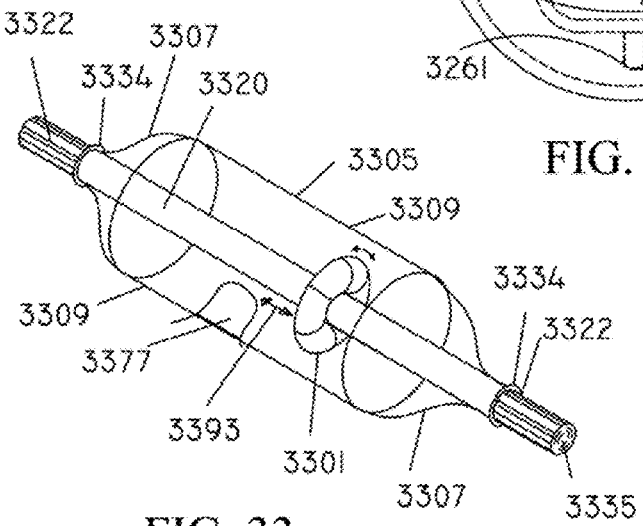
FIG. 33 is a partial front perspective view of an apparatus which includes a helical coil springs (HCSs) in accordance with embodiments of the present system.

FIG. 33 is a partial front perspective view of an apparatus 3300 which includes a helical coil springs (HCSs) 3301 in accordance with embodiments of the present system. The apparatus 3300 may include one or more of the HCS 3301, a link 3320, one or more walls 3305, and handles 3322. The one or more walls 3305 may be configured to form at least part of a cavity 3377 in which at least part of the link 3320 and the HCS 3301 may be located. The one or more walls 3305 may include a center wall 3309 situated between end walls 3307. The link 3320 may have a circular cross section between ends 3334 which may be solid and/or hollow. The one or more walls 3305 may include one or more portions which may be transparent, translucent, and/or opaque. At least portions of the one or more walls 3305 may be formed from a suitable material such as plastic (e.g., polycarbonate, PET, etc.), glass, etc. and may be formed integrally with, or attached to, one or more of the end walls 3307. The handles 3322 should be suitable for grasping by a user and may be attached to, or formed integrally with, one or more of the link 3320 and/or end walls 3307. The end walls 3307 may be configured to hold the link 3320 in desired position. Accordingly, the end walls 3307 may include an opening which may be configured to receive the link 3320 and hold the link 3320 in a desired position. However, in yet other embodiments, it is envisioned that the link 3320 may extend through openings in the end walls 3320 and may be coupled to the end walls 3320 using any suitable method (e.g., adhesives, bonds, welds, screws, flanges, etc.) For example, the link 3320 may include one or more flanges to locate the link 3320 in a desired position relative to the end walls 3320, if desired. However, in yet other embodiments, it is envisioned that ends 3334 of the link may extend to ends 3335 of the handles 3322. For example, it is envisioned that in some embodiments the link 3320 may extend through an opening in a corresponding end wall 3307 or may be formed integrally with a corresponding end wall 3307. It is further envisioned that the handles 3322 may include a coupler (e.g., a threaded coupler, etc.) so that the corresponding handle 3322 may be attached to a desired object such as a hub (as will be described below). In yet other embodiments, it is envisioned that the link 3320 may be formed integrally with the one or more walls 3305. The one or more walls 3305 may protect the HCS 3301 during shipping, storage, and/or use. Further, the one or more walls 3305 may be shaped and/or sized so that the excessive stretching of the HCS 3301 may be prevented.

Figure 34:
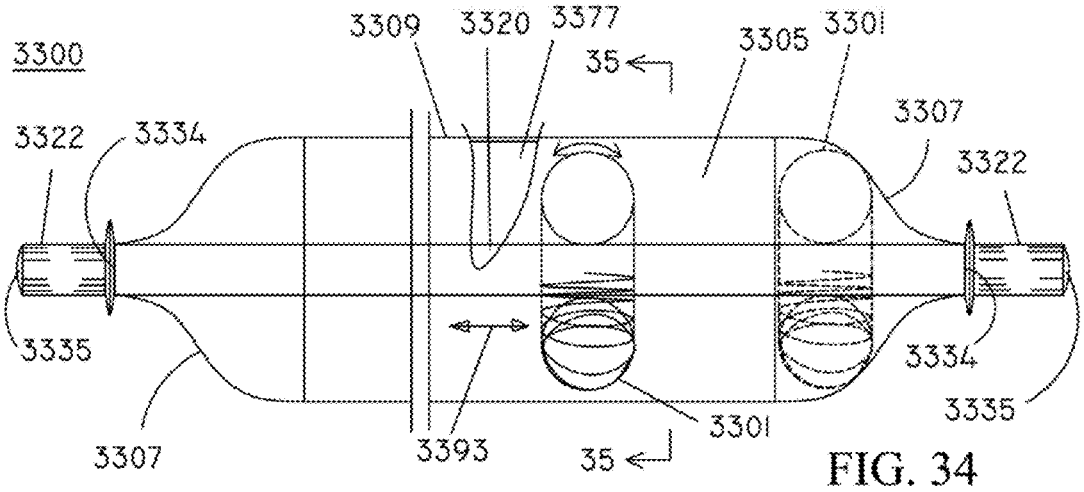
FIG. 34 is a front view of the apparatus in accordance with embodiments of the present system.

FIG. 34 is a front view of the apparatus 3300 in accordance with embodiments of the present system. The HCS 3301 may travel along the link 3320 between the end walls 3307 as illustrated by arrow 3393. The end walls 3307 may be configured to limit the travel of the HCS 3301. However, in yet other embodiments, it is envisioned that one or more bumpers may be situated within the cavity 3377 and may be configured to limit the travel of the HCS 3301. Although a single HCS 3301 is shown in the cavity 3377, in yet other embodiments a plurality of HCSs 3301 may be situated within the cavity. In yet other embodiments, each of the plurality of HCSs 3301 situated in the cavity 3377 may be separated by a bumper which may be stationary and/or mobile. For example, a bumper may include a washer having an opening configured to receive the link 3320 and may travel longitudinally relative link 3320, if desired. In some embodiments, it is envisioned that the one or more outer walls and/or links may include one or more light emitters (e.g., LEDs, etc.) under the control of a controller. The controller may be configured to control the one or more light emitters to emit light in a pattern in accordance with time (e.g., illuminate a first LED, a third LED, a seventh LED, the second LED, etc.). A user may then attempt to manipulate the apparatus so that the HCS is sensed (e.g., by sensors) in a zone of the one or more light emitters that emitted light, in the same pattern. Accordingly, if the HCS is sensed in the same In yet another embodiment, the controller may determine a location of the HCS relative to the link and may output (e.g., by rendering on a UI such as a speaker and/or display of the apparatus) a corresponding tone, pitch, musical note(s), score(s), an auditory attribute of musical tones, etc., and/or an audio (and/or video) file (e.g., an MPEG-3 file, etc.). For example, when it is determined that the HCSs is at the right end of the link, the controller may control a speaker to output corresponding a high-frequency tone, a musical score(s), a musical note(s) and/or a certain file(s) (e.g., an audio file(s)). However, when it is determined that the HCSs is at left end of the link, the controller may control a speaker to output a low-frequency tone, a musical score(s), a musical note(s) and/or a certain file(s) (e.g., an audio file(s)). Thus, a high-frequency tone, musical score(s), and/or musical note(s), audio/video files, etc., may be mapped to one or more locations or zones relative to the link or links. This mapping may be stored in memory of the system and/or may be edited by a user (e.g., using a UI, etc.), if desired. Accordingly, a user may manipulate the apparatus so as to move the HCS, which movement may result in a an audible output.

Figure 35:
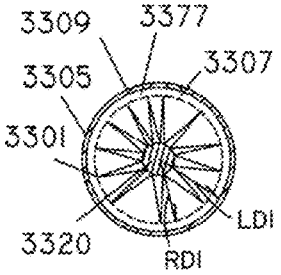
FIG. 35 is cross-sectional view of the apparatus taken along lines 35-35 of FIG. 34 in accordance with embodiments of the present system.

FIG. 35 is cross-sectional view of the apparatus 3300 taken along lines 35-35 of FIG. 34 in accordance with embodiments of the present system. The link 3320 may be solid or hollow and may be situated within the cavity 3377. The center wall 3309 may partially or fully surround the HCS 3301 and may include a substantially round cross-section having a radius (Ldi). Ldi may be sized such that it is larger than an outer peripheral diameter (Rdi) of the HCS 3301. Accordingly, the HCS 3301 may have sufficient room to stretch (e.g., radially away from the link 3320) without contacting the center wall 3309 during normal use. With regard to the shape and size of the center wall 3309, it is also envisioned that in other embodiments the center wall 3309 may include other cross-sectional shapes such as an oval, a polygon (e.g., a square, a rectangular, a triangular, etc.) etc.

Figure 36:
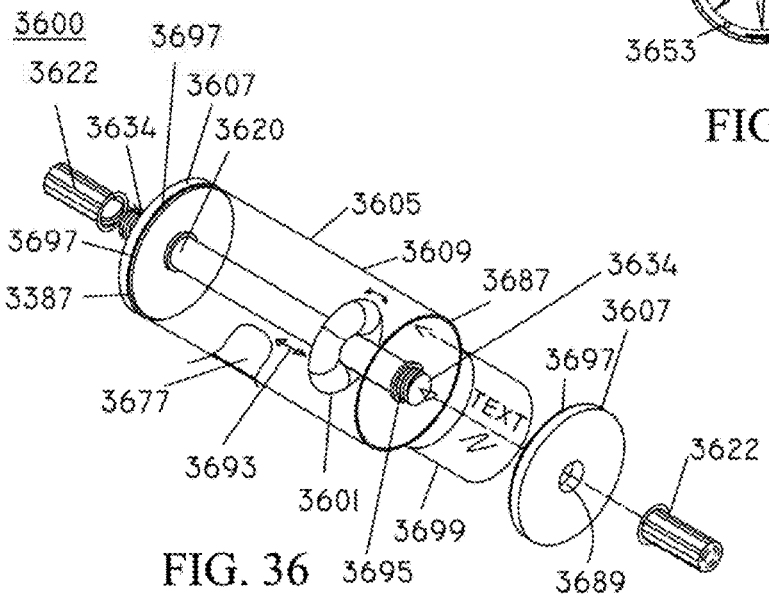
FIG. 36 is an exploded partial front perspective view of an apparatus which includes a helical coil springs (HCSs) in accordance with embodiments of the present system.

FIG. 36 is an exploded partial front perspective view of an apparatus 3600 which includes a helical coil springs (HCSs) 3601 in accordance with embodiments of the present system. The apparatus 3600 is similar to the apparatus 3300 and may include one or more of the HCS 3601, a link 3620, one or more walls 3605, and handles 3622. However, the one or more walls 3605 may include end walls 3607 which may be substantially flat as opposed to conical such as the end walls 3307 of the apparatus 3300. One or more of the HCS 3601, the link 3620, the one or more walls 3605, and the handles 3622 may be coupled to each other using any suitable method (e.g., threads, screws, welds, adhesives, friction fits, latches, rivets, etc.). For example, the link 3620 may include threads 3695 which may engage corresponding threads in one or more of the end walls 3607 and the handles 3622 so as to sandwich the center wall 3609 between the end walls 3607. Accordingly, for example, the handles 3622 may include threads which may be coupled to corresponding threads 3695 located at ends 3634 of the link 3620. The end walls 3607 may include openings 3689 configured to receive at least a portion of the link 3620. However, in other embodiments, the handles 3622 may be formed integrally with corresponding end walls 3607. Further, in yet other embodiments, the ends 3687 of the center wall 3609 may include threads configured to be coupled to corresponding threads of a flange area 3697 of the end walls 3607. In yet other embodiments, the end walls may be formed integrally with the handles and may be coupled to the center wall 3909 using any suitable method (e.g. welding, threads, a friction flit etc.).

The one or more inserts such as an insert 3699 which may include graphics and/or text (e.g., as may be suitable for promotional items toys, etc.) and may be inserted within the cavity 3677. The insert 3699 may be formed from any suitable material or materials (e.g., paper, plastic, wood, metal, and/or laminates thereof, etc.) and may, if desired, by attached to one or more of center wall 3709 and/or the end walls 3707 using any suitable method (e.g., adhesives, cohesive, welds, glues, friction fits, etc.). In some embodiments, the insert 3699 may be formed from a resilient material (e.g., plastic) which may bias itself against the one or more walls 3605. In some embodiments, the one or more walls 3605 may include graphics and/or text.

Figure 37:
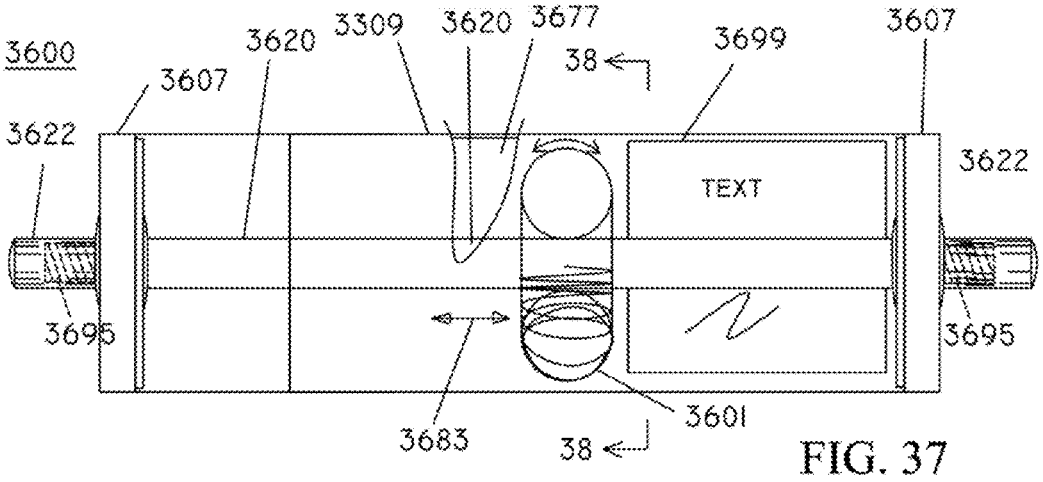
FIG. 37 is a front view of the apparatus in accordance with embodiments of the present system.

FIG. 37 is a front view of the apparatus 3600 in accordance with embodiments of the present system. The HCS 3601 may travel along the link 3620 between the end walls 3607 as illustrated by arrow 3683. The end walls 3607 may be configured to limit the travel of the HCS 360. However, in yet other embodiments, it is envisioned that one or more bumpers may be situated within the cavity 3677 and may be configured to limit the travel of the HCS 3601. The insert 3699 is shown situated within the cavity 3677.

Figure 38:
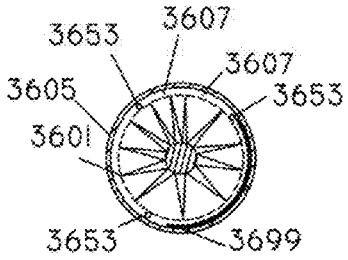
FIG. 38 is cross sectional view of the apparatus taken along lines 38-38 of FIG. 37 in accordance with embodiments of the present system.

FIG. 38 is cross sectional view of the apparatus 3600 taken along lines 38-38 of FIG. 37 in accordance with embodiments of the present system. The link 3620 may be solid or hollow and may be situated within the cavity 3677. The center wall 3609 may be similar to the center wall 3309, if desired. The insert 3699 may adhere to art inner surface of the one or more walls 3605. Further, the link 3920 may be cylindrical having a round cross section. However, it is also envisioned that the link may include other types of cross sections (e.g., oval, etc.), may be tapered, etc., if desired.

In yet other embodiments, one or more rods may be coupled to one or more of the end walls. For example, the rods may be coupled to and extend between both end walls. The rods may be located radially away from the center link such as at locations 3653. However other locations and/or numbers of rods are also envisioned. The rods may protect contents of the cavity such as the HCS. Further, in yet other embodiments, its also envisioned that the cavity may include, for example, ball bearings, marbles, other cavities, spirals, etc.

Figure 39:
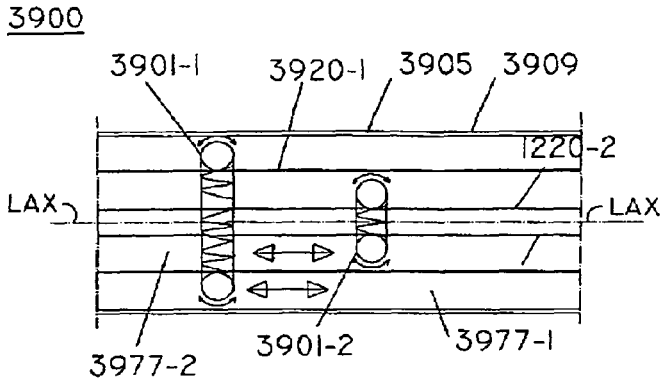
FIG. 39 is a front view of portion of an apparatus in accordance with embodiments of the present system.

FIG. 39 is a front view of portion of an apparatus 3900 in accordance with embodiments of the present system. The apparatus 3900 may be similar to the apparatus 3600. However, the apparatus 3900 may include first and second links 3920-1 and 3920-2, the first link 3920-1 may be situated within a first cavity 3977-1 formed at least in part by an outer wall 3905; and the second link 2900-2 may situated within second cavity 3977-2 which may be formed at least in part by the first link 3920-1 and may be situated within the first cavity 3977-1. A first HCS 3901-1 may be situated around the first link 3920-1 and a second HCS 3901-2 may be situated around the second link 3920-2. The wall 3905 may include a center wall 3909 which may be cylindrical in cross section and may include end walls situated at ends of the center wall 3909 so as to close at least part of the cavity 3977-1. Further, one or more of the first and second links 3920-1 and 3920-2, respectively, may be cylindrical in shape and may have a round cross section. However, in yet other embodiments, one or more of the center wall 3905, the first link 3920-1, and the second link 3920-2 may a taper. Further, the taper of the first and second links may be in the same or in opposite directions relative each other.

Thus, for example, assuming each of the first and second links includes a first end having a small taper (e.g., a small diameter) and a second end having a larger taper (e.g., the larger diameter than the diameter of the first end) and that the taper of each of the first and second links is sufficient to cause a corresponding HCS to travel to the first end of the corresponding link when the apparatus is held with its longitudinal axis (Lax) substantially parallel to the horizon. Further, assuming the first ends of the first and second links are on opposite sides of each other relative to the apparatus 3900. Then, when the apparatus is held with its longitudinal axis (Lax) substantially parallel to the horizon, the first and second HCSs may each travel towards the first ends of the corresponding links and in opposite directions to each other.

Figure 40:
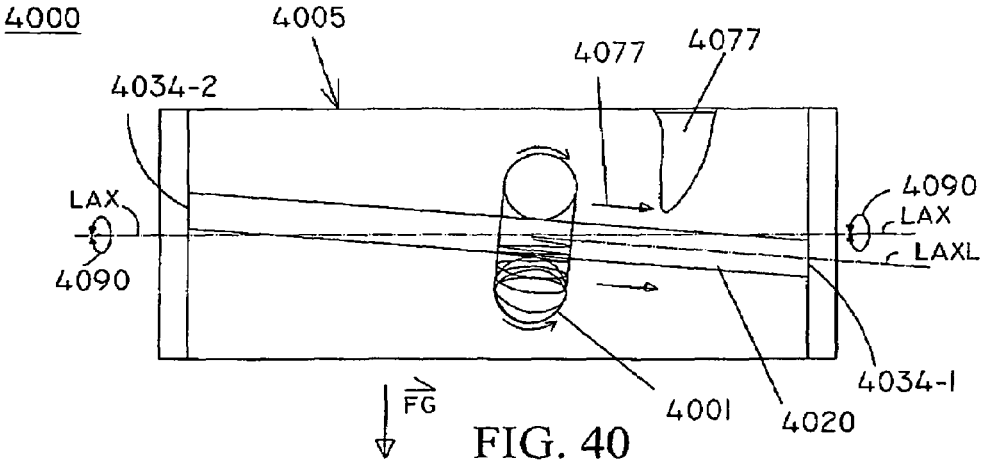
FIG. 40 is a front view of a portion of an apparatus in accordance with embodiments of the present system.

FIG. 40 is a front view of a portion of an apparatus 4000 in accordance with embodiments of the present system. The apparatus 4000 may be similar to the apparatus 3600, and may include one or more of one or more walls 4005, a link 4020, and an HCS 4001. The one or more walls 4005 may include a center wall 4005 which may be similar to the center wall 3605, and end walls 4007 one or more of which may be coupled to the link 4020. The link 4020 may included first and second ends 4034-1 and 4034-2, respectively. However, unlike the apparatus 3600, a longitudinal axis (Laxl) of the link 4020 is not substantially parallel to a longitudinal axis (Lax) of the one or more walls 4005. Accordingly, when in an orientation shown (e.g., the first end 4034-1 of the link 4020 is lower than the second end 4034-2 of the link 4020) and assuming that the Lax is substantially parallel to the Earth's Horizon, the force of gravity (illustrated by arrow Fg) may cause the HCS 4001 to move towards first end 4034-1 of the link 4020. Further, by rotating the apparatus 4000 about its longitudinal axis (Lax) as illustrated by arrow 4090, the orientation of the link 4020 may change such that the second end 4034-2 of the link 4020 may rotate into a position that is lower than first end 4034-1 of the link 4020 (as illustrated by the dotted lines depicting the link 4020 in this position. Accordingly, in this position, the force of gravity (Fg) (acting downwards) may act upon the HCS 4001 to urge it towards the second end 4034-2 of the link 4020. Accordingly, by rotating the apparatus 4000 about its longitudinal axis (Lax) while maintaining the Lax substantially horizontal, the HCSs 4001 may travel between the first and second sides 4034-1 and 4034-2, respectively, of the link 4020. Further, to rotate the apparatus 4000 about its longitudinal axis (Lax), a user may roll the apparatus 4000 on any suitable surface such as a floor, a table, a bed, a wall, a shelf, etc.

In some embodiments, vessels may include one or more walls configured to form a cavity for containing one or more HCSs and one or more links. These vessels may be coupled to a carriage. The carriage may include one or more wheels and/or a chassis as will be described below. It is further envisioned that vessels in accordance may be coupled to a gimbal having one or more axes of rotation (e.g., x, y, and/or z axes). In yet other embodiments, it is envisioned that an actuator may be coupled to one or more links (e.g., link x20) which may be situated within a vessel (e.g., via a force-transmitting linkage). The actuator may transmit a force to move at least a portion of the link relative to the one or more walls. This movement may be sufficient to cause a force such as the force of gravity (fg) to act upon the HCS so as to cause the HCS to move relative to the link. In yet other embodiments, it is envisioned that the actuator may be coupled to the one or more walls and may transmit a force to move the one or more walls. This movement may be sufficient to cause a force such as the force of gravity (fg) to act upon the HCS so as to cause the HCS to move relative to the link. In some embodiments, the actuator may be driven by one or more wheels of a carriage. However, in yet other embodiments, it is envisioned that the actuator may be controlled by a controller including one or more processors and/or other logic devices.

Figure 41:
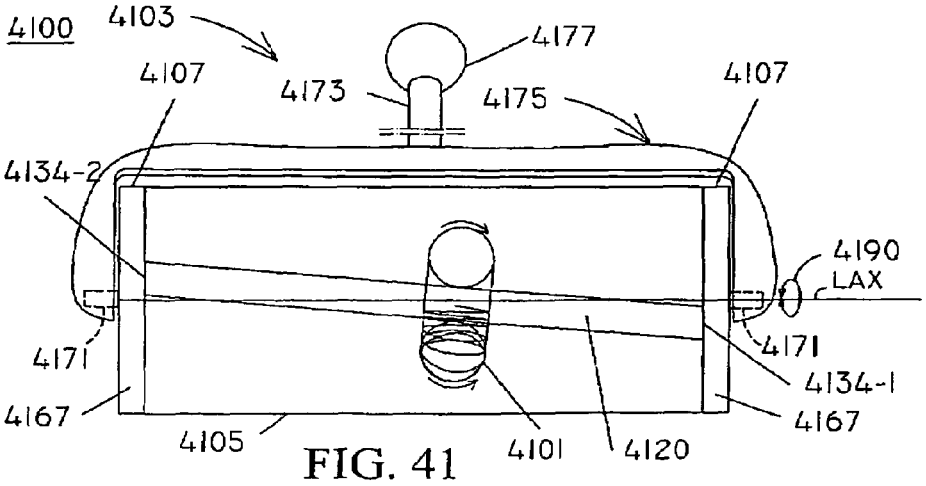
FIG. 41 is a front view of a portion of an apparatus 4100 in accordance with embodiments of the present system.

FIG. 41 is a front view of a portion of an apparatus 4100 in accordance with embodiments of the present system. The apparatus 4100 may be similar to the apparatus 4000 and include one or more of one or more walls 4105, a link 4120, and an HCS 4101, which may be similar to the one or more walls 4005, the link 4020, and the HCS 4001. However, a carriage 4103 including one or more of a chassis 4175, a shaft 4173, and a handle 4177 may be coupled to the one or more walls 4105 using any suitable method. For example, the chassis 4175 may include openings configured to receive the axles 4171 of the end walls 4107. The end walls 4107 may further include friction enhancing surface (e.g., rubber, plastic, etc.) 4167. During operation, a user may pull the apparatus 4100 along a desired surface (e.g., a floor) by grasping one or more portions of the carriage 4103 (e.g., the chassis 4175, the shaft 4173, and/or the handle 4173) and friction between surface and one or more of a center wall 4105 an/or the end walls 4107 of the one or more walls 4105 may rotate the one or more walls 4105 about their longitudinal axis (Lax) thus causing opposed first and second ends 4134-1 and 4134-2, respectively, of the link 4120 to rise or fall relative to the surface (assuming the surface is the ground). Accordingly, a gravitational force may act upon the HCS 4101 so as to cause the HCS 4101 to travel back and forth between the first and second ends 4134-1 and 4134-2, respectively, of the link 4120 as the apparatus 4100 is rolled along the surface.

Figure 42:
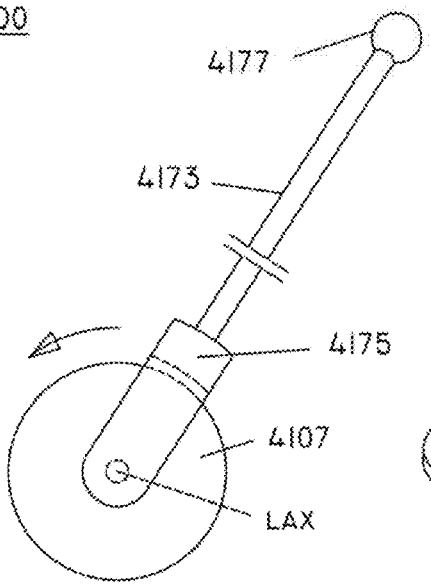
FIG. 42 is a side view of the apparatus in accordance with embodiments of the present system.

FIG. 42 is a side view of the apparatus 4100 in accordance with embodiments of the present system. The one or more of the side walls 4107 may act as wheels which may contact the surface. However, in yet other embodiments, separate wheels may be coupled to one or more of the side walls 4107 and/or center wall 4109.

Figure 43:
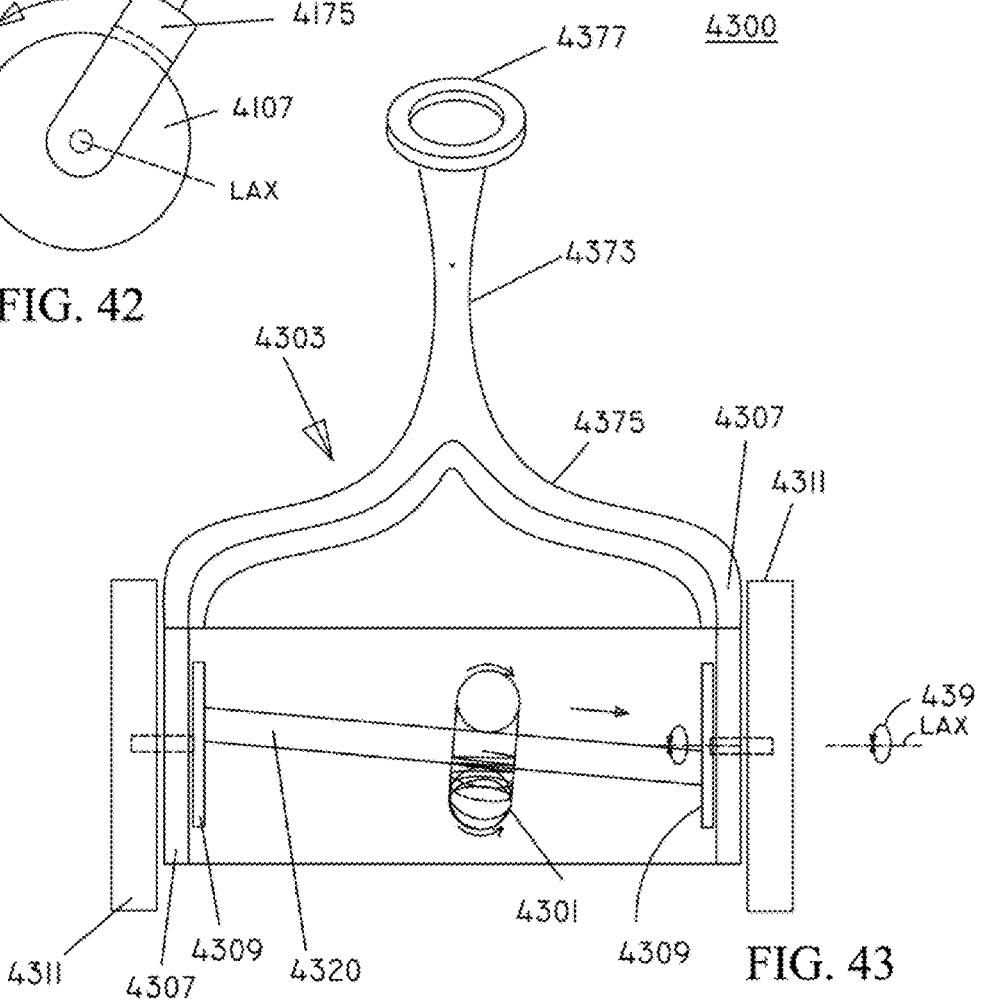
FIG. 43 is a front view of a portion of an apparatus in accordance with embodiments of the present system.

FIG. 43 is a front view of a portion of an apparatus 4300 in accordance with embodiments of the present system. The apparatus 4300 may be similar to the apparatus 4100 and include one or more of one or more walls 4305, a link 4320, and an HCS 4301, and a carriage 4303 which may be similar to the one or more walls 4105, the link 4120, the HCS 4101 and the carriage 4103. However, the one ort more outer walls 4305 may be rotationally decoupled a rotation of the link 4320. Accordingly, for example, the link 4320 may be coupled to one or more hubs 4309 which may pass through openings in corresponding side walls 4307 and may be rotationally coupled to an adjacent wheel 4311. Accordingly, when one or more wheels 4311 rotate (e.g., see arrows 4390), they (e.g., the wheels 4311) may cause the one or more hubs 4390 attached thereto to rotate. However, as the one or more walls 4305 (which may include end walls 4307 and a center wall 4309) are rotationally decoupled from the wheels 4390), they may remain in position as the wheels 4390 rotate. Further, as a longitudinal axis (Laxl) of the link 4320 ray be offset from a longitudinal axis (Lax) of a center of rotation of the one or more hubs 4309, the HCS 4301 may move between ends of the link 4320 as the hubs rotate as discussed above with reference to the apparatus 4100. Further, with regard to the end walls 4307, these may be formed integrally with a chassis 4375 of the carriage 4303. The carriage 4303 may further include a shaft 4303 and a handle 4377 coupled thereto and which may be suitable for grasping by a user.

Figure 44:
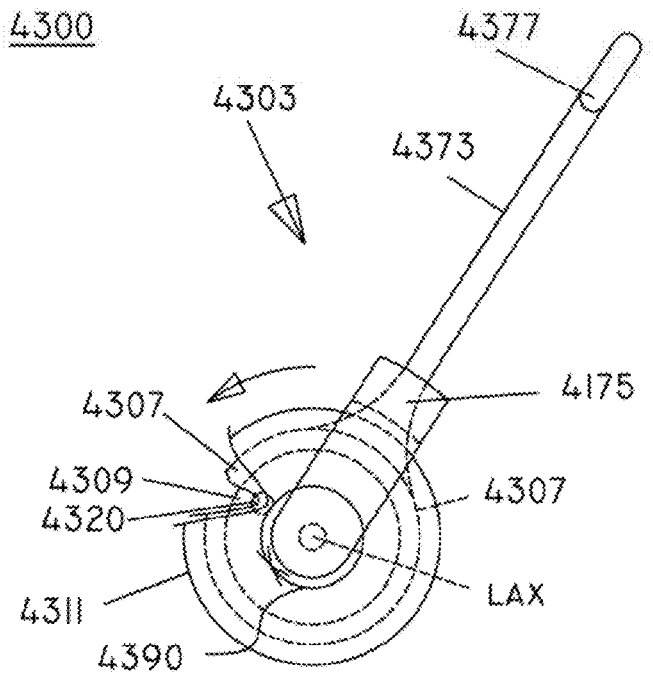
FIG. 44 is a side view of a portion of an apparatus of FIG. 43 in accordance with embodiments of the present system.

FIG. 44 is a side view of a portion of an apparatus 4300 of FIG. 43 in accordance with embodiments of the present system.

Figure 45:
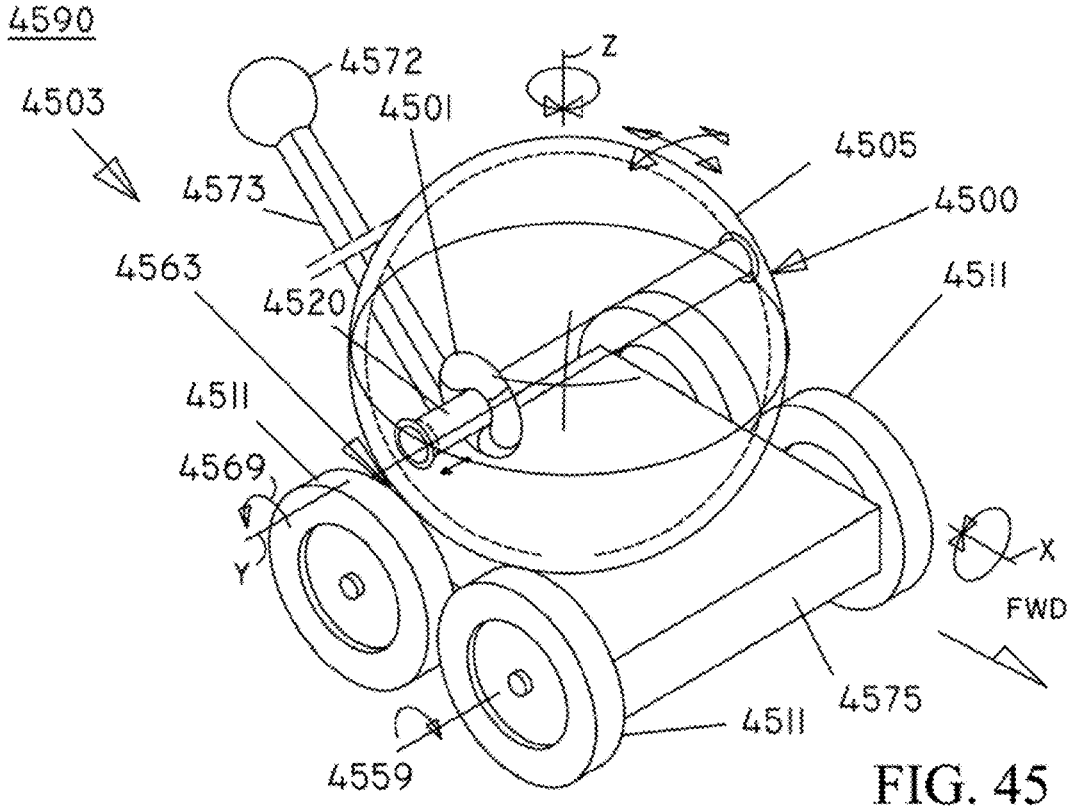
FIG. 45 is a front perspective view of an apparatus having a vessel and a carriage in accordance with embodiments of the present system.

FIG. 45 is a front perspective view of an apparatus 4590 having a vessel 4500 and a carriage 4503 in accordance with embodiments of the present system. The vessel 4500 may be similar to the apparatuses 2300, 2500, 2700) 3100, 3200 which may be spherical. However, in yet other embodiments, it is envisioned that the vessel 4500 may be similar to the apparatuses 3300, 3600, 3900, or 4000 which may be cylindrical. However, other types of vessels 4500 are also envisioned. The vessel 4500 may include one or more walls 4505 which form at least part of a cavity 4577. One or more links 4520 and one or more HCS 4501 are situated within the cavity such that the one or more links 4520 may pass through a center opening of corresponding ones of the one or more HCSs 4501. The carriage 4503 including one or more of a chassis 4575, a shah 4573, a handle 4572, and one or more wheels 4511. The one or more wheels 4511 may be coupled to the chassis 4575 using any suitable method (e.g., axles, caps, bolts, etc.). The shaft 4573 may be formed integrally with, or separately from, the chassis 4575 and may be coupled to the chassis 4575 using any suitable method (e.g. friction its screws, bolts, adhesives, etc.). The handle 4572 may be formed integrally with, or separately from, the shaft 4573 and may be coupled to the shaft 4573 using any suitable method (e.g., friction fits, screws, bolts, adhesives, etc.). The handle 4572 may be shaped and/or sized such that it is suitable for grasping by a user. Accordingly, the handle 4572 may be substantially spherical. However, in yet other embodiments, the handle includes a loop. Similarly, the shaft 4573 may include two or more shafts. For example, in some embodiments, the shaft and handle may form a "U" shaped object with the bottom of the U forming the handle and the top of the U (e.g., the bifurcated ends) coupled to the chassis 4575. The vessel 4500 may rest upon upper portions of the wheels 4511 such that rotation of the wheels 4511 causes a rotation of the vessel 4511 about one or more of its axes (e.g., x, y, and/or z axes). Accordingly, when for example, the wheels 4511 rotate in the direction of arrow 4559, the vessel 4500 may rotate in an opposite direction substantially about a similar axis (e.g., the y-axis) as illustrated by arrow 4569. This rotation may cause the link 4520 to roll, pitch, and/or yaw which may cause the force of gravity to act upon the HCSs 4501 and cause it to travel between ends of the link 4520 as the chassis 4503 is, for example, moved across a floor by a user. Further, the wheels 4511 may include a taper to hold the vessel in position 4500, if desired. Moreover, one or more of the wheels 4511 may include a friction modifying surface such as a friction enhancing surface and/or a friction reducing surface (e.g., to enhance slip), if desired. It is preferable that the wheels 4511 rotate independently of each other. However, in yet other embodiments, one or more of the wheels may be rotationally coupled (e.g., rotate dependently with each other) to each other. For example, the front wheels may be rotationally coupled to the same axle such that rotating the front left wheel causes an equal rotation in the right fount wheel, it is further envisioned that the wheels 4511 may be aligned with each other or may have a toe-in. Further, it is envisioned that the wheels 4511 may have camber, if desired. Thus, for example, the tops of two or more of the wheels 4511 may converge at a point, if desired. Further, by changing camber or distance between wheels on the front and rear axles respectively, a point of contact between a corresponding wheel and the outer wall of the vessel 4500 may be varied which may consequently vary a rotational ratio between the wheels 4511 and the vessel 4500. Thus, for example, for any given wheel speed (e.g., assuming all wheels turning at a constant rotational velocity), the rotational velocity of the vessel may be varied by varying the point of contact of the corresponding wheel and the vessel 4500. This may have an effect of a variable transmission.

Further, in some embodiments, one or more of the wheels 4511 may have an outside diameter that is different from each other. Thus, for example, wheels 4511 on the tight side of the carriage 4503 may have a smaller outside diameter than the wheels on the left side of the carriage 4503. Accordingly, assuming that carriage 4503 is pulled along a floor the wheels 4511 on the right side will rotate faster than the wheels on the left side. Accordingly, this difference in rotational speed between the wheels on the right and left sides may cause the vessel to rotate about its z axis, if desired.

Figure 46:
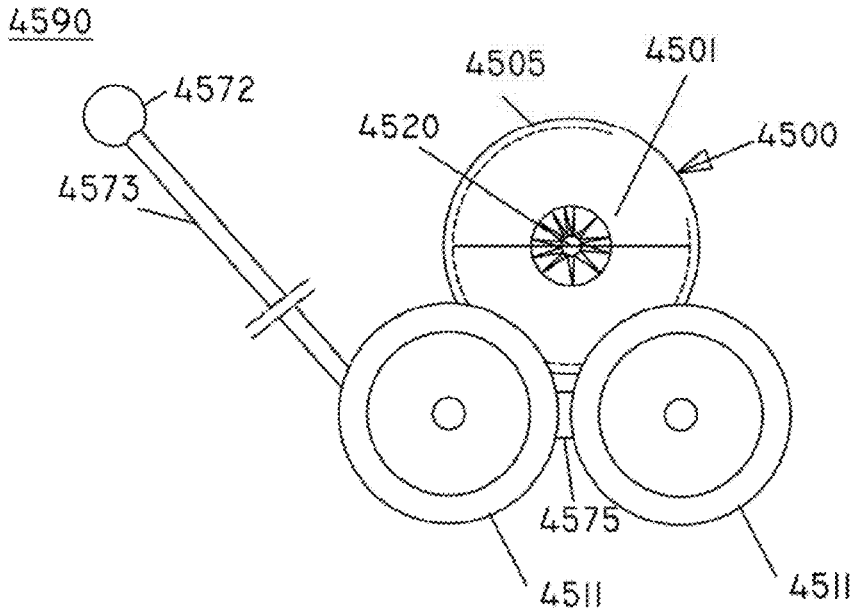
FIG. 46 is a side view of a portion of the apparatus of FIG. 45 in accordance with embodiments of the present system.

FIG. 46 is a side view of a portion of the apparatus 4590 of FIG. 45 in accordance with embodiments of the present system. Each of the wheels 4511 may have the same size and/or shape as the others.

Figure 47:
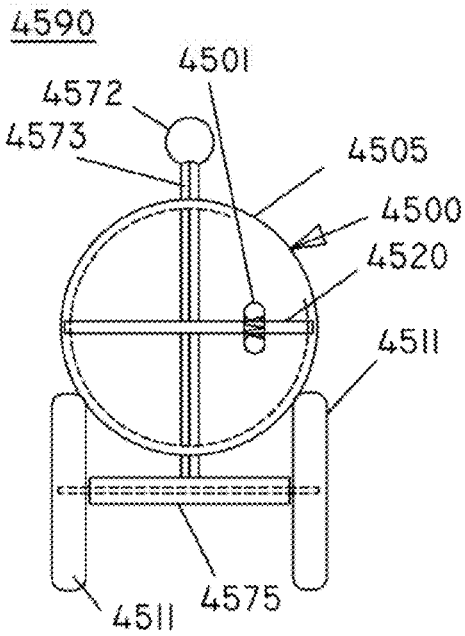
FIG. 47 is a front view of a portion of the apparatus of FIG. 45 in accordance with embodiments of the present system.

FIG. 47 is a front view of a portion of the apparatus 4590 of FIG. 45 in accordance with embodiments of the present system.

Figure 48:
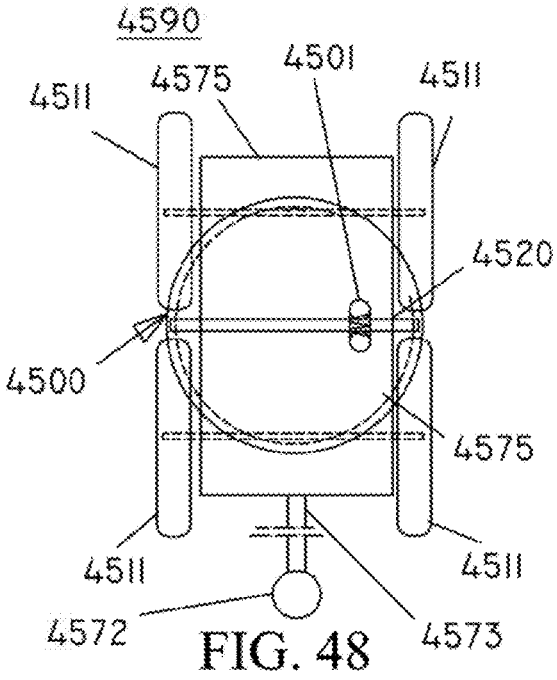
FIG. 48 is a top view of a portion of the apparatus of FIG. 45 in accordance with embodiments of the present system.

FIG. 48 is a top view of a portion of the apparatus 4590 of FIG. 45 in accordance with embodiments of the present system. Each wheel 4511 may be mounted to an independent axle or an axle may be commonly shared between two wheels.

Figure 49A:
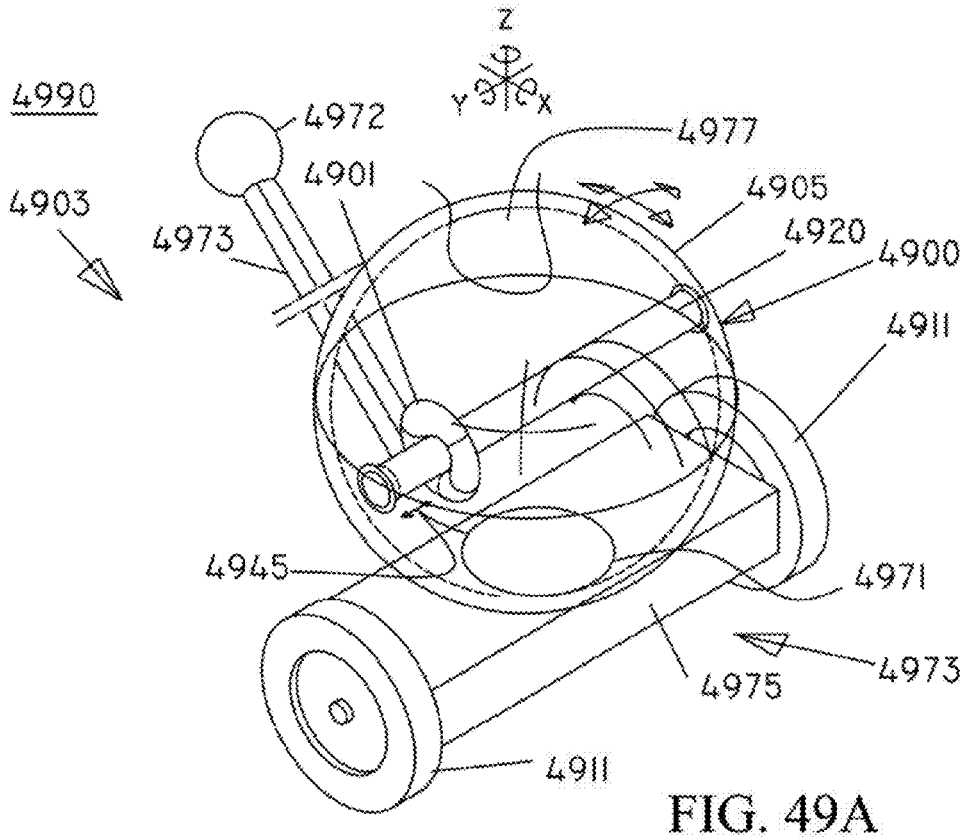
FIG. 49A is a front perspective view of an apparatus having a vessel and a carriage in accordance with embodiments of the present system.

FIG. 49A is a front perspective view of an apparatus 4990 having a vessel 4900 and a carriage 4903 in accordance with embodiments of the present system. The carriage 4903 may include one or more of a chassis 4975, a shaft 4973, a handle 4972, one or more wheels 4911, an actuator, and a vessel coupler 4971. The vessel 4900 may be similar to spherical vessels shown elsewhere such as the spherical vessels shown in FIGS. 23 through 32 and FIGS. 45 through 48. However, it is also envisioned that the vessel 4900 may include other shapes and/or sizes. For example, it is envisioned that the vessel 4900 may include one or more walls having a cylindrical shape and, thus, may be similar to the cylindrical vessels shown in FIGS. 33-40, etc., if desired.

The vessel 4900 may include one or more walls 4905 which form at least part of a cavity 4977 for containing at least part of a link 4920 and an HCS 4901. The one or more walls 4905 may be coupled to the chassis 4975 using a vessel coupler 4971 which may fixedly or flexibly couple the vessel 4900 to the chassis 4975. For example, when the vessel 4900 is fixedly coupled to the chassis 4975 both the vessel 4900 and the chassis 4975 may remain in the same position relative to each other. However, when the vessel 4900 is flexibly attached to the chassis 4975, the vessel 4900 may move relative to the chassis 4975 about, for example, with one or more degrees of freedom (e.g., 6 degrees of freedom although other values are also envisioned) as illustrated by arrow 4931. However, in yet other embodiments, the vessel coupler may be configured to rotate the vessel about a single axes such as the y axis (shown).

With regard to flexibly coupling, the vessel coupler 4971 may include, for example, gimbals, canfield joints, u-joints, hinges (e.g., regular, complex, live, etc.), rotational or rotary turntables (e.g., "Lazy-Susan"-type rotary turntables), etc. which may be configured to provide this motion with one or more degrees of freedom. An actuator may be coupled to, and/or driven by, one or more of the wheels 4911 (e.g., directly or via an axle) and/or to a controller and may be operative to provide a force to move the vessel 4900. The actuator may include linear and/or rotary actuators. Sensors may be provided to detect an orientation of the vessel 4900 relative to the chassis 4975 and provide this information to the controller. The controller may then determine a next position for the vessel 4900 relative to the chassis 4975 and may control the actuator accordingly so as to provide a force to move the vessel 4900 to the next position relative to the chassis 4975. Accordingly, the actuator may alternately tilt the link (e.g., about one or more axes such as the y axes shown) so as to cause it to wobble. One or more forces such as the force of gravity may then act upon the HCS 4901 so as to cause the HCS 4901 to move back and forth along the link 4920 as illustrated by arrow 4941.

Figure 49B:
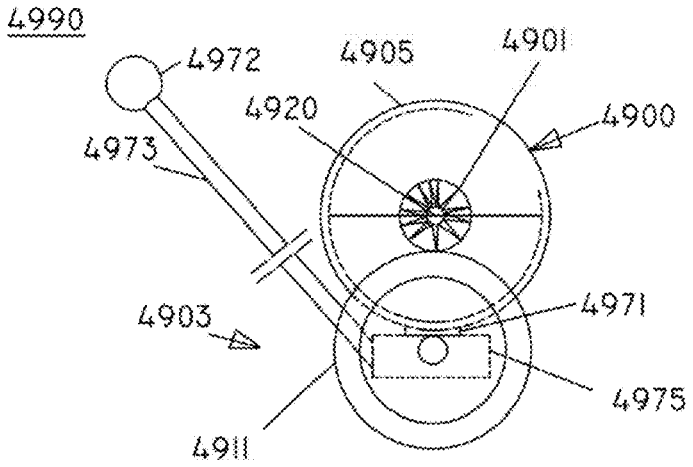
FIG. 49B is a side view of a portion of the apparatus of FIG. 49A in accordance with embodiments of the present system.

FIG. 49B is a side view of a portion of the apparatus 4990 of FIG. 49A in accordance with embodiments of the present system. Each of the wheels 4911 may have the same size and/or shape as the others.

Figure 49C:
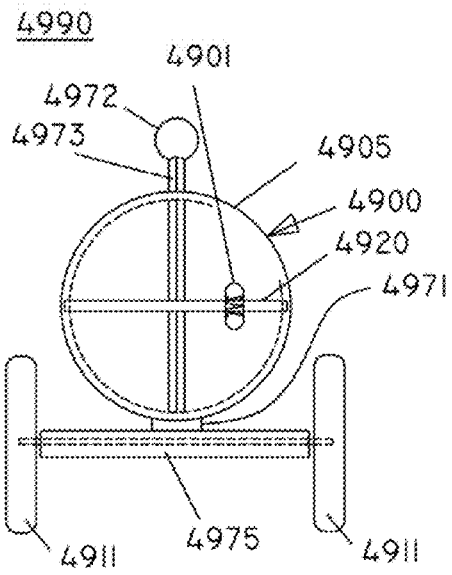
FIG. 49C is a front view of a portion of the apparatus of FIG. 49A in accordance with embodiments of the present system.

FIG. 49C is a front view of a portion of the apparatus 4990 of FIG. 49A in accordance with embodiments of the present system. The one or more walls 4905 may include one or more openings and/or attachment flanges. Further, the link 4920 may include a plurality of links.

Figure 49D:
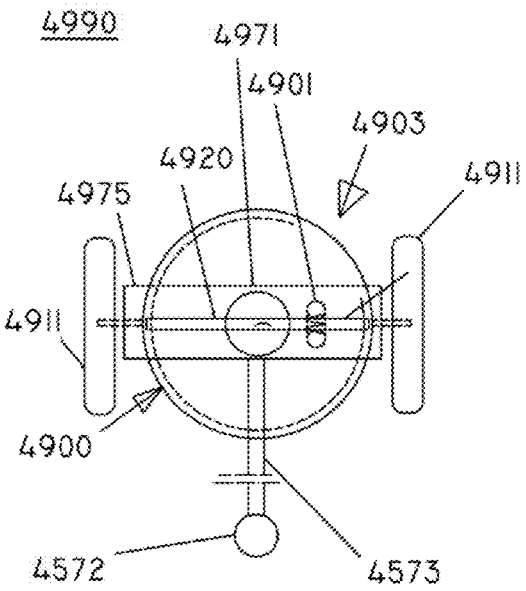
FIG. 49D is a top view of a portion of the apparatus of FIG. 49A in accordance with embodiments of the present system.

FIG. 49D is a top view of a portion of the apparatus 4590 of FIG. 49A in accordance with embodiments of the present system. Each wheel 4911 may be mounted to a common axle. However, in yet other embodiments, one or more of the wheels 4911 may include an independent axle. Further, in yet other embodiments, the chassis may include more than two wheels.

Figure 50A:
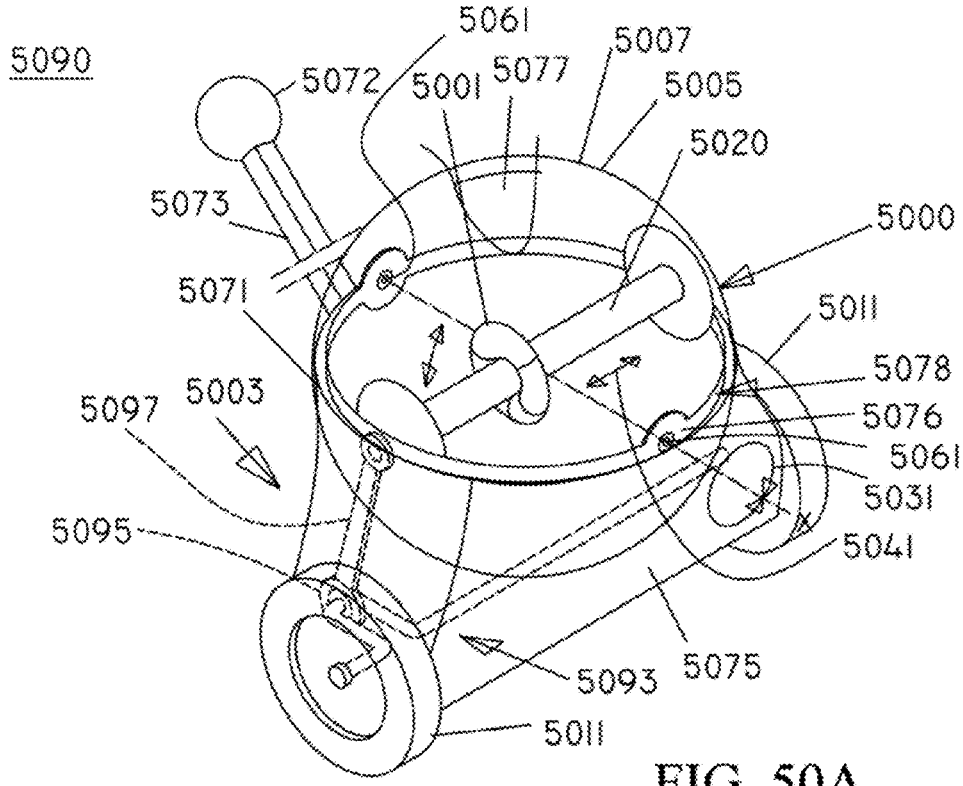
FIG. 50A is a front perspective view of an apparatus having a vessel and a carriage in accordance with embodiments of the present system.

FIG. 50A is a front perspective view of an apparatus 5090 having a vessel 5000 and a carriage 5003 in accordance with embodiments of the present system. The carriage 5003 may include one or more of a chassis 5075, a shaft 5073, a handle 5072, one or more wheels 5011, a gimbal 5078, and an actuator assembly 5093. The vessel 5000 may include one or more walls 5005 which form at least part of a cavity 5077 for containing at least part of a link 5020 and an HCS 5001. The one or more walls 5005 include a transparent dome 5007 which may be coupled to the chassis 5075 at coupler 5071. The chassis 5075 may form at least another part of the cavity 5077. Accordingly, the chassis may include a lower dome 5007-2. The vessel 5000 may include an HCS 5001 having a center opening through which a link 5020 passes. The gimbal 5078 may flexibly couple the link 5020 to the chassis 5075 with one or more degrees of freedom. The actuator assembly 5093 may include a link 5097 which is driven by a crankshaft 5095 and impresses a driving force upon the link 5020 to urge the link 5020 to rotate about one or more axes such as an x axis of the gimbal 5078 as illustrated by arrow 5031. However, in yet other embodiments, the link 5020 may be coupled to the chassis using any suitable coupler such as canfield joints, u-joints, hinges (e.g., regular, complex, live, etc.), rotary turntables (e.g., "lazy-susan"-type rotary turntables etc, which may be configured to provide one or more degrees of freedom to the link relative to the chassis. The gimbal 5078 may include a gimbal ring 5076 and one or more hinge pins 5089 which may be received by openings of the chassis 5003 configured to receive the hinge pins 5089.

The actuator 5093 may be coupled to, and/or driven by, one or more of the wheels 5011 (e.g., directly or via an axle such as axle 5091) and/or to a controller and may be operative to provide a force to rotate a portion of the gimbal 5078 about its x axis. Accordingly, the link 5020 attached to the gimbal 5078 may rotate about the x axis of the gimbal 5078. However, in yet other embodiments, the actuator may be coupled directly to the link. The actuator 5093 may include linear and/or rotary actuators. For example the actuator 5093 may include a link 5097 coupled to a crank 5095 of the axle 5091 so as to provide a reciprocating force to the gimbal so as to rotate the gimbal about its x axis when the wheels 5011 rotate during use. Sensors may be provided to detect an orientation of the link 5020 (or gimbal) and/or the HCS 5001 and provide this information to the controller. The controller may then determine a next position for the link 5020 relative to the chassis 5075 and may control the actuator accordingly so as to provide a force to move the vessel link to the next position relative to the chassis 5075. Accordingly, the actuator 5093 may alternately tilt the link 5075 (e.g., about one or more axes such as the y axes shown) so as to cause it to wobble. One or more forces such as the force of gravity may then act upon the HCS 5001 so as to cause the HCS 5001 to move back and forth along the link 5020 as illustrated by arrow 5041. In yet other embodiments, the actuator may include any suitable actuator such as linear and/or rotary motors (e.g., electronic, pneumatic, and/or hydraulic motors) and/or combinations thereof, which may be controlled mechanically and/or by a controller using digital and/or analog control methods. In yet other embodiments, the actuator may include cam shafts, gears, etc. so as to control displacement and/or speed, respectively, of an output of the actuator.

Figure 50B:
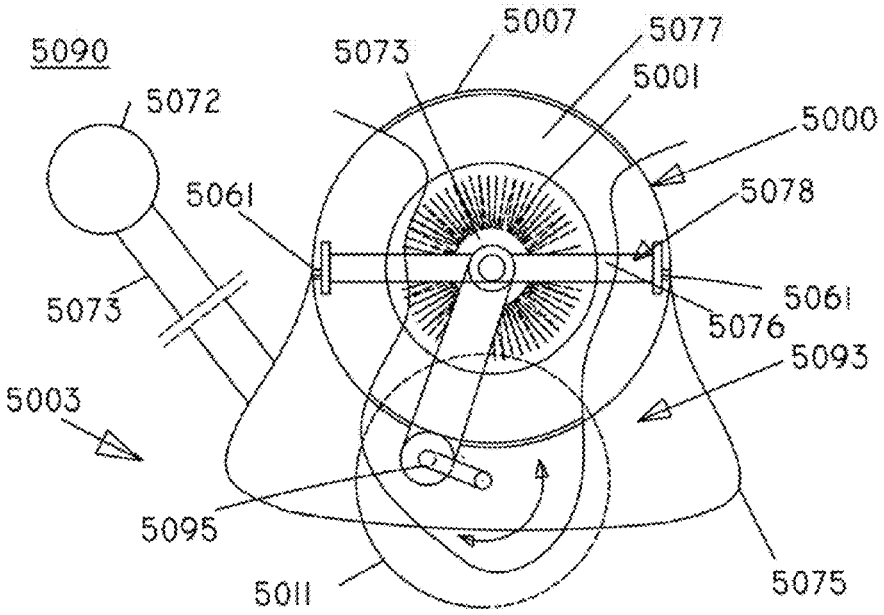
FIG. 50B is a side view of a portion of the apparatus of FIG. 50A in accordance with embodiments of the present system.

FIG. 50B is a side view of a portion of the apparatus 5090 of FIG. 50A in accordance with embodiments of the present system. Each of the wheels 4911 may have the same size and/or shape as the others and may be shown rotated slightly so as to display features of the apparatus 5090 in more detail.

Figure 50C:
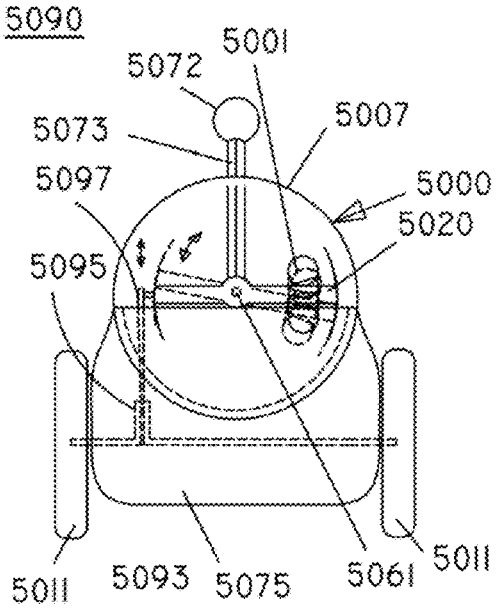
FIG. 50C is a front view of a portion of the apparatus of FIG. 50A in accordance with embodiments of the present system.

FIG. 50C is a front view of a portion of the apparatus 5090 of FIG. 50A in accordance with embodiments of the present system. The one or more walls 4905 may include one or more openings and/or attachment flanges. Further, in some embodiments, the link 5020 may include a plurality of links.

Figure 50D:
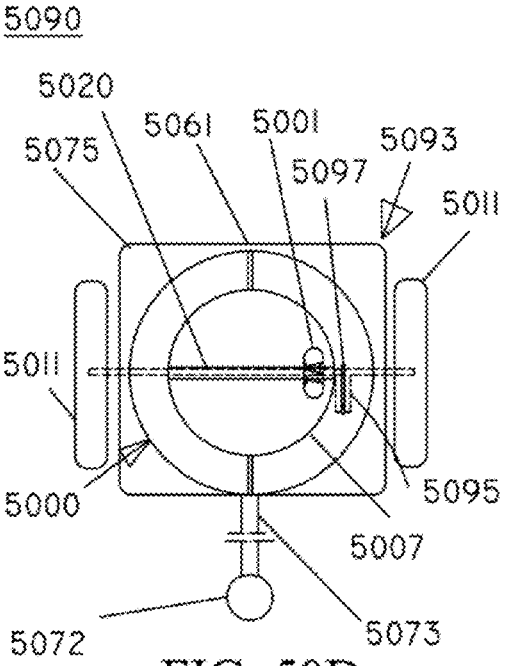
FIG. 50D is a top view of a portion of the apparatus of FIG. 50A in accordance with embodiments of the present system.

FIG. 50D is a top view of a portion of the apparatus 5090 of FIG. 50A in accordance with embodiments of the present system. Each wheel 5011 may be mounted to a common axle such as the axle 5091. However, in yet other embodiments, one or more of the wheels 5011 may include an independent axle. Further, in yet other embodiments, the chassis may include more than two wheels.

In some embodiments, it is envisioned that one or more of the wheels may include an asymmetric shape such as may be typical of a cam profile and/or may include an offset axle so that the wheel may rotate eccentrically. Accordingly, when this wheel rotates, its eccentricity and/or cam profile may cause the carriage and/or the vessel coupled thereto to wobble. In yet other embodiments, the carriage may include other numbers of wheels such as three (e.g., with a single front wheel mounted in the front center), etc.

Moreover, it is envisioned that the one or more walls may include one or more openings. The openings may provide ventilation and/or access to the cavity. For example, in some embodiments, actuator or parts thereof such as linkages may pass through the opening. The actuator may be coupled to the one or more links so as to displace the one or more links if desired. Moreover, in yet other embodiments, illumination guides and/or wires may pass through the opening. The illumination guides may be configured to act as a conduit for illumination. Further, the wiring may provide power, control, command, and/or communication to controller, sensors, and/or actuators within the cavity defined by the one or more outer walls. Further, in yet other embodiments, the one or more outer walls may include a cavity for a power source (e.g., a battery, a capacitor, etc.). In yet other embodiments, the one or more walls may include lugs for attachment to, for example, couplers such as gimbals, canfield joints, u-joints, hinges (e.g. regular, complex, live, etc.), etc. Further, in yet other embodiments, the one or more links may be coupled to a link coupler which may spin or otherwise tilt the links attached thereto. The link coupler may include, for example, axles, gimbals, hinges, canfield joints, u-joints, etc.

Figure 51:
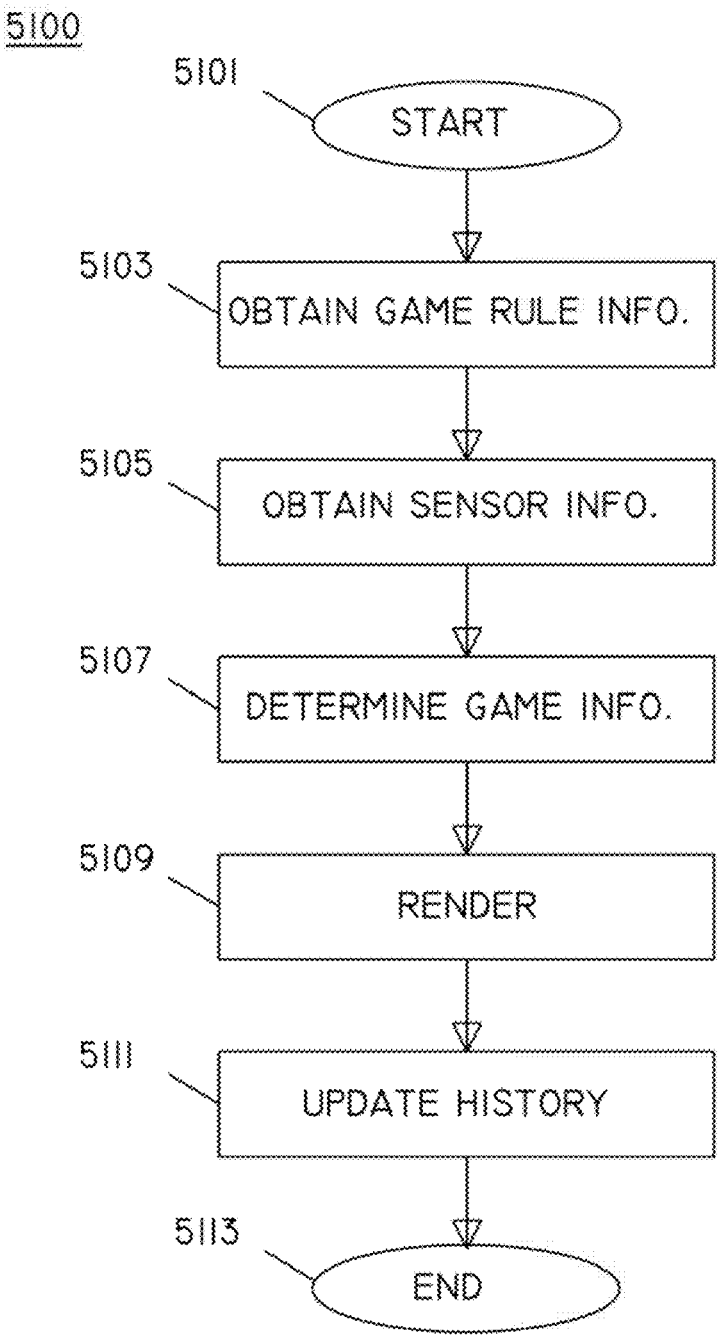
FIG. 51 is a flow diagram that illustrates a process in accordance with an embodiment of the present system.

FIG. 51 shows a flow diagram that illustrates a process 5100 in accordance with an embodiment of the present system. The process 5100 may be performed using by a system having one or more computers which may communicate over a network. The process 5100 can include one of more of the following acts. Further, one or more of these acts may be combined and/or separated into sub-acts, if desired. In operation, the process may start during act 5101 and then proceed to act 5103.

During act 5103, the process may obtain game rule information (GR) from a memory of the system and/or may set game type and for play level (e.g., an experience level) in accordance with a default setting and/or a user's selection. Accordingly, the process may obtain the GR which may include information related to game type(s) and/or play level(s) and may render this information. Table 3 is a table which illustrates GR. More particularly, the game types include one or more game types such as types I, II, III, . . . user defined 1 (e.g., user def1), user defined 2 (e.g., user def2), etc. However, other types as may be defined by a user and/or system are also envisioned. After rendering information related to the GR, on for example, a display of the system, the process may await a user's selection or may select a default game type (e.g., after a period of time has elapsed). The GR may be indexed in a table format as shown in Table 3 below and may be set and/or reset by the system and/or user. However, other formats are also envisioned. After completing act 5103 the process may continue to act 5105.

During act 5105, the process may obtain sensor information from one or more sensors of the system. The sensor information may be obtained from sensors of the system (which may be may be local and/or remotely located). The sensors of the system may sensors such as acceleration sensors which provide acceleration information (e.g., in one or more axis, e.g. to detect change in orientation of the apparatus); gravity sensors which provide orientation information (e.g., to detect orientation e.g. tilted up, down, etc.), proximity sensors which provide proximity information (e.g., electrical, optical, and/or mechanical, sensors such as an infra-red sensor to detect the presence of the HCS), microphones, and/or other sensors as may be discussed elsewhere. For example, in the present embodiment, it will be assumed that the system obtains the proximity information. In some embodiments, to conserve resources, the process may obtain the sensor information only from one or more sensors in accordance with the selected, game type, if desired. For example, if the game type selected requires sensor information from proximity sensors such as sensors located in one or more first end zones (end zone 1), the process may obtain information related to the HCS from the first end zone sensors. After completing act 5105, the process may continue to act 5107.

During act 5107, the process may determine game information (GI) in accordance with the sensor information and/or the selected CR. The GR may set forth methods to determine the GI of a game such as points, plays (e.g. turns or outs), rendered information (e.g., graphics, text, audio, video, etc.), one or more of which may be rendered on a UI of the system such as a display and/or speaker for the convenience of a user. Thus, the GI may include information related to a user's score, speed or velocity of the HCS, orientation, plays, outs, etc.

For example, in accordance with a first game type, a user's score may be determined in accordance with points earned for passing a center link (e.g., see, Table 3, center point pass) of the apparatus by the HCS (e.g. 100 points each time HCS passes the center link); while in the second game type, a user's score may be determined in accordance with points earned for passing a center link of the apparatus and in accordance with speed (e.g., trap speed) of the HCS through a speed trap. For example, the points earned may be multiplied by a multiplier based upon the determined speed of the HCS as it passes the speed trap (e.g., if speed of the HCS is in a range of three through ten feet-per-second multiplier is 3; however, if speed of the HCS is less than three feet-per-second multiplier is 0.5). Further, in accordance with yet other game types, one or more travel zones and no-travel zones (e.g., one or more prohibited zones such as end zones) may be defined along a length of one or more of the links. Accordingly, for example, to obtain points, the HCS must travel to a travel zone (e.g., be detected by sensors at the travel zone). Conversely, if it is detected that the HCS has not traveled to the defined travel zone, a user may be not be awarded points or may be awarded a reduced number of points. With regard to the end zones, if it is detected that the HCS has traveled to an end zone (e.g., overshot its set amplitude or travel distance), the user may lose a turn (or play) and may receive no points. Thus, travel zones may set forth zones which the HCS should travel (e.g., to gain points) to and other zones which the HCS should not travel to (e.g., to avoid lost turns). Further, points may be generated in accordance with rotational ranges of a user's associated link pair (e.g., a FLP and/or a SLP). Thus, for example, if it is determined that a user has rotated his link pair between 90 and 120 degrees the points received during the current turn may be predefined (e.g., 100 points) or may be set in accordance with a multiplier (e.g., x=1.5) while if a user has rotated his link pair between 121 and 140 degrees, the user may receive 200) points and the multiplier x may be equal to 2.0, etc. The score may be adjusted in accordance with points earned by a user during a turn. Thus, the score may be a summation of points awarded to a user during a game and may be updated in real time.

Similarly, the GR may include information relevant to determine actions to be taken based upon detected regard to roll, pitch, and/or yaw of the apparatus. For example, in accordance with a certain game rule (or a certain game type), the controller may determine points, multipliers, and/or lost plays (e.g., outs) in accordance with one or more threshold values and/or ranges of values. For example, if it is determined that a user has pitched the apparatus (e.g., 25 degrees) and this value is greater than or equal to a threshold pitch value (e.g., 20 degrees) during play, the controller may subtract a play from the user and award the user no points for a most recent point calculation (e.g. points for speed, crossing the speed trap, etc.).

Similarly, the GR may include information relevant to determining actions based upon a number of players. For example, in dual player games (e.g. games with two users) the controller may determine points based upon actions associated with a player of the two more players. Thus, for example, points for a player may be determined in accordance with a trap speed of the HCS substantially due to a players action(s).

Similarly, the GR may include information relevant to determining actions based upon play level. For example, play level information may include information related to an experience level and may include one or more levels such as (e.g., 1=new player, 2=intermediate player, 3=advanced player, etc.). The play level may be selected by a user or the system, for example, in accordance with a stored settings for the user acquired from a memory of the system or may be selected based upon default settings, etc. The play level (1, 2, 3) may include information related to corresponding threshold values such as threshold speed value (e.g., 10, 20, 30, respectively, for the play levels 1, 2, and 3.). Further, during this act, the process may reset initial values such as "plays"=4 (or conversely "outs"=0) and score=0, for each player.

A game rule table including GR is shown below in Table 3

TABLE 3

| | Action(s) | | | | | | | |
|---|---|---|---|---|---|---|---|---|
| | Points | | | Lose Play (Outs) | | | | |
| | | | Min. | Start Turns = 3 | | | | |
| | Center | | Speed | Orientation | | | End Zone Detect | |
| Game | Link Pass on/off | Speed Points | on/off (ft/sec.) | (Tilt) on/off (max degs, absolute) | | | End Zone1 | End Zone2 |
| Type | points | on/off | Points | Roll | Pitch | Yaw | detect | detect |
| I | on 100 points | off | 5 fps min 50 points | 20 | 20 | off | on | off |
| II | on 50 points | on | 10 200 pts | 30 | 30 | off | off | off |
| III | off | on | off | 90 | 90 | off | off | off |
| . . . | . . . | . . . | . . . | . . . | . . . | . . . | . . . | . . . |
| . . . | . . . | . . . | . . . | . . . | . . . | . . . | . . . | . . . |
| user def1 | on 50 points | off | off | off | off | off | on | on |
| user def2 | on 20 points | off | off | off | off | off | off | off |

Referring to Table 3, the game type indicates a game type which may be selected by the system and/or user (e.g., see act 5103). The game types may include custom settings as may be set by, for example, a user (e.g., see, user def1 and user def2). For each game type, points and/or lost plays may be determined in accordance with various criteria which may be set by the system and/or user. For example, with regard to points, the "Center Link Pass on/off points" column includes information relevant to determining points which may be earned by a corresponding user each time an HCS passes a center link (or other predetermined zone) of an apparatus of the present system. Thus, if set to an "on" setting each time an HCS is determine to pass (e.g., as sensed during act 1905) the center link (or other predetermined zone), the corresponding points (e.g., 100 points for game type I, 50 for game type II, and 20 for user defined game type 2) will be awarded to a corresponding player. With regard to the "speed/points" setting, when enabled, the controller may determine a speed of the HCS in a speed trap (e.g. in corresponding direction) each time the HCS passes a speed trap (or other predetermined zone) corresponding to the user and may compare this speed with a threshold speed. Accordingly, if it is determined that the determined speed of the HCS is greater than or equal to the threshold speed, the controller may award the corresponding player corresponding points. However, if it is determined that the speed of the HCS is less than the threshold speed, then no point will be given to the user for speed through the trap.

With regard to the "Min Speed," when enabled, the controller may determine a speed of an HCS at one or more locations (e.g., trap speed at a center link) and compare this speed to a threshold speed value (5 feet per second minimum for type I games) and when it is determined that the speed of the HCS is greater than or equal to the threshold speed value, a corresponding number of points (e.g. 50 points) may be awarded to the user.

With regard to orientation or tilt, this selection may include information related to roll pitch and/or yaw as indicated by "roll," "tilt," and/or "yaw" settings, respectively, which, when enabled (e.g. "on"), the controller may determine corresponding roll, pitch, and/or yaw of the apparatus and compare these values to corresponding threshold values for roll, pitch, and/or yaw, respectively. Accordingly, if it is determined that the roll, pitch, and/or yaw of the apparatus is greater than or equal to corresponding threshold values for roll, pitch, and/or yaw, respectively, the controller may subtract a turn from a user (e.g., a user is out or loses a play) and may inform a corresponding user of such loss of a turn. However, it is determined that the roll, pitch, and/or yaw of the apparatus is less than corresponding threshold values for roll, pitch, and/or yaw, respectively, the controller may continue a current game.

With regard to end zone detection such as illustrated by "end zone1" and "end zone2" detect, when enabled, the controller may determine whether an HCS has traveled into a corresponding end zone (e.g., end zone1 and end zone2) which may be otherwise referred to as a prohibited zone (e.g. a zone adjacent to a handle of a link) of a corresponding player (e.g., end zones of a first link pair for a first player and end zones of a second link pair of a second player, etc. Accordingly, if it is determined that an HCS has traveled into a corresponding end zone, the controller may subtract a turn from a user (e.g., a user is out or loses a play) and may inform a corresponding user of such loss of a turn.

The GR may be stored in a memory of the system and/or may be accessed by the process in accordance with a user's selection and/or default rules. Accordingly, the process may obtain the corresponding GR from the memory of the system and/or may configure the controller accordingly. The GR may be stored using any suitable method, for example, in accordance with embodiments of the present system, the game type information and/or game rules may be stored in one or more tables. A user may then select game type and/or game rule information to be selected stored in accordance with a certain game type such as a user-defined game type (e.g., user defined game type 1=points calculated in accordance with passes (e.g., past a center link) and speed for each pass, expert player level; user defined game type 2=points calculated in accordance with passes, novice player level), etc. In yet other embodiments, it is envisioned that the game rule information may be selected by a user independent of game type information. After completing act 5107, the process may continue to act 5109, where the process may render the determined GI on a UI of the system such as on a display and/or via a speaker output. Accordingly, the process may generate a window such as the window shown in the screen shot of FIG. 17. After completing act 510, the process may continue to act 5111.

During act 5111, the process may update a game history in accordance with the current GI. The game history may include information related to a user, dates, and the GI and may be stored in a memory of the system for later use. After completing act 5111, the process may continue to act 5113 where it ends.

Figure 52:
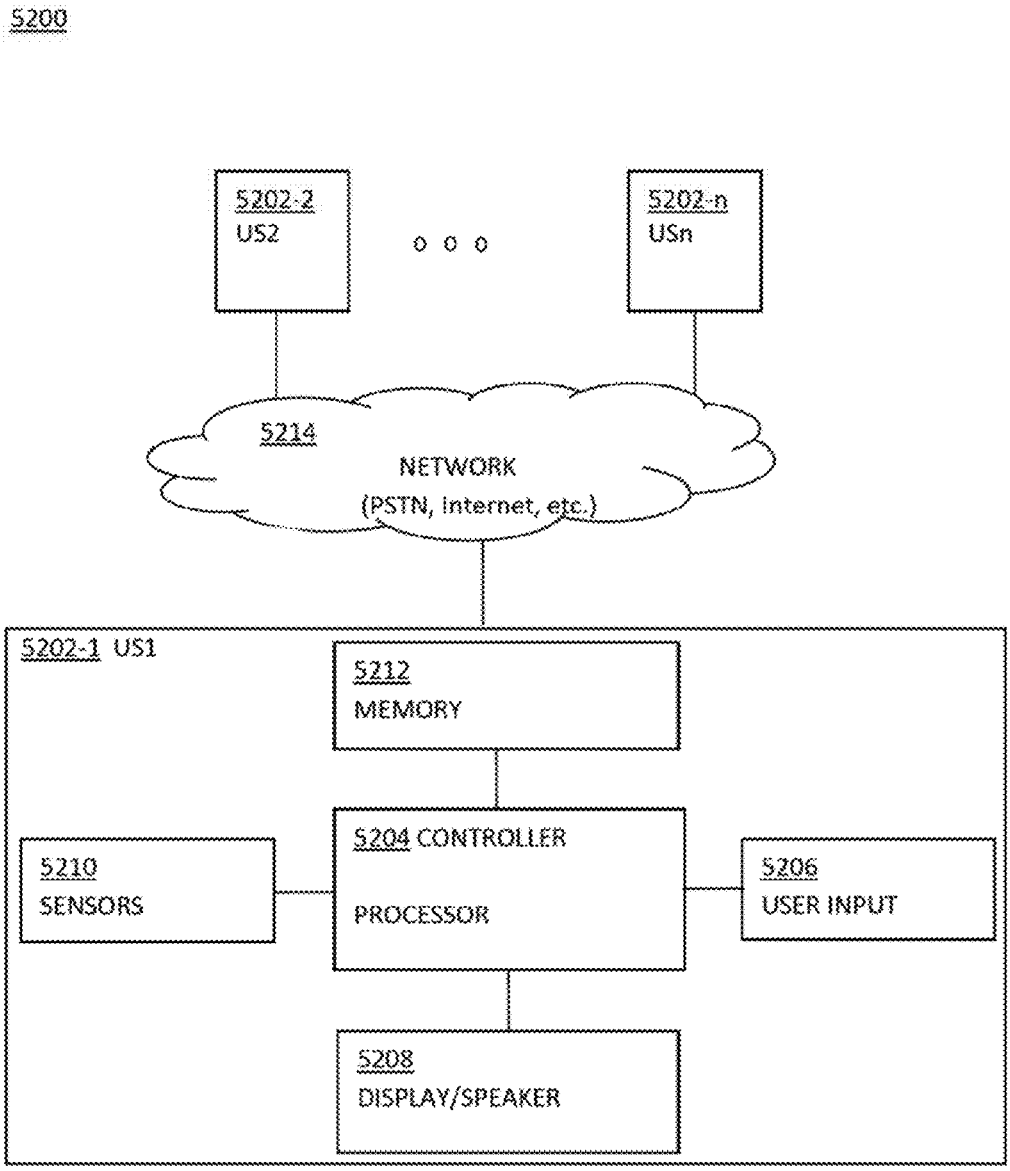
FIG. 52 is a portion of a system (e.g., peer, server, etc.) in accordance with embodiments of the present system.

FIG. 52 shows a portion of a system 5200 (e.g., peer, server, etc.) in accordance with embodiments of the present system. The system may include one or more of a network 5214 and one or more user stations US1-US-n 5202-1 through and **5202-*n*, respectively (generally USs 5202-*x*). The one or more USs 5202-*x* may be similar to, or different from, each other. However, for the sake of clarity, operative features of the US1 5202-1 will be discussed in detail. Accordingly, the US1 5202-1 may include one or more of a controller 5204, a memory 5212, one or more sensors 5210, a user input 5206, a display/speaker 5208, and a communication portion to communicate with a network such as the network 5214 via wired and/or wireless methods. The controller 5204 may be operationally coupled to the memory 5212, the display/speaker (e.g., a rendering device) 5208, the one or more sensors 5210, and the user input device 5206. The controller 5204 may include one or more processors which may be locally and/or remotely located relative to each other. The memory 5212 may be any type of device for storing application data as well as other data related to the described operation of the system 5200 in accordance with embodiments of the present system. The memory 5212 may include one or more storage areas which may be local and/or remote from the US1 5202-1. For example, the memory may include a local memory and/or a surface area network (SAN) memory which may be accessible via the network 5214. The application data and/or other data (e.g., the GR, etc.) may received by the controller 5204 and may configure (e.g. program) the controller 5204 to perform operation acts in accordance with one or more embodiments of the present system. Accordingly, the controller 5204** so configured may become a special purpose machine particularly suited for performing in accordance with one or more embodiments of the present system.

The operation acts may include requesting, providing, updating, and/or tendering of content such as game information. The user input 5206 may include any suitable user input device such as a keyboard, keys (e.g. hard or soft), a mouse, trackball, a pointing device, and/or other devices, such as touch-sensitive displays or pads, which may be stand alone and/or may be a part of a system, such as a part of a personal computer (PC), a personal digital assistant (PDA), a mobile phone, a smart phone (e.g., an IPhone™, etc.), a set top box, or other device for communicating with the controller 5204 via any operable link. The user input device 5206 may be operable for interacting with the controller 5204 including enabling interaction within a UI as described herein, Thus, the controller 5204, the memory 5212, display 5208 and/or user input device 5206 may all or partly be a portion of a computer system or other device such as a client and/or server as described herein. The controller 5204 may include one or more processors (e.g., micro-processors) or logic devices which may be locally and/or remotely located relative to each other.

The methods of the present system are particularly suited to be carried out by a computer software program, such program containing modules corresponding to one or more of the individual steps and/or acts described and/or envisioned by the present system. Such program may be embodied in a computer-readable medium, such as an integrated chip, a peripheral device, or memory, such as the memory 5212 or other memory coupled to the controller 5204.

The program and/or program portions contained in the memory 5212 configure the processors of the controller 5204 to implement the methods, operational acts, and functions disclosed herein. The memories may be distributed, for example between the clients and/or servers, or local, and the controller 5204, where additional processors may be provided, may also be distributed or may be singular. The memories may be implemented as electrical, magnetic or optical memory, or any combination of these or other types of storage devices. Moreover, the term "memory" should be construed broadly enough to encompass any information able to be read from or written to an address in an addressable space accessible by the controller 5204. With this definition, information accessible through a network is still within the memory, for instance, because the controller 5204 may retrieve the information from the network for operation in accordance with the present system. The controller 5204 may communicate with the network using any suitable method(s) such as wired and/or wireless methods.

The network 5214 may include one or more networks such as telephony network (e.g. a PSTN, a POTs network, a 3G, 4G, etc. network, etc.) and/or other communication network(s) such as a proprietary network, a wide area network (WAN), a local area network (LAN), the Internet, a local bus, etc.

The controller 5204 is operable for providing control signals and/or performing operations in response to input signals from the user input device 5206, the sensors 5210, as well as in response to other devices of a network (e.g., memory device, sensors, USs, etc.) and executing instructions stored in the memory 5212. The controller 5204 may be an application-specific or general-use integrated circuit(s). Further, the controller 5204 may be a dedicated process for performing in accordance with the present system or may be a general-purpose processor wherein only one of many functions operates for performing in accordance with the present system. The controller 5204 may operate utilizing a program portion, multiple program segments, or may be a hardware device utilizing a dedicated or multi-purpose integrated circuit.

Further variations of the present system would readily occur to a person of ordinary skill in the art and are encompassed by the following claims. Through operation of the present system, a virtual environment solicitation may be provided to a user to enable simple immersion into a virtual environment (e.g., a virtual reality (VR) environment) and its objects.

Finally, the above-discussion is intended to be merely illustrative of embodiments of the present system and should not be construed as limiting the appended claims to any particular embodiment or group of embodiments. Thus, while the present system has been described with reference to exemplary embodiments, it should also be appreciated that numerous other embodiments modifications, and variations can be devised by those having ordinary skill in the art without departing from the broader and intended spirit and scope of the present system as set forth in the claims that follow. In addition, the section headings included herein are intended to facilitate a review but are not intended to limit the scope of the present system. Accordingly, the specification and drawings are to be regarded in an illustrative manner and are not intended to limit the scope of the appended claims.

In interpreting the appended claims, it should be understood that: a) the words "comprising" or "comprises" do not exclude the presence of other elements or acts than those listed in a given claim; b) the words "a" or "an" preceding an element do not exclude the presence of a plurality of such elements: c) any of the disclosed elements may be comprised of hardware portions (e.g., including discrete and integrated electronic circuitry), software portions (e.g., computer programming), and/or any combination thereof; d) hardware portions may include analog and/or digital portions; e) any of the disclosed devices, apparatus, and/or portions thereof may be combined together or separated into further portions unless specifically stated otherwise; f) no specific sequence of acts or steps is intended to be required unless specifically indicated; and g) the term "plurality of" an element may include two or more of the claimed element, and does not imply any particular range of number of elements; that is, a plurality of elements may be as few as two elements, and may include an immeasurable number of elements.

What is claimed is:

1. A toy comprising:

a spring having first and second ends and a plurality of turns situated therebetween, the first and second ends of the spring coupled together so as to form a center opening;

first through fourth links each having first and second ends and being coupled together at the first ends so as to form first and second pairs of adjacent links, at least one of the first and second pairs of adjacent links extending through the center opening of the spring and configured to enable travel of the spring along at least one of the first and second pairs of links which pass through the opening of the spring.

2. The toy according to claim 1, further comprising a spring coupler which couples the ends of the spring together.

3. The toy according to claim 2, wherein the spring coupler comprises one or more of an adhesive, a hook-and-loop fastener, a friction-type fastener, a threaded fastener, and a magnetic fastener.

4. The toy according to claim 1, wherein the spring forms a torus-like shape in a relaxed closed state.

5. The toy according to claim 1, further comprising at least one coupler which couples the first ends of the first through fourth links together.

6. The toy according to claim 1, further comprising a center link coupled to each of the first through fourth links.

7. The toy according to claim 1, further comprising at least one center link which hingedly couples the first through fourth links together.

8. The toy according to claim 1, further comprising one or more sensors which:

sense one or more of a proximity of the spring, a velocity or speed of the spring, an acceleration of the spring, an angular position of one or more of the first through fourth links, an orientation of the toy, and an acceleration of the toy; and form corresponding sensor information.

9. The toy according to claim 8, further comprising a controller which receives the sensor information and determines a corresponding score for at least one user.

10. The toy according to claim 9, further comprising at least one illumination source or a speaker to render information received from the controller.

11. The toy according to claim 1, further comprising a rotational coupler configured to rotationally couple cross-opposed links of the first through fourth links with each other such that the cross-opposed links are rotationally coupled together.

12. The toy according to claim 1, wherein a distance between the second ends of links of a corresponding link pair of the first and second link pairs can be varied.

13. The toy according to claim 1, wherein the spring rotates in a substantially poloidal direction about its central axis when traveling along at least one of the first through fourth links which passes through the center opening of the spring.

14. A toy comprising:

a spring having first and second ends and a plurality of turns situated therebetween, the first and second ends of the spring coupled together so as to form a center opening;

a first link having a body situated between opposed ends; and a second link having a body situated between opposed ends and being coupled to the first link to enable an angle between the first and second links to be varied, the first and second links extending through the center opening of the spring and being configured control tension of the spring.

15. The toy according to claim 14, further comprising third and fourth links each having a body situated between opposed ends and being coupled to at least one of the first and second links so that an angle between the third and fourth links can vary.

16. A toy comprising:

a spring forming a torus-like shape having a center opening; and first through fourth links each having first and second ends and being coupled together at their respective first ends so as to form first and second pairs of adjacent links, at least one of the first and second pairs of adjacent links extending through the center opening of the spring and being configured to enable travel of the spring along at least one of the first and second pairs of links which pass through the opening of the spring.

17. The toy according to claim 16, further comprising at least one coupler which couples the first ends of the first through fourth links together.

18. The toy according to claim 17, wherein the coupler further comprises a center link which is coupled to each of the first through fourth links.

19. The toy according to claim 16, further comprising at least one center link which hingedly couples the first through fourth links together.

20. The toy according to claim 16, further comprising a rotational coupler configured to rotationally couple cross-opposed links of the first through fourth links with each other such that the cross-opposed links are rotationally coupled together.

* * * * *